US006084610A

United States Patent [19]

Ozaki et al.

[11] Patent Number: 6,084,610

[45] **Date of Patent: *Jul. 4, 2000**

[54] INK JET RECORDING METHOD AND APPARATUS, INK AND INK CARTRIDGE

[75] Inventors: Mitsuo Ozaki; Shigeharu Suzuki; Shino Sakai; Keita Akeno; Shigeyoshi Umemiya; Masahiro Mori; Takefumi Inagaki; Hiroo Ueda, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/585,196

[22] Filed: Jan. 11, 1996

[30] Foreign Application Priority Data

| | | | |
|---|---|---|---|
| Jan. 13, 1995 | [JP] | Japan | 7-004350 |
| Nov. 15, 1995 | [JP] | Japan | 7-297049 |

[51] Int. Cl.[7] ..... B41J 2/21

[52] U.S. Cl. ..... 347/43; 347/15

[58] Field of Search ..... 347/43, 15

[56] References Cited

U.S. PATENT DOCUMENTS

| | | | |
|---|---|---|---|
| 4,604,654 | 8/1986 | Sakurada et al. | 347/15 X |
| 5,477,248 | 12/1995 | Sugimoto et al. | 347/43 |
| 5,570,118 | 10/1996 | Rezenka et al. | 347/100 X |

FOREIGN PATENT DOCUMENTS

| | | |
|---|---|---|
| 0517 468 A2 | 12/1992 | European Pat. Off. . |
| 0580 449 A1 | 1/1994 | European Pat. Off. . |
| 0 583 27 A2 | 2/1994 | European Pat. Off. . |
| 0692 396 A1 | 1/1996 | European Pat. Off. . |
| 59-215889 | 12/1984 | Japan . |
| 60-197776 | 10/1985 | Japan . |
| 62-271778 | 11/1987 | Japan . |
| 63-299939 | 12/1988 | Japan . |
| 2-16078 | 1/1990 | Japan . |
| 2-175253 | 7/1990 | Japan . |
| 3-2046 | 1/1991 | Japan . |
| 3-45379 | 2/1991 | Japan . |
| 3-142252 | 6/1991 | Japan . |
| 3-146355 | 6/1991 | Japan . |
| 4-211984 | 8/1992 | Japan . |
| 4-239068 | 8/1992 | Japan . |
| 4-355157 | 12/1992 | Japan . |
| 4-364961 | 12/1992 | Japan . |
| 5-69538 | 3/1993 | Japan . |
| 5-96720 | 4/1993 | Japan . |
| 6-23973 | 2/1994 | Japan . |
| 6-92010 | 4/1994 | Japan . |
| 6-143795 | 5/1994 | Japan . |
| 6-328678 | 11/1994 | Japan . |
| 6-344652 | 11/1994 | Japan . |
| 37 02 340 C2 | 6/1988 | Netherlands . |

OTHER PUBLICATIONS

HP Journal "Printing on Plain Paper with a Thermal Inkjet Printer" Dec. 1988, No. 8, pp. 39–44.

"New Science of Paper" by Takuya Kadoya, Chugai Sangyo Chosakai, pp. 345–370, Jun. 12, 1994.

*Primary Examiner*—N. Le

*Assistant Examiner*—Shih-Wen Hsieh

*Attorney, Agent, or Firm*—Armstrong, Westerman, Hattori, McLeland & Naughton

[57] ABSTRACT

An ink jet recording method records an image on a recording medium by adhering inks of a plurality of hues on the recording medium. The ink jet recording method includes the steps of (a) carrying out a recording using two kinds of inks having different diffusibilities with respect to the recording medium for at least a predetermined one of the hues, where a first ink out of the two kinds of inks has a diffusibility which is lower than a diffusibility of an ink having a hue other than the predetermined hue, and (b) at a boundary portion on the recording medium where a first recording region which includes the predetermined hue and a second recording region which includes a hue different from the predetermined hue are adjacent to each other, recording at least a portion of the boundary region with a predetermined recording width up to the second recording region using a second ink out of the two kinds of inks having a diffusibility higher than that of the first ink and recording a remaining portion of the boundary region using the second ink.

38 Claims, 44 Drawing Sheets

FIG. 17A

XYZ[\]^_`abcde
áíóúñÑªº¿⌐¬½¼¡

FIG. 17B

XYZ[\]^_`abcde
áíóúñÑªº¿⌐¬½¼¡

X : Y, M, C, K, K', R(=Y+M), G(=Y+C), B(=M+C)

FIG.20

EACH COLOR PRINT DATA
(YELLOW $d_{Y0,0}\ d_{Y1,0} \cdots d_{Ya,0} \cdots d_{Ym,n} \cdots d_{Ya,1} \cdots d_{Ya,b}$)
(MAGENTA $d_{M0,0}\ d_{M1,0} \cdots d_{Ma,0} \cdots d_{Mm,n} \cdots d_{Ma,1} \cdots d_{Ma,b}$)
(CYAN $d_{C0,0}\ d_{C1,0} \cdots d_{Ca,0} \cdots d_{Cm,n} \cdots d_{Ca,1} \cdots d_{Ca,b}$)
(BLACK $d_{K0,0}\ d_{K1,0} \cdots d_{Ka,0} \cdots d_{Km,n} \cdots d_{Ka,1} \cdots d_{Ka,b}$)

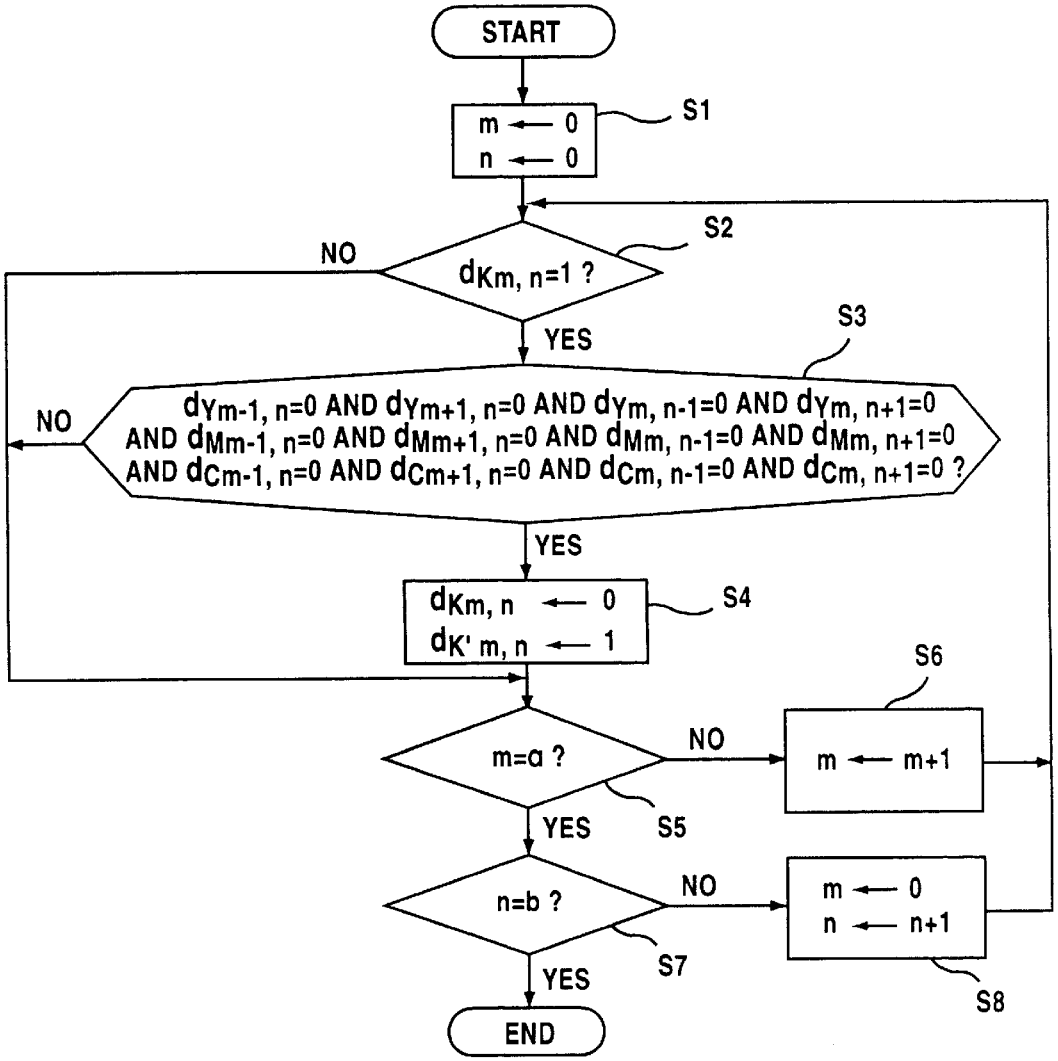

EACH COLOR PRINT DATA
(YELLOW $d_{Y0,0}\ d_{Y1,0} \cdots d_{Ya,0} \cdots d_{Ym,n} \cdots d_{Ya,1} \cdots d_{Ya,b}$)
(MAGENTA $d_{M0,0}\ d_{M1,0} \cdots d_{Ma,0} \cdots d_{Mm,n} \cdots d_{Ma,1} \cdots d_{Ma,b}$)
(CYAN $d_{C0,0}\ d_{C1,0} \cdots d_{Ca,0} \cdots d_{Cm,n} \cdots d_{Ca,1} \cdots d_{Ca,b}$)
(HI DIFF BLACK $d_{K0,0}\ d_{K1,0} \cdots d_{Ka,0} \cdots d_{Km,n} \cdots d_{Ka,1} \cdots d_{Ka,b}$)
(LOW DIFF BLACK $d_{K'0,0}\ d_{K'1,0} \cdots d_{K'a,0} \cdots d_{K'm,n} \cdots d_{K'a,1} \cdots d_{K'a,b}$)

FIG.33

| INK | SURFACE TENSION (dyne/cm) | BLEEDING | BLENDING |
|---|---|---|---|
| A | 53 | ○ | × |
| B | 33.6 | × | ○ |

FIG.34

| INK | DYE DENSITY (wt%) | RECORDING TONE (O.D) |
|---|---|---|
| I1 | 4 | 1.44 |
| I2 | 4 | 0.98 |

FIG.35

| INK | COLORING MATERIAL DENSITY (wt%) | RECORDING TONE (O.D) |
|---|---|---|
| I3 | 2 | 1.25 |
| I4 | 10 | 1.12 |

FIG.36

| OVERLAPS | RECORDING TONE (O.D.) |
|---|---|
| 1 | 0.92 |
| 2 | 1.07 |
| 3 | 1.13 |

FIG.37

| INK | OVERLAPS | DYE INTENSITY (wt%) | RECORDING TONE (O.D.) |
|---|---|---|---|
| I5 | 1 | 3 | 1.25 |
| I6 | 2 | 6 | 1.12 |

FIG.40

| INK | CONTACT ANGLE (deg.) | BLEEDING | BLENDING |
|---|---|---|---|
| C | 102 | ○ | × |
| D | 51 | × | ○ |

FIG.41

| INK | CONTACT ANGLE (deg.) |
|---|---|
| C | 105 |
| D | 85 |

FIG.42

| | 1ST COPIER PAPER | | 2ND COPIER PAPER | | 3RD COPIER PAPER | |
|---|---|---|---|---|---|---|
| | COEFFICIENT Ka | BLEEDING | COEFFICIENT Ka | BLEEDING | COEFFICIENT Ka | BLEEDING |
| INK K'1 | 4.5 | ○ | 8.4 | ○ | 15 | × |
| INK K'2 | 6.1 | ○ | 9.4 | ○ | 52 | × |
| INK K'3 | 7.1 | ○ | 11 | △ | 65 | × |
| INK K'4 | 42 | × | 41 | × | 90 | × |
| INK K'5 | 102 | × | 111 | × | 98 | × |

FIG.43

| | COEFFICIENT Ka | | | | PRINT QUALITY EVALUATION BLENDING |
|---|---|---|---|---|---|
| | Y | M | C | K | |
| INK 6 | 4.5 | 8.4 | 15 | 15 | × |
| INK 7 | 50 | 55 | 66 | 77 | △ |
| INK 8 | 102 | 89 | 100 | 105 | ○ |
| INK 9 | 120 | 170 | 110 | 120 | ○ |

FIG.44

| | COEFFICIENT Ka | | | | PRINT QUALITY EVALUATION BLENDING |
|---|---|---|---|---|---|
| | Y | M | C | K | |
| INK 10 | 108 | 100 | 92 | 125 | ○ |
| INK 11 | 117 | 104 | 100 | 113 | ○ |
| INK 12 | 150 | 125 | 150 | 146 | ○ |
| INK 13 | 116 | 80 | 102 | 124 | ○ |
| INK 14 | 40 | 50 | 46 | 44 | △ |
| INK 15 | 83 | 105 | 94 | 102 | ○ |

INK JET RECORDING METHOD AND APPARATUS, INK AND INK CARTRIDGE

BACKGROUND OF THE INVENTION

The present invention generally relates to ink jet recording methods and apparatuses, inks and ink cartridges, and more particularly to an ink jet recording method, an ink jet recording apparatus, an ink and an ink cartridge which are suited for suppressing blending, bleeding or the like so that a high quality recording is possible.

Various kinds of ink jet recording methods have been proposed. For example, in the bubble (or thermal) system, the ink is heated to generate bubbles and the pressure introduced by the bubbles is used to eject the ink. According to the piezoelectric system or the acoustic wave system, a piezoelectric element or an acoustic wave generating element is used to mechanically vibrate or displace the ink so as to eject the ink. In addition, systems which eject the ink from a nozzle using a magnetic field or an electric field have also been proposed. According to these ink jet recording methods, the recording is made by ejecting droplets of ink so that a portion or all of the droplets are adhered on a recording medium. For this reason, no noise is generated during the recording, and it is possible to make color recordings at a high speed.

Normally, the main component of the ink that is used for the ink jet recording is made up of coloring material such as dye and pigment and which is used as the recording agent, and liquid medium. For safety reasons and to obtain a satisfactory recording characteristic, water soluble dye and preferably acid dye or direct dye are used as the recording agent. On the other hand, for safety reasons and to ensure a satisfactory recording characteristic, liquids having water as the main component are used as the liquid medium. In addition, polyhydric alcohol or the like is often added to the liquid medium so as to prevent the nozzle of a head from becoming blocked and to stabilize the ink ejection.

The recording medium that is used by the ink jet recording apparatus includes normal or plain paper such as woodfree copier paper used in copying machines, and paper which is also sometimes referred to as ink jet recording paper (or sheet). The ink jet recording paper is made up of a base and an ink absorbable and/or ink soluble ink receptor layer which is provided on the base. However, because the performance of the ink jet recording apparatus has improved and it is possible to make color recordings at a high recording speed, there are now new demands to be satisfied. Among such new demands, there is a demand to stably fix the ink on the recording medium at a high speed so that the blending or bleeding of the ink is not notable even on the plain paper.

When inks having different colors are mixed at a boundary of the two colors, the blending occurs and the recording quality deteriorates. Hence, various methods have been proposed to suppress this blending, such as the methods (1) through (7) described in the following.

According to the method (1), the boundary tension between the two inks having the different colors and forming the color boundary is set large. This method (1) is proposed in a Japanese Laid-Open Patent Application No.2-175253, for example.

The method (2) makes the diffusibilities of the inks with respect to the recording medium different. The diffusibility of the ink refers to the property of the ink used to indicate the ease with which the ink is diffuses into the recording medium and is absorbed by the recording medium. This method (2) is proposed in Japanese Laid-Open Patent Applications No.4-355157 and No.4-364961, for example.

According to the method (3), no ink is adhered on the color boundary portion to make the color boundary portion void. This method (3) is proposed in a Japanese Laid-Open Patent Application No.3-146355, for example.

The method (4) completes the recording by carrying out thinned recording a plurality of times. This method is also proposed in the Japanese Laid-Open Patent Application No.3-146355, for example.

According to the method (5), an ink repellent agent is coated on the recording medium in advance, so that the inks having the different colors will not make contact at the color boundary by preventing the diffusion and spreading of the ink with respect to the recording medium. This method (5) is proposed in a Japanese Laid-Open Patent Application No.3-002046, for example.

The method (6) reduces the number of ink particles or the amount of ink that is adhered on the color boundary portion.

The method (7) uses a fixing unit which forcibly evaporates the ink that is adhered on the recording medium.

However, according to the methods (1) and (2), the diffusibilities of the inks with respect to the recording medium are different. For this reason, when the recording is made by the ink having the large diffusibility, the bleeding or blur at the edge of the recorded portion becomes large along the fiber of the paper. As a result, the recorded image is not sharp, and there was a problem in that picture quality greatly deteriorates.

On the other hand, according to the method (3), a white unrecorded portion is formed at the color boundary portion in the case where the recording medium used is white paper. Hence, there was a problem in that the picture quality of the image as a whole and the recording tone deteriorate. Particularly at the color boundary portion of dark colors having a large contrast with respect to the white background of the paper, the picture quality deterioration was considerable.

Furthermore, according to the method (4), the number of scans made by the recording head with respect to the recording medium becomes large, and there was a problem in that the recording speed becomes low.

According to the method (5), the size of the dots formed by the ink becomes small, and there was a problem in that the picture quality deteriorates because the recording tone becomes poor and/or the dots become uneven or non-uniform. In addition, the user must use a special recording medium, thereby making it inconvenient for the user.

Moreover, according to the method (6), there was a problem in that the picture quality becomes poor due to deterioration in the resolution at the color boundary portion and the deterioration of the recording tone.

According to the method (7), it is necessary to provide a fixing unit which is relatively large. As a result, there were problems in that the ink jet recording apparatus becomes large and the power consumption increases.

On the other hand, when recording line drawings and general images on the recording medium with a desired resolution by the ink jet recording apparatus, it is necessary to adjust the amount of ink that is ejected from the head so that the obtained dot size is suited for the predetermined resolution. The spreading of the dot on the recording medium is smaller for the ink having the low diffusibility than the ink having the high diffusibility, and the amount of ink recorded on the recording medium is larger for the ink having the low diffusibility as compared to the ink having the high diffusibility. This tendency is notable in the case of copier paper which is subjected to a sizing process or the like which suppresses diffusion of the ink into the recording medium, and plain paper such as bond paper and post card. On the other hand, in the case of ink jet recording paper such as the coated paper exclusively for use in the ink jet recording, overhead projector (OHP) film and glossy paper, the ink acceptor layer is provided on the base paper/film so that the ink absorption is uniform and/or fast. Hence, the effects of the diffusibility of the ink on the ink absorptivity (or permeability) of the recording medium is relatively small in the case of the ink jet recording paper. For example, the ink acceptor layer is made of hydrophilic and water absorbent polymers and resins such as polyvinyl alcohol and cationic resins, pigment, binder and the like.

Therefore, the behaviors of the inks having different diffusibilities on the recording medium greatly differ, and there was a problem in that it is difficult to design a recording medium which guarantees a sufficiently high performance with respect to each of the various inks.

In addition, the diameter of the nozzle of the head is on the order of 50 $\mu$m to 100 $\mu$m and very small. Hence, a solvent which is non-volatile and hygroscopic is added to the ink so that the ink will not evaporate and dry up at the tip end of the nozzle (nozzle orifice) to block the nozzle orifice. However, although it is possible to prevent blocking of the nozzle orifice caused by the deposition of the dye within the nozzle orifice, the increase of the ink viscosity caused by the evaporation of the solvent cannot be avoided. As the ink viscosity increases, the ink injecting direction becomes unstable, and an error is generated in the position of the dot recorded on the recording medium. In extreme cases, it no longer becomes possible to inject the ink because of the increased ink viscosity, and the dot to be recorded on the recording medium becomes omitted or drops out. In order to prevent these inconveniences, there was a proposal to provide a backup unit and to spray the ink from the nozzle into the backup unit before the ink viscosity becomes too large so as to clear the nozzle orifice. But the ink viscosity depends on the kind and density of the wetting agent, dye and the like included within the ink. Although the ink viscosities of the various kinds of inks used in one ink jet recording apparatus may be different, the conventional ink jet recording apparatus gave absolutely no consideration as to the differences in the ink viscosities among the various kinds of inks.

SUMMARY OF THE INVENTION

Accordingly, it is a general object of the present invention to provide a novel and useful ink jet recording method and apparatus, ink and ink cartridge in which the problems described above are eliminated.

In other words, the general object of the present invention is to provide an ink jet recording method and apparatus, ink and ink cartridge which can realize a high quality recording.

More particularly, a first object of the present invention is to provide an ink jet recording method and apparatus, ink and ink cartridge which can suppress the blending at the color boundary portion, so that no difference occurs in the recording tone, contrast and color saturation at the recording portions of the same hue and/or no bleeding occurs when characters or the like are printed.

A second object of the present invention is to provide an ink jet recording method and apparatus which can realize a high quality recording which introduces no unevenness in the recording tone even when inks having different diffusibilities are used.

A third object of the present invention is to provide an ink jet recording method and apparatus which can realize a high quality recording with a high reliability by stabilizing the ink injection which is otherwise affected by the ink viscosity.

Another and more specific object of the present invention is to provide an ink jet recording method which records an image on a recording medium by adhering inks of a plurality of hues on the recording medium, comprising the steps of (a) carrying out a recording using two kinds of inks having different diffusibilities with respect to the recording medium for at least a predetermined one of the hues, a first ink out of the two kinds of inks having a diffusibility which is lower than a diffusibility of an ink having a hue other than the predetermined hue, and (b) at a boundary portion on the recording medium where a first recording region which includes the predetermined hue and a second recording region which includes a hue different from the predetermined hue are adjacent to each other, recording at least a portion of the boundary region with a predetermined recording width up to the second recording region using a second ink out of the two kinds of inks having a diffusibility higher than that of the first ink and recording a remaining portion of the boundary region using the second ink. According to the ink jet recording method of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

Still another object of the present invention is to provide an ink jet recording method which records an image on a recording medium by adhering inks of a plurality of hues on the recording medium, comprising the steps of preparing inks of a plurality of hues, setting an Rf value of the ink of at least one hue to a value different from Rf values of the inks of other hues, the Rf value indicating a mobility of a coloring material in the ink, and setting the Rf value of the ink having a hue with a first contrast lower than the Rf value of the ink having a hue with a second contrast which is higher than the first contrast. According to the ink jet recording method of the present invention, the first object is achieved. More particularly, it is possible to prevent blending at the boundary portion of the different hues and thus record a clear and sharp color image.

A further object of the present invention is to provide an ink jet recording method which records an image on a recording medium by adhering inks of a plurality of hues on the recording medium, comprising the steps of preparing two kinds of inks for at least one hue such that a difference between contact angles of the inks is 15° or greater with respect to the recording medium, and recording the image using the inks on one or a plurality of kinds of recording mediums so that a combination of the ink and the recording medium results in the difference between the contact angles of the inks. According to the ink jet recording method of the present invention, the first object is achieved. More particularly, it is possible to record high quality line drawings and general images on various kinds of recording mediums including plain paper.

Another object of the present invention is to provide an ink jet recording method which records an image on a recording medium by adhering inks of a plurality of hues on the recording medium, comprising the steps of preparing two kinds of inks for at least one hue such that a difference between surface tensions is 4 dyne/cm or greater, and recording the image on the recording medium by selectively using the two kinds of inks. According to the ink jet recording method of the present invention, the first object is achieved. More particularly, it is possible to record high quality line drawings and general images on various kinds of recording mediums including plain paper.

Still another object of the present invention is to provide an ink jet recording method which records an image on a recording medium by adhering an ink of at least one hue on the recording medium, comprising the steps of preparing at least one kind of ink for one hue such that a diffusibility coefficient Ka ($nl/(mm^2 \cdot s^{1/2})$) of the ink with respect to the recording medium is set to 15 or less, and recording the image on the recording medium using the ink. According to the ink jet recording method of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

A further object of the present invention is to provide an ink jet recording method which records an image on a recording medium by adhering inks of a plurality of hues on the recording medium, comprising the steps of preparing inks of a plurality of hues such that a diffusibility coefficient Ka ($nl/(mm^2 \cdot s^{1/2})$) of each of the inks with respect to the recording medium is set to 40 or greater, and recording the image on the recording medium using the inks. According to the ink jet recording method of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

Another object of the present invention is to provide an ink jet recording method which records an image on a recording medium by adhering inks of a plurality of hues on the recording medium, comprising the steps of recording a first pixel using one or a plurality of inks belonging to a first group and having a diffusibility coefficient Ka ($nl/(mm^2 \cdot s^{1/2})$) with respect to the recording medium set to 15 or less, and recording a second pixel so as not to touch the first pixel using one or a plurality of inks belonging to a second group and having a diffusibility coefficient Ka ($nl/(mm^2 \cdot s^{1/2})$) with respect to the recording medium set to 40 or greater. According to the ink jet recording method of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

Still another object of the present invention is to provide an ink jet recording apparatus which records an image on a recording medium by adhering inks of a plurality of hues on the recording medium, where two kinds of inks having different diffusibilities with respect to the recording medium are used for at least a predetermined one of the hues, a first ink out of the two kinds of inks having a diffusibility which is lower than a diffusibility of an ink having a hue other than the predetermined hue, and the ink jet recording apparatus comprises a head portion having a plurality of heads corresponding to a number of kinds of inks used, and control means for controlling the head portion so that, at a boundary portion on the recording medium where a first recording region which includes the predetermined hue and a second recording region which includes a hue different from the predetermined hue are adjacent to each other, at least a portion of the boundary region is recorded with a predetermined recording width up to the second recording region using a second ink out of the two kinds of inks having a diffusibility higher than that of the first ink and a remaining portion of the boundary region is recorded using the second ink. According to the ink jet recording apparatus of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

A further object of the present invention is to provide an ink jet recording apparatus which records an image on a recording medium by adhering inks of a plurality of hues on the recording medium, where an Rf value of the ink of at least one hue is set to a value different from Rf values of the inks of other hues, the Rf value indicates a mobility of a coloring material in the ink, the ink jet recording apparatus comprises a head portion having a plurality of heads corresponding to a number of kinds of inks used, and control means for controlling the head portion to eject the inks onto the recording medium, where the Rf value of the ink has a hue with a first contrast being set lower than the Rf value of the ink having a hue with a second contrast which is higher than the first contrast. According to the ink jet recording apparatus of the present invention, the first object is achieved. More particularly, it is possible to prevent blending at the boundary portion of the different hues and thus record a clear and sharp color image.

Another object of the present invention is to provide an ink jet recording apparatus which records an image on a recording medium by adhering inks of a plurality of hues on the recording medium, where two kinds of inks for at least one hue have contact angles such that a difference between the contact angles of the inks is 15° or greater with respect to the recording medium, and the ink jet recording apparatus comprises a head portion having a plurality of heads corresponding to a number of kinds of inks used, and control means for controlling the head portion to record the image using the inks on one or a plurality of kinds of recording mediums so that a combination of the ink and the recording medium results in the difference between the contact angles of the inks. According to the ink jet recording apparatus of the present invention, the first object is achieved. More particularly, it is possible to record high quality line drawings and general images on various kinds of recording mediums including plain paper.

Still another object of the present invention is to provide an ink jet recording apparatus which records an image on a recording medium by adhering inks of a plurality of hues on the recording medium, where two kinds of inks for at least one hue have surface tensions such that a difference between the surface tensions is 4 dyne/cm or greater, and the ink jet recording apparatus comprises a head portion having a plurality of heads corresponding to a number of kinds of inks used, and control means for controlling the head portion to record the image on the recording medium by selectively ejecting the two kinds of inks onto the recording medium. According to the ink jet recording apparatus of the present invention, the first object is achieved. More particularly, it is possible to record high quality line drawings and general images on various kinds of recording mediums including plain paper.

A further object of the present invention is to provide an ink jet recording apparatus which records an image on a recording medium by adhering an ink of at least one hue on the recording medium, where at least one kind of ink for one hue has a diffusibility such that a diffusibility coefficient Ka ($nl/(mm^2 \cdot s^{1/2})$) of the ink with respect to the recording medium is set to 15 or less, and the ink jet recording apparatus comprises a head portion having a plurality of heads corresponding to a number of kinds of inks used, and control means for controlling the head portion to record the image on the recording medium by ejecting the one kind of ink onto the recording medium. According to the ink jet recording apparatus of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

Another object of the present invention is to provide an ink jet recording apparatus which records an image on a recording medium by adhering inks of a plurality of hues on the recording medium, where inks of a plurality of hues have diffusibilities such that a diffusibility coefficient Ka ($nl/(mm^2 \cdot s^{1/2})$) of each of the inks with respect to the recording medium is set to 40 or greater, and the ink jet recording apparatus comprises a head portion having a plurality of heads corresponding to a number of kinds of inks used, and control means for controlling the head portion to record the image on the recording medium by ejecting the inks onto the recording medium. According to the ink jet recording apparatus of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

Still another object of the present invention is to provide an ink jet recording apparatus which records an image on a recording medium by adhering inks of a plurality of hues on the recording medium, comprising a head portion having a plurality of heads corresponding to a number of kinds of inks used, and control means for controlling the head portion to eject the inks onto the recording medium, where the control means comprises means for controlling the head portion to record a first pixel using one or a plurality of inks belonging to a first group and having a diffusibility coefficient Ka ($nl/(mm^2 \cdot s^{1/2})$) with respect to the recording medium set to 15 or less, and means for controlling the head portion to record a second pixel so as not to touch the first pixel using one or a plurality of inks belonging to a second group and having a diffusibility coefficient Ka ($nl/(mm^2 \cdot s^{1/2})$) with respect to the recording medium set to 40 or greater. According to the ink jet recording apparatus of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

A further object of the present invention is to provide an ink cartridge which stores an ink of a predetermined hue which is used together with inks of a plurality of hues when making an ink jet recording on a recording medium, comprising a cartridge body, and an ink of the predetermined hue stored within the cartridge body, where the ink of the predetermined hue has a diffusibility with respect to the recording medium lower than diffusibilities of the inks of the plurality of hues, and a contrast which is lower than contrasts of the inks of the plurality of hues. According to the ink cartridge of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

Another object of the present invention is to provide an ink cartridge which stores an ink of a predetermined hue which is used together with a black ink when making an ink jet recording on a recording medium, comprising a cartridge body, and an ink of the predetermined hue stored within the cartridge body, where the ink of the predetermined hue has a diffusibility with respect to the recording medium higher than a diffusibility of the black ink, and a contrast which is higher than or equal to a contrast of the black ink. According to the ink cartridge of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

Still another object of the present invention is to provide an ink cartridge which stores an ink of a predetermined hue which is used together with inks of a plurality of hues when making an ink jet recording on a recording medium, comprising a cartridge body, and an ink of the predetermined hue stored within the cartridge body, where the ink of the predetermined hue has a Rf value different from Rf values of the inks of the plurality of hues, and the Rf value of the ink of the predetermined hue is lower than that of the ink of a hue having a contrast higher than a contrast of the predetermined hue, and the Rf value indicates a mobility of a coloring material in the ink. According to the ink cartridge of the present invention, the first object is achieved. More particularly, it is possible to prevent blending at the boundary portion of the different hues and thus record a clear and sharp color image.

A further object of the present invention is to provide an ink cartridge which stores an ink of a predetermined hue which is used together with inks of a plurality of hues when making an ink jet recording on a recording medium, comprising a cartridge body, and an ink of the predetermined hue stored within the cartridge body, where the ink of the predetermined hue has a contact angle greater than or equal to 85° or, less than or equal to 70° with respect to the recording medium. According to the ink cartridge of the present invention, the first object is achieved. More particularly, it is possible to record high quality line drawings and general images on various kinds of recording mediums including plain paper.

Another object of the present invention is to provide an ink cartridge which stores an ink of a predetermined hue which is used together with inks of a plurality of hues when making an ink jet recording on a recording medium, comprising a cartridge body, and an ink of the predetermined hue stored within the cartridge body, where the ink of the predetermined hue has a surface tension greater than or equal to 49 dyne/cm or, less than or equal to 45 dyne/cm. According to the ink cartridge of the present invention, the first object is achieved. More particularly, it is possible to record high quality line drawings and general images on various kinds of recording mediums including plain paper.

Still another object of the present invention is to provide an ink cartridge which stores an ink of a predetermined hue which is used together with inks of a plurality of hues when making an ink jet recording on a recording medium, comprising a cartridge body, and an ink of the predetermined hue stored within the cartridge body, where the ink of the predetermined hue has a diffusibility coefficient Ka (nl/($mm^2 \cdot s^{1/2}$)) less than 15 with respect to the recording medium. According to the ink cartridge of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

A further object of the present invention is to provide an ink cartridge which stores an ink of a predetermined hue which is used together with inks of a plurality of hues when making an ink jet recording on a recording medium, comprising a cartridge body, and an ink of the predetermined hue stored within the cartridge body, where the ink of the predetermined hue has a diffusibility coefficient Ka (nl/($mm^2 \cdot s^{1/2}$)) greater than or equal to 40 with respect to the recording medium. According to the ink cartridge of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

Another object of the present invention is to provide an ink of a predetermined hue which is used together with a black ink when making an ink jet recording on a recording medium, where the ink of the predetermined hue comprises a dye, and a solvent, and a diffusibility of the ink of the predetermined hue with respect to the recording medium is higher than a diffusibility of the black ink, and the ink of the predetermined hue has a contrast which is higher than or equal to a contrast of the black ink. According to the ink of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

Still another object of the present invention is to provide an ink of a predetermined hue which is used together with inks of a plurality of hues when making an ink jet recording on a recording medium, where the ink of the predetermined hue comprises a dye, and a solvent, and the ink of the predetermined hue has a Rf value different from Rf values of the inks of the plurality of hues, and lower than that of the ink of a hue having a contrast higher than a contrast of the predetermined hue, and the Rf value indicates a mobility of a coloring material in the ink. According to the ink of the present invention, the first object is achieved. More particularly, it is possible to prevent blending at the boundary portion of the different hues and thus record a clear and sharp color image.

A further object of the present invention is to provide an ink of a predetermined hue which is used together with inks of a plurality of hues when making an ink jet recording on a recording medium, where the ink of the predetermined hue comprises a dye, and a solvent, and the ink of the predetermined hue has a contact angle greater than or equal to 85° or, less than or equal to 70° with respect to the recording medium. According to the ink of the present invention, the first object is achieved. More particularly, it is possible to record high quality line drawings and general images on various kinds of recording mediums including plain paper.

Another object of the present invention is to provide an ink of a predetermined hue which is used together with inks of a plurality of hues when making an ink jet recording on a recording medium, where the ink of the predetermined hue comprises a dye, and a solvent, and the ink of the predetermined hue has a surface tension greater than or equal to 49 dyne/cm or, less than or equal to 45 dyne/cm. According to the ink of the present invention, the first object is achieved. More particularly, it is possible to record high quality line drawings and general images on various kinds of recording mediums including plain paper.

Still another object of the present invention is to provide an ink of a predetermined hue which is used together with inks of a plurality of hues when making an ink jet recording on a recording medium, where the ink of the predetermined hue comprises a dye, and a solvent, and the ink of the predetermined hue has a diffusibility coefficient Ka (nl/($mm^2 \cdot s^{1/2}$)) less than 15 with respect to the recording medium. According to the ink of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

A further object of the present invention is to provide an ink of a predetermined hue which is used together with inks of a plurality of hues when making an ink jet recording on a recording medium, where the ink of the predetermined hue comprises a dye, and a solvent, and the ink of the predetermined hue has a diffusibility coefficient Ka (nl/($mm^2 \cdot s^{1/2}$)) greater than or equal to 40 with respect to the recording medium. According to the ink of the present invention, the first object is achieved. More particularly, it is possible to record high quality line drawings such as characters free of bleeding, and to record high quality general images such as graphics free of blending. In addition, the differences in the recording tone and hue between the line drawings and the general images can be suppressed.

Another object of the present invention is to provide an ink jet recording method which records a color image on a recording medium using at least first and second inks having the same hue but mutually different diffusibilities and inks of other hues, comprising the steps of recording an image using the first ink which has a diffusibility lower than that of the second ink when the inks of different hues are recorded non-adjacent to each other on the recording medium, and recording the image using the second ink when the inks of the different hues are recorded adjacent to each other on the recording medium, where the second ink has a color material density higher than that of the first ink. According to the ink jet recording method of the present invention, the first object is achieved. More particularly, it is possible to reduce the difference between the recording tones of the line drawings and the general images recorded on the recording medium.

Still another object of the present invention is to provide an ink jet recording method which records a color image on a recording medium using at least first and second inks having the same hue but mutually different diffusibilities and inks of other hues, comprising the steps of recording an image using the first ink which has a diffusibility lower than that of the second ink when the inks of different hues are recorded non-adjacent to each other on the recording medium, and recording the image using the second ink when the inks of the different hues are recorded adjacent to each other on the recording medium, where the recording using one of the first and second inks having a lower recording tone on the recording medium is made a plurality of times in an overlapping manner. According to the ink jet recording method of the present invention, the first object is achieved. More particularly, it is possible to reduce the difference between the recording tones of the line drawings and the general images recorded on the recording medium.

A further object of the present invention is to provide an ink jet recording method which records an image on a recording medium using a first ink and at least a second ink, where the first ink has a diffusibility lower than the second ink, the ink jet recording method comprises the steps of setting an ink quantity of the first ink per unit area to be recorded on the recording medium in one scan of a head portion to an amount less than or equal to an ink quantity of the second ink recorded on the recording medium in one scan of the head portion when a recording characteristic of the recording medium is adjusted with respect to the second ink, and recording a plurality of complementary thinned patterns in a case of full recording and recording a logical product of the plurality of complementary thinned patterns and image data in a case of image data recording when making successive recordings using the first ink by a plurality of scans of the head portion. According to the ink jet recording method of the present invention the second object is achieved. More particularly, it is possible to carry out a high quality recording using the ink having the lower diffusibility so that no unevenness of the recording tone occurs, and it is also possible to secure a time that is required for the ink to dry and fix.

Another object of the present invention is to provide an ink jet recording method which records a color image on a recording medium using inks of two or more hues, comprising the steps of setting viscosities of the inks so that a difference between increases of the viscosities caused by evaporation of solvents of the inks is 1000 cp or less when the inks are released to normal temperature and humidity conditions of 25° C.60% RH, and recording the color image on the recording medium by selectively using the inks. According to the ink jet recording method of the present invention, the third object is achieved. More particularly, it is possible to improve the recording speed by suppressing the ink spray condition of the head to a minimum, where the head sprays the ink to prevent recording defect such as dropout and positional error of the dots caused by increased viscosity of the ink. Further, it is also possible to reduce the ink consumption.

Still another object of the present invention is to provide an ink jet recording apparatus which records a color image on a recording medium using at least first and second inks having the same hue but mutually different diffusibilities and inks of other hues, comprising means for recording an image using the first ink which has a diffusibility lower than that of the second ink when the inks of different hues are recorded non-adjacent to each other on the recording medium, and means for recording the image using the second ink when the inks of the different hues are recorded adjacent to each other on the recording medium, where the second ink has a color material density higher than that of the first ink. According to the ink jet recording apparatus of the present invention, the first object is achieved. More particularly, it is possible to reduce the difference between the recording tones of the line drawings and the general images recorded on the recording medium.

A further object of the present invention is to provide an ink jet recording apparatus which records a color image on a recording medium using at least first and second inks having the same hue but mutually different diffusibilities and inks of other hues, comprising means for recording an image using the first ink which has a diffusibility lower than that of the second ink when the inks of different hues are recorded non-adjacent to each other on the recording medium, and means for recording the image using the second ink when the inks of the different hues are recorded adjacent to each other on the recording medium, where the recording using one of the first and second inks having a lower recording tone on the recording medium is made a plurality of times in an overlapping manner. According to the ink jet recording apparatus the present invention, the first object is achieved. More particularly, it is possible to reduce the difference between the recording tones of the line drawings and the general images recorded on the recording medium.

Another object of the present invention is to provide an ink jet recording apparatus which records an image on a recording medium using a first ink and at least a second ink, where the first ink has a diffusibility lower than the second ink, the ink jet recording apparatus comprises means for setting an ink quantity of the first ink per unit area to be recorded on the recording medium in one scan of a head portion to an amount less than or equal to an ink quantity of the second ink recorded on the recording medium in one scan of the head portion when a recording characteristic of the recording medium is adjusted with respect to the second ink, and means for recording a plurality of complementary thinned patterns in a case of full recording and recording a logical product of the plurality of complementary thinned patterns and image data in a case of image data recording when making successive recordings using the first ink by a plurality of scans of the head portion. According to the ink jet recording apparatus of the present invention the second object is achieved. More particularly, it is possible to carry out a high quality recording using the ink having the lower diffusibility so that no unevenness of the recording tone occurs, and it is also possible to secure a time that is required for the ink to dry and fix.

Still another object of the present invention is to provide an ink jet recording apparatus which records a color image on a recording medium using inks of two or more hues, comprising means for setting viscosities of the inks so that a difference between increases of the viscosities caused by evaporation of solvents of the inks is 1000 cp or less when the inks are released to normal temperature and humidity conditions of 25° C.60% RH, and means for recording the color image on the recording medium by selectively using the inks. According to the ink jet recording apparatus of the present invention, the third object is achieved. More particularly, it is possible to improve the recording speed by suppressing the ink spray condition of the head to a minimum, where the head sprays the ink to prevent recording defect such as dropout and positional error of the dots caused by increased viscosity of the ink. Further, it is also possible to reduce the ink consumption.

Other objects and further features of the present invention will be apparent from the following detailed description when read in conjunction with the accompanying drawings.

BRIEF DESCRIPTION OF THE DRAWINGS

FIGS. 17A and 17B respectively are diagrams showing recorded results which are obtained when the recording is made on a recording medium having a relatively high ink absorptivity;

FIG. 20 is a flow chart for explaining the operation of a black data boundary color discriminator, a black data separator and a dot controller for a case where a recording width using the black ink having the high diffusibility at the boundary portion is 1 dot;

FIG. 33 is a diagram showing evaluation results of the bleeding and the blending;

FIG. 34 is a diagram showing experimental results for a case where an image having a printing rate of 100% is recorded using the ink having the low diffusibility and the ink having the high diffusibility, where both inks use black dye with the same dye density;

FIG. 35 is a diagram showing experimental results for a case where an image having the printing rate of 100% is recorded using the ink having the low diffusibility and the ink having the high diffusibility, where both inks use black dyes with mutually different dye densities;

FIG. 36 is a diagram showing experimental results for a case where the recording is made a plurality of times using the ink having the high diffusibility;

FIG. 37 is a diagram showing experimental results for a case where an image having the printing rate of 100% is recorded using the ink having the low diffusibility and the ink having the high diffusibility, where both inks use black dyes with mutually different dye densities and the recording using the ink having the high diffusibility is made a plurality of times;

FIG. 40 is a diagram showing evaluation results of the bleeding and the blending;

FIG. 41 is a diagram showing measured results of the contact angle with respect to PTFE of inks Ck, Cy, Dk and Dy;

FIG. 42 is a diagram showing the extent of an absorption coefficient Ka and bleeding with respect to various recording mediums;

FIG. 43 is a diagram showing the extent of the absorption coefficient Ka and blending with respect to various recording mediums;

FIG. 44 is a diagram showing the extent of the absorption coefficient Ka and blending with respect to various recording mediums;

DESCRIPTION OF THE PREFERRED EMBODIMENTS

Figure 1:
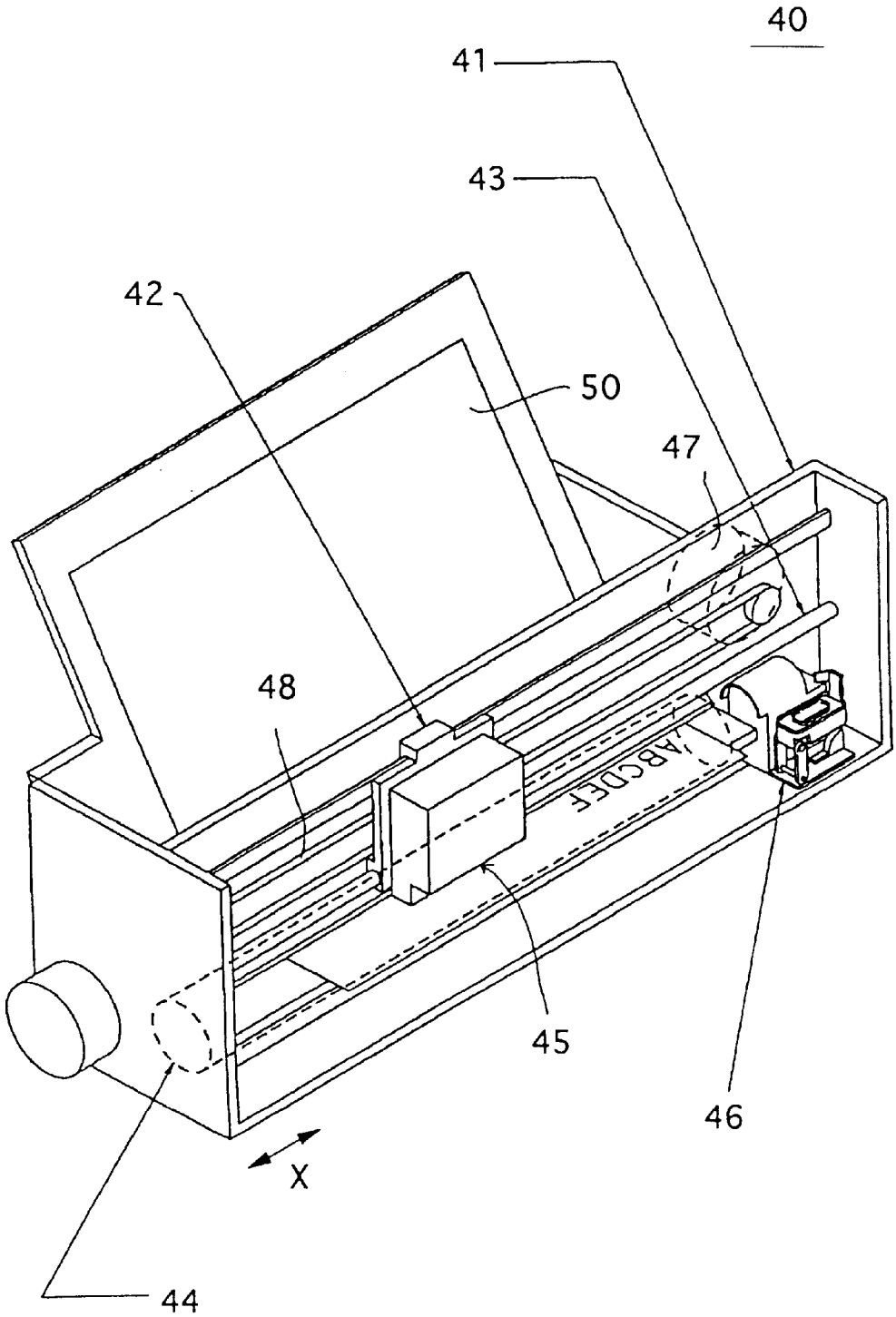
FIG. 1 is a perspective view showing a part of a first embodiment of an ink jet recording apparatus according to the present invention.
Figure 2:
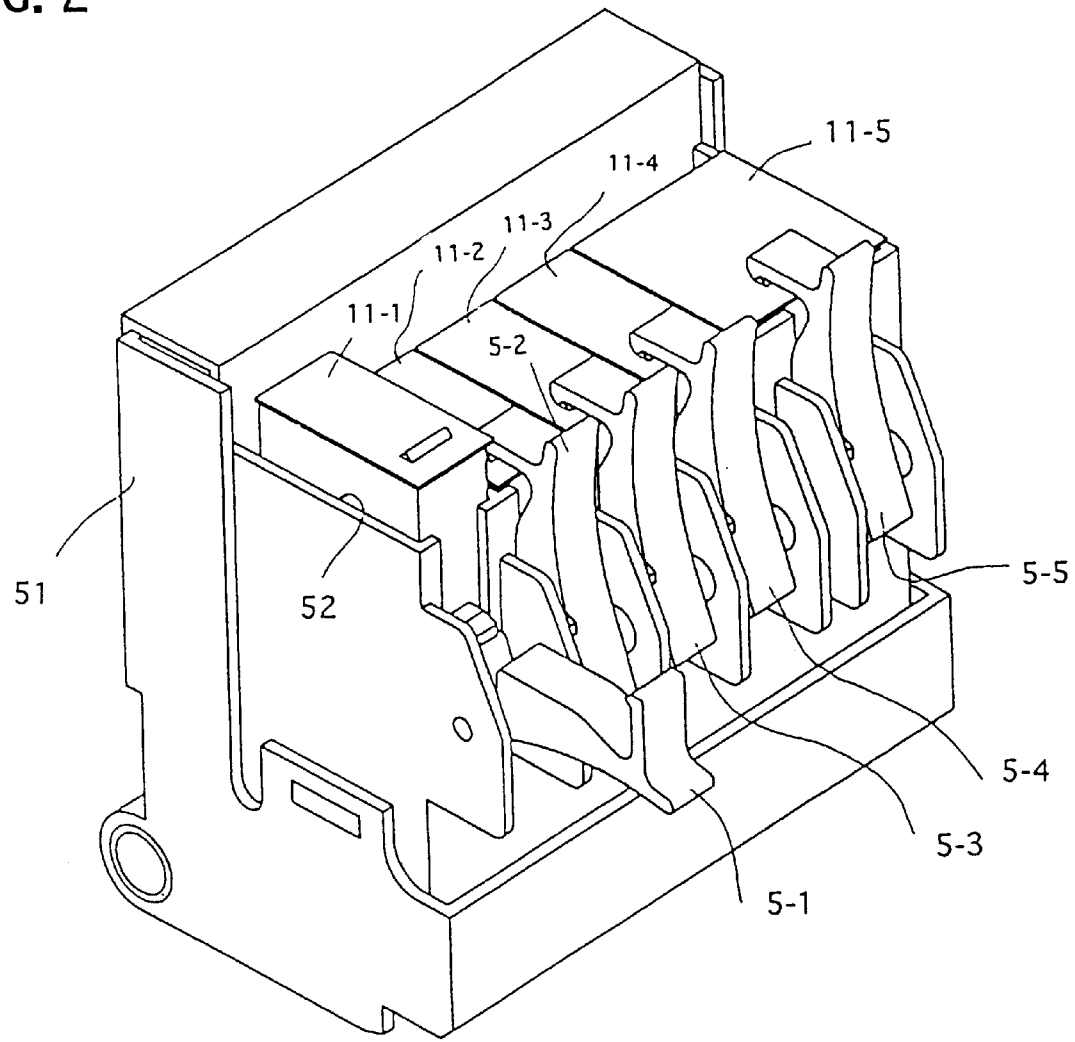
FIG. 2 is a perspective view showing a head part.

First, a description will be given of a first embodiment of an ink jet recording apparatus according to the present invention, by referring to FIGS. 1 and 2. FIG. 1 is a perspective view showing a part of the first embodiment of the ink jet recording apparatus, and FIG. 2 is a perspective view showing a head part of the ink jet recording apparatus. The first embodiment of the ink jet recording apparatus employs a first embodiment of an ink jet recording method according to the present invention, a first embodiment of an ink according to the present invention, and a first embodiment of an ink cartridge according to the present invention.

In FIG. 1, an ink jet recording apparatus 40 generally includes a frame 41, a carrier 42, a stage shaft 43, a paper feed roller 44, a head portion 45, a backup unit 46, a motor 47, a belt 48 and the like. The carrier 42 is driven by the motor 47 via the belt 48, and is movable in directions X show in FIG. 1 under the guidance of the stage shaft 43. The head portion 45 is mounted on the carrier 42. A recording medium 50 such as paper is fed by the paper feed roller 44, and the head portion 45 records (or prints) an image on this recording medium 50 based on image data received from a host unit (not shown), for example.

The backup unit 46 is provided as a protection mechanism with respect to the head portion 45. The backup unit 46 includes functions such as capping the nozzle surface of the head portion 45 in a standby state so as to prevent nozzle clogging, and sucking the ink and air bubbles from a nozzle of the head portion and ejecting the same so as to restore the clogged nozzle that would otherwise cause dropout of dots when the user carries out a predetermined operation.

A known structure may be used for a portion of the ink jet recording apparatus 40 including the frame 41, the carrier 42, the stage shaft 43, the paper feed roller 44, the backup unit 46, the motor 47, the belt 48 and the like. Hence, a detailed description on the structure and operation of this portion of the ink jet recording apparatus 40 will be omitted in this specification.

Next, a description will be given of the structure of the head portion 45, by referring to FIG. 2. FIG. 2 shows the head portion 45 in a state where a cover thereof is removed.

In FIG. 2, the head portion 45 includes a housing 51, and a plurality of levers 5-1 through 5-5 are provided on the housing 51. In addition, slots 52 are provided in the housing 51 at positions corresponding to the levers 5-1 through 5-5. Ink cartridges 11-1 through 11-5 are inserted into the corresponding slots 52, and are detachable with respect to corresponding printing heads (not shown) by the operation of the levers 5-1 through 5-5. Each printing head has a nozzle from which the ink is ejected or sprayed, and a known structure may be used for the printing head itself. Hence, a detailed description on the structure and operation of the printing head will be omitted in this specification.

FIG. 2 shows a state before the ink cartridge 11-1 is completely inserted into the corresponding slot 52 or a state where the ink cartridge 11-1 is partially extracted from the corresponding slot 52.

In this embodiment, 5 printing heads are provided at the lower portion of the housing 51 in correspondence with the 5 ink cartridges 11-1 through 11-5, but the printing heads are not visible in FIG. 2. Each of the ink cartridges 11-1 through 11-5 may basically have known structures, and each printing head includes one or a plurality of nozzles from which the ink is ejected or sprayed.

For example, the ink cartridges 11-1 through 11-4 are respectively made up of cartridge bodies storing black ink, yellow ink, magenta ink and cyan ink which are used when making a color recording. In addition, the ink cartridge 11-5 is made up of a cartridge body slightly larger than those of the other ink cartridges 11-1 through 11-4, and the cartridge body of this ink cartridge 11-5 stores black ink which is used when making a monochrome (or black-and-white) recording. Accordingly, the black ink is supplied from different ink cartridges for the color recording and the monochrome recording. By taking this measure, it is also possible to use printing heads having different structures for the printing heads corresponding to the ink cartridges 11-1 through 11-4 and the printing head corresponding to the ink cartridge 11-5, for example.

For example, in this embodiment, the black, yellow, magenta and cyan inks stored within the ink cartridges 11-1 through 11-4 have a composition including 2 weight percent (%) of acid dye, 10 weight % of glycerol, 0.5 weight % of anionic surface-active agent and the remainder water. In addition, the black ink stored within the ink cartridge 11-5 has a composition including 2 weight % of direct dye, 10 weight % of glycerol, 4 weight % of isopropanol and the remainder water, for example. These inks having such compositions were obtained by measuring the amount of ink in a sealed polyethelene container for each kind of ink, stirring and melting the ink at 50° C. for 3 hours, cooling the ink to room temperature, and filtering the ink using a filter having a pore size of 0.2 $\mu$m. Compared to the black, yellow, magenta and cyan inks stored within the ink cartridges 11-1 through 11-4, the black ink stored within the ink cartridge 11-5 has a composition such that the diffusibility with respect to the recording medium 50 is lower. For example, the diffusion time with respect to the woodfree copier paper used in copying machines was approximately 25 seconds for the black ink which is stored within the ink cartridge 11-5 and is used for the monochrome recording, and approximately 3 seconds for the other inks which are stored within the ink cartridges 11-1 through 11-4 and are used for the color recording.

The diffusibility of the ink refers to the property of the ink used to indicate the ease with which the ink is diffuses into the recording medium and is absorbed by the recording medium. On the other hand, the ink absorptivity of the recording medium refers to the property of the recording medium used to indicate the ease with which the recording medium absorbs the ink.

Figure 3A:
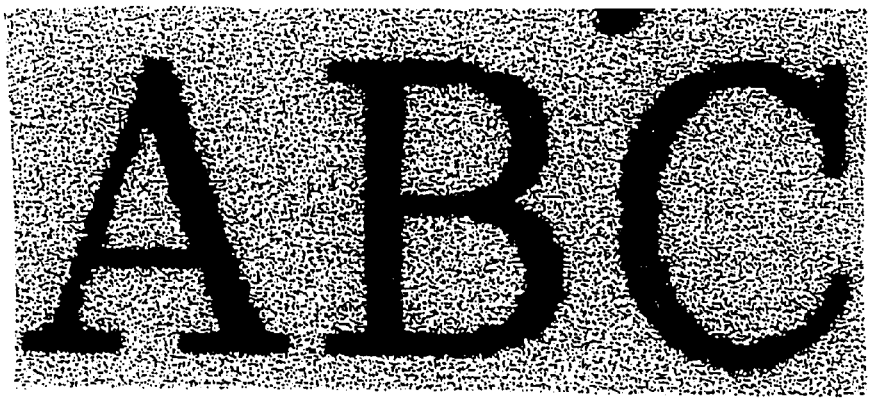
FIGS. 3A and 3B respectively are diagrams schematically showing, on an enlarged scale, photographs of recorded results which are obtained when two kinds of inks are used to record characters on a woodfree copier paper used in copying machines with a resolution of 360 dpi.
Figure 3B:
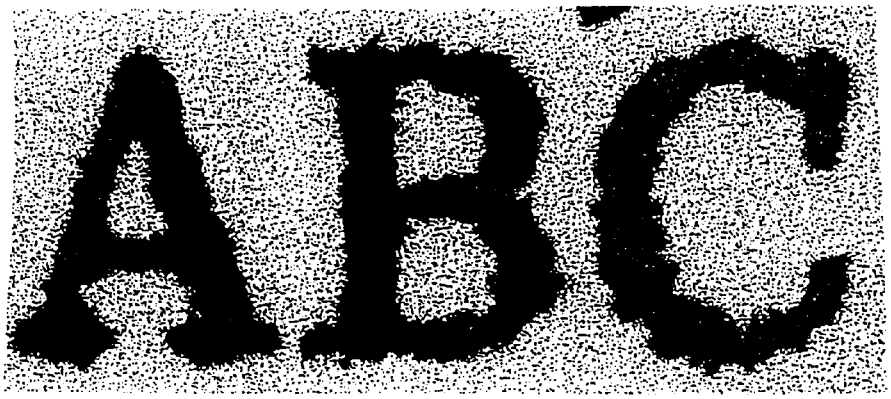

FIGS. 3A and 3B respectively are diagrams schematically showing, on an enlarged scale, photographs of recorded results which are obtained when two kinds of inks are used to record characters "ABC" on the woodfree copier paper with a resolution of 360 dpi. FIG. 3A shows the recorded results for a case where the recording is made by the black ink which is stored within the ink cartridge 11-5 and is used for the monochrome recording. On the other hand, FIG. 3B shows the recorded results for a case where the recording is made by the black ink which is stored within the ink cartridge 11-1 and is used for the color recording. As may be seen from FIGS. 3A and 3B, compared to the case where the recording is made using the black ink which has the high diffusibility and is stored within the ink cartridge 11-1, it is possible to carry out the recording with a high quality using the black ink which has the low diffusibility and is stored within the ink cartridge 11-5 because there is little bleeding of the ink. Particularly in the case shown in FIG. 3B, the bleeding of the ink is large because of the high diffusibility of the ink, and it can be seen by comparing FIG. 3B with FIG. 3A that the fine portions of the characters are deformed and the sharpness of the edges are lost, thereby greatly deteriorating the recording quality compared to that of FIG. 3A. Hence, in this embodiment, the recording is made using the black ink which has the low diffusibility and is used for the monochrome recording, when the image to be recorded is a monochrome image or, when the image to be recorded is black and has no portion touching other colors.

On the other hand, when recording in this embodiment an image having a portion where yellow and black touch each other, for example, only a portion of a boundary region between the black region and the yellow region is recorded using the black ink having the high diffusibility and is used for the color recording, and other portions of the black region are recorded using the black ink having the low diffusibility and is used for the monochrome recording.

FIGS. 4A through 4D respectively are diagrams schematically showing, on an enlarged scale, blending states in photographs of recorded results which are obtained when an image made up of yellow and black is recorded.

Figure 4A:
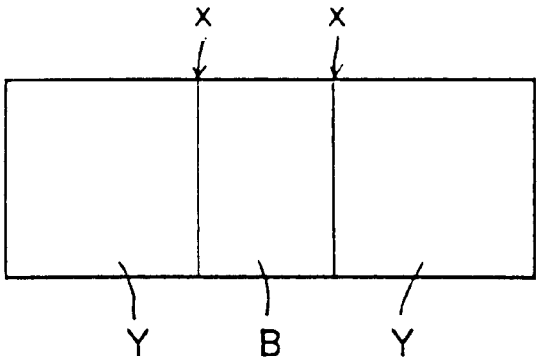
FIGS. 4A through 4D respectively are diagrams schematically showing, on an enlarged scale, blending states in photographs of recorded results which are obtained when an image made up of yellow and black is recorded.

FIG. 4A is a diagram schematically showing, on an enlarged scale, the photograph of the recorded result which is obtained when a portion of a black region B amounting to a width of 6 dots in a boundary portion x between the black region B and a yellow region Y is recorded using the black ink which has the high diffusibility and is used for the color recording, and other portions of the black region B are recorded using the black ink which has the low diffusibility and is used for the monochrome recording.

Figure 4B:
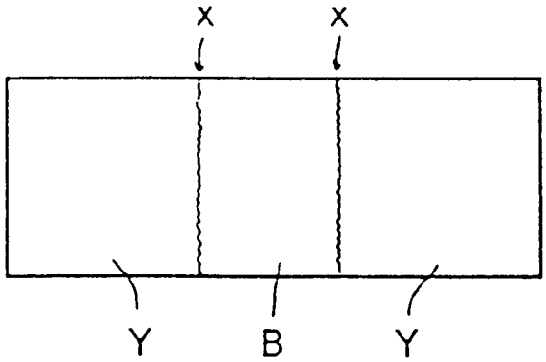

FIG. 4B is a diagram schematically showing, on an enlarged scale, the photograph of the recorded result which is obtained when the entire black region B including the boundary portion x between the black region B and the yellow region Y is recorded using the black ink which has the low diffusibility and is used for the monochrome recording.

Figure 4C:
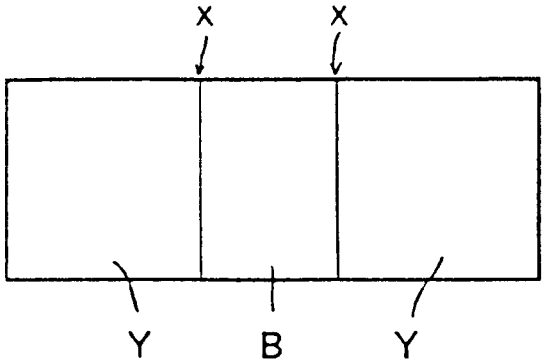

FIG. 4C is a diagram schematically showing, on an enlarged scale, the photograph of the recorded result which is obtained when the entire black region B including the boundary portion x between the black region B and the yellow region Y is recorded using the black ink which has the high diffusibility and is used for the color recording.

Figure 4D:
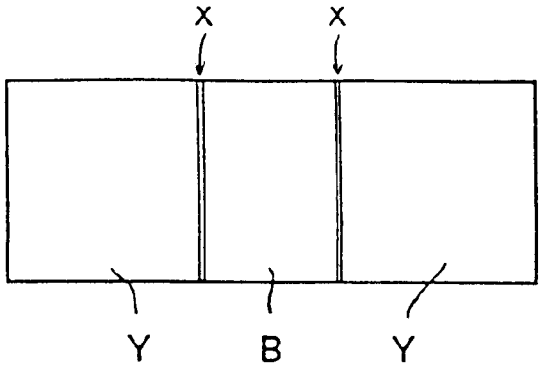

FIG. 4D is a diagram schematically showing, on an enlarged scale, the photograph of the recorded result which is obtained when an unrecorded (blank or white) portion is formed in the boundary portion x between the black region B and the yellow region Y.

According to this embodiment, it is possible to realize a recording having little blending as shown in FIG. 4A, similarly to the case shown in FIG. 4C.

However, the blending is considerably large in the case shown in FIG. 4B. Further, in the case shown in FIG. 4D, the white region (in the case of white recording medium) in the boundary portion x is considerably notable. Therefore, it was confirmed that the recorded results greatly differ from the desired image to be recorded in the cases shown in FIGS. 4B and 4D.

Compared to the characters shown in FIG. 3A, the recording tone of the black region B in FIG. 4C is low, and the difference between the colors of the black characters shown in FIG. 3A and the black region B was visible, thereby deteriorating the quality of the recorded image as a whole. On the other hand, according to this embodiment, the recording tone of the black region B is high in FIG. 4A, and the difference between the colors of the black characters shown in FIG. 3A and the black region B was hardly recognizable.

Accordingly, as shown in FIGS. 3A and 4A, this embodiment can simultaneously realize the recording of the high quality characters having no bleeding and the recording of the high quality color boundary portion having no blending.

In addition, the recording tones, the contrasts and the color saturations of the characters, graphics and the like can be made approximately the same, thereby making it possible to greatly improve the quality of the recorded image as a whole.

The effect of reducing the blending becomes greater in the black region B as the width of the boundary portion x recorded using the black ink which has the high diffusibility and is used for the color recording increases. However, as the dot width of the boundary region x increases, the differences between the contrasts, color saturations and recording tones become recognizably large. Hence, it is possible to reduce the color difference by using the same kind of dye for the two kinds of black ink, that is, the black ink having the low diffusibility used for the monochrome recording and the black ink having the high diffusibility used for the color recording. In addition, as will be described later in conjunction with a fourth embodiment, it is also possible to reduce the difference between the recording tones by making the dye density of the black ink having the high diffusibility and used for the color recording higher than the dye density of the black ink having the low diffusibility and used for the monochrome recording.

Figure 5:
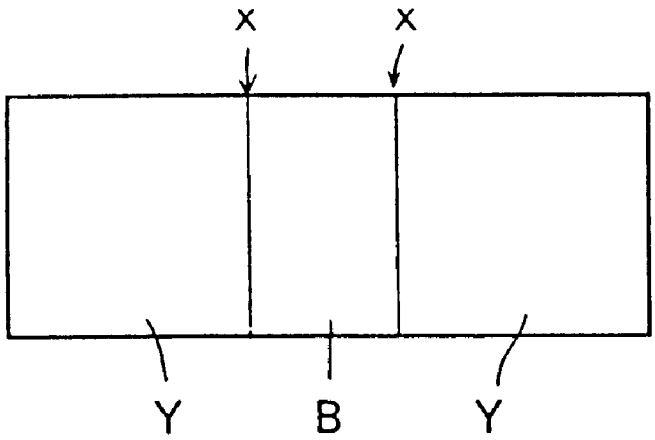
FIG. 5 is a diagram schematically showing, on an enlarged scale, a photograph of a recorded result which is obtained when the recording is made using black ink with adjusted dye.
Figure 6A:
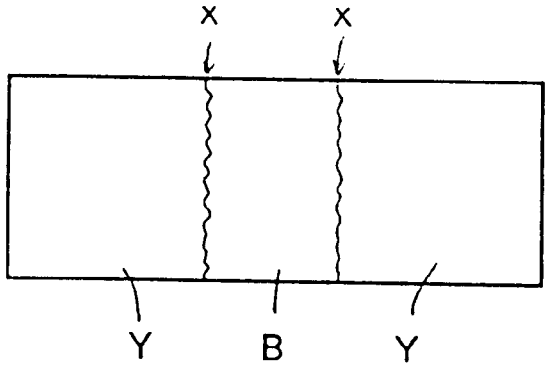
FIGS. 6A through 6D respectively are diagrams schematically showing, on an enlarged scale, photographs of recorded results which are obtained when the recording is made on a recording medium having an ink absorptivity with a first value using black ink having a high diffusibility at a boundary portion x between a yellow region Y and a black region B.
Figure 6B:
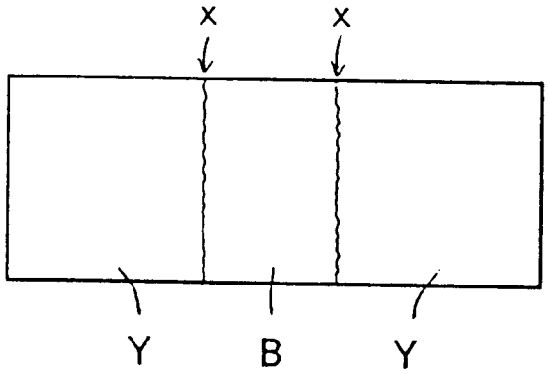
Figure 6C:
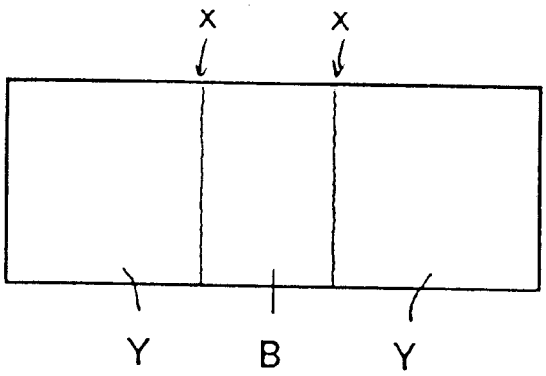
Figure 6D:
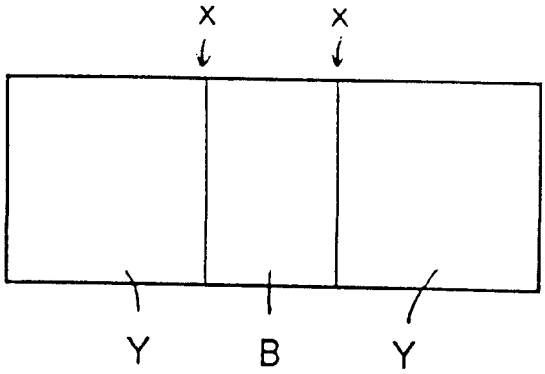
Figure 7A:
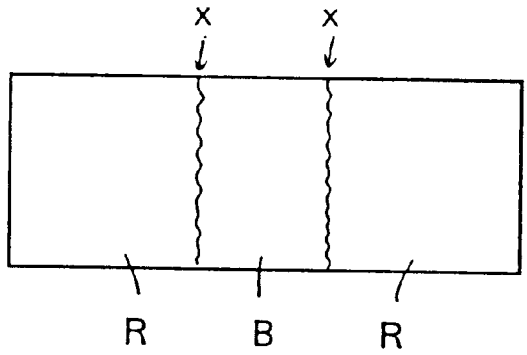
FIGS. 7A through 7D respectively are diagrams schematically showing, on an enlarged scale, photographs of recorded results which are obtained when the recording is made on the recording medium having the ink absorptivity with the first value using the ink with the high diffusibility at the boundary portion x between a red region R and the black region B.
Figure 7B:
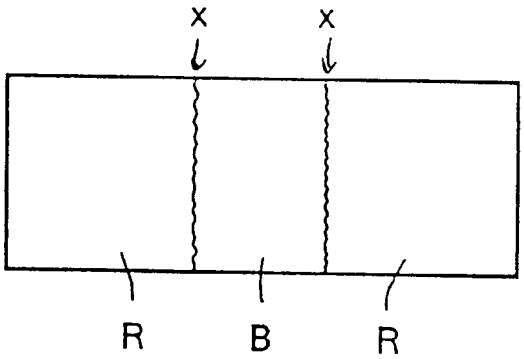
Figure 7C:
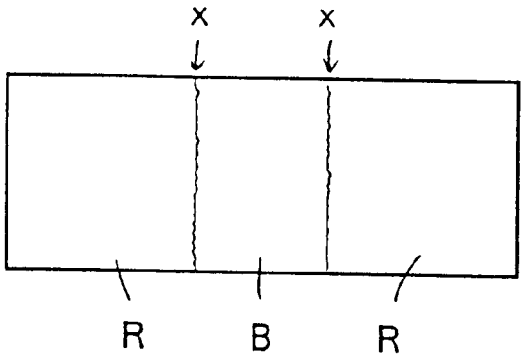
Figure 7D:
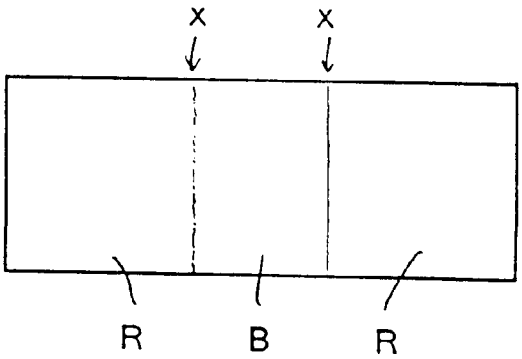
Figure 8A:
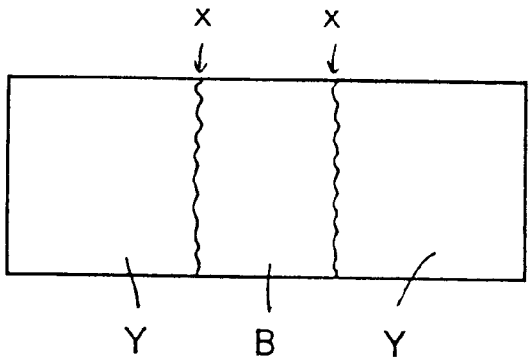
FIGS. 8A through 8D respectively are diagrams schematically showing, on an enlarged scale, photographs of recorded results which are obtained when the recording is made on a recording medium having an ink absorptivity with a second value using the black ink having the high diffusibility at the boundary portion x between the yellow region Y and the black region B.
Figure 8B:
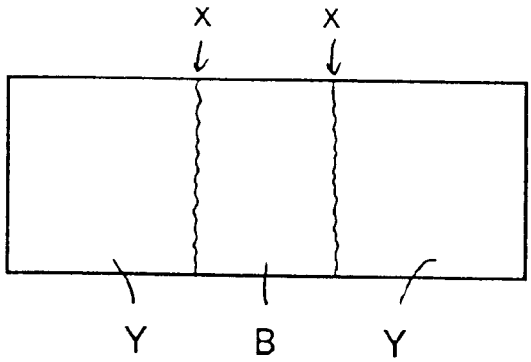
Figure 8C:
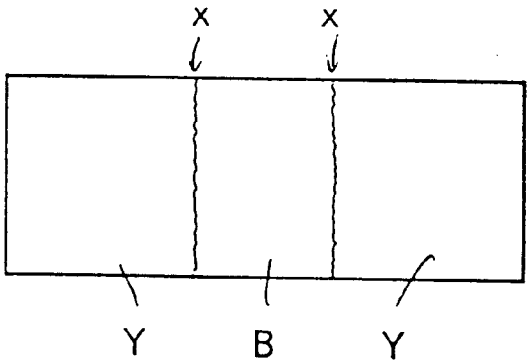
Figure 8D:
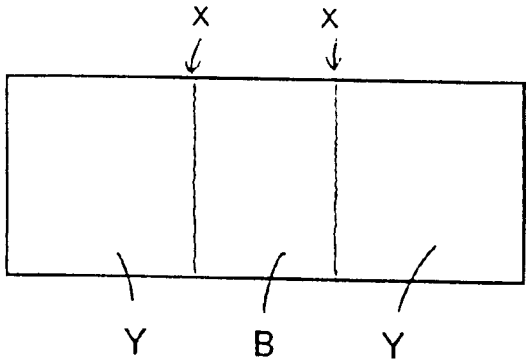
Figure 9A:
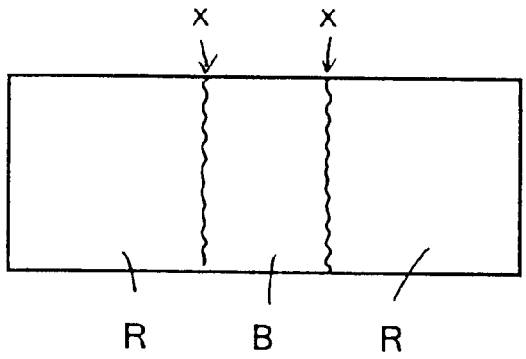
FIGS. 9A through 9D respectively are diagrams schematically showing, on an enlarged scale, photographs of recorded results which are obtained when the recording is made on the recording medium having the ink absorptivity with the second value using the ink with the high diffusibility at the boundary portion x between the red region R and the black region B.
Figure 9B:
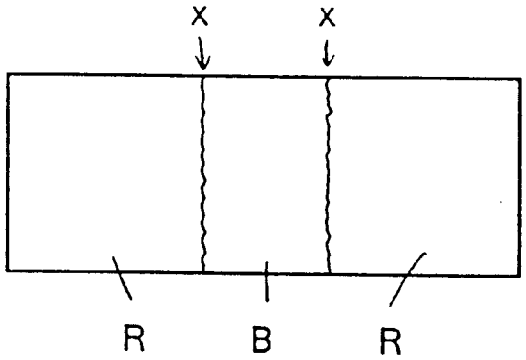
Figure 9C:
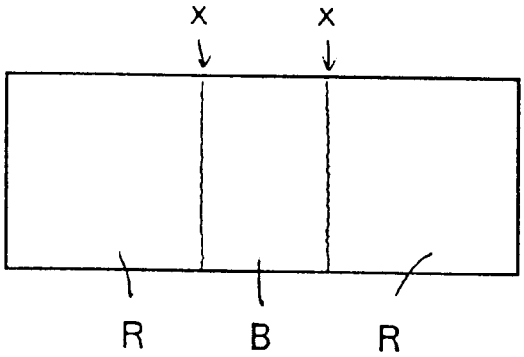
Figure 9D:
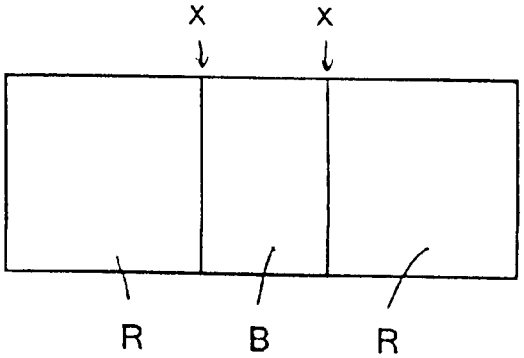

FIG. 5 is a diagram schematically showing, on an enlarged scale, a photograph of a recorded result which is obtained when the recording is made using black ink having the high diffusibility and used for the color recording with adjusted dye. The dye of the black ink which has the high diffusibility and is used for the color recording is adjusted by changing the acid dye to the same direct dye which is used in the black ink having the low diffusibility and used for the monochrome recording, and increasing the composition ratio of the dye from 2 weight % to 4 weight %. As may be seen by comparing FIG. 5 with FIG. 4A, the blending in FIG. 5 is small to the same extent as that in FIG. 4A. In addition, the boundary of the black region is hardly recognizable in FIG. 5, and it was confirmed that the recording uniformity is improved.

A more detailed description will be given later in conjunction with fourth and fifth embodiments, but the present inventors confirmed the following. That is, the present inventors conducted subjective evaluation using various kinds of samples of the hue, and it was confirmed that the differences between the contrasts and color saturations are within respective tolerable ranges if the color difference is 5 or less, and that it is desirable for the color difference of the regions recorded using the inks having different diffusibilities to be 5 or less. In addition, the present inventors also conducted subjective evaluation of the recording tone of recording regions having the same hue. It was confirmed that when the recording tone (OD) measured on a Macbeth densitometer is approximately 1.0 or greater, the difference of the recording tones is within a tolerable range if the difference of the recording tones between the recording regions having the same hue is 0.3 or less. Accordingly, it was found that the difference of the recording tones between the recording region recorded using the ink having the high diffusibility and the recording region recorded using the ink having the low diffusibility is desirably 0.3 (OD) or less.

In addition, the ink having the low diffusibility has a tendency such that the spreading of the ink on the recording medium is small. For this reason, when carrying out the recording using both the ink having the low diffusibility and the ink having the high diffusibility, it is desirable to adhere more of the ink having the low diffusibility than the ink having the high diffusibility on the recording medium per unit area. By taking this measure, it is possible to record dots suited for realizing a predetermined resolution on the ink jet recording apparatus.

In the boundary portion, it is possible to improve the quality of the image that is recorded by adjusting the width recorded using the black ink having the high diffusibility by the amount of ink in each color region forming the boundary portion and the ink absorptivity of the recording medium itself. In other words, the larger the amount of ink, and the lower the ink absorptivity of the recording medium itself, the greater the blending tends to become. Hence, it is effective to set the width recorded by the black ink having the high diffusibility in the boundary portion large.

FIGS. 6A through 6D respectively are diagrams schematically showing, on an enlarged scale, photographs of recorded results which are obtained when the recording is made on a recording medium having an ink absorptivity with a first value using the black ink having the high diffusibility at the boundary portion x between the yellow region Y and the black region B. FIGS. 6A, 6B, 6C and 6D respectively show the blending states for cases where the width recorded using the black ink having the high diffusibility at the boundary portion x is 1 dot, 2 dots, 4 dots and 6 dots.

FIGS. 7A through 7D respectively are diagrams schematically showing, on an enlarged scale, photographs of recorded results which are obtained when the recording is made on the recording medium having the ink absorptivity with the first value using the black ink having the high diffusibility at the boundary portion x between a red region R and the black region B. The red region R is obtained by overlapping the recordings made using the yellow and magenta inks. Compared to the case where the yellow region Y is recorded using the yellow ink, the total amount of ink used to record the red region R is approximately 2 times that required for the yellow region Y. FIGS. 7A, 7B, 7C and 7D respectively show the blending states for cases where the width recorded using the black ink having the high diffusibility at the boundary portion x is 1 dot, 2 dots, 4 dots and 6 dots.

As may be seen from FIGS. 6A through 6D and FIGS. 7A through 7D, it was found that the blending becomes smaller as the recording width at the boundary portion x using the black ink having the high diffusibility increases. In addition, the blending had a tendency to be greater at the boundary of the black region B and the red region R than at the boundary of the black region B and the yellow region Y. In order to reduce the blending and at the same time maintain a satisfactory recording quality, it was found that the recording width at the boundary portion x using the black ink having the high diffusibility is desirably approximately 4 dots at the boundary of the yellow region Y and the black region B having a small amount of ink, and approximately 6 dots at the boundary of the red region R and the black region B having a large amount of ink. Hence, at the boundary where the amount of the ink is large, it is effective to increase the recording width in the boundary portion x using the black ink having the high diffusibility, that is, to increase the number of dots, from the point of view of reducing the blending and obtaining a satisfactory recording quality.

FIGS. 8A through 8D respectively are diagrams schematically showing, on an enlarged scale, photographs of recorded results which are obtained when the recording is made on a recording medium having an ink absorptivity with a second value using the black ink having the high diffusibility at the boundary portion x between the yellow region Y and the black region B, where the second value is smaller than the first value. FIGS. 8A, 8B, 8C and 8D respectively show the blending states for cases where the width recorded using the black ink having the high diffusibility at the boundary portion x is 2 dots, 4 dots, 6 dots and 8 dots.

FIGS. 9A through 9D respectively are diagrams schematically showing, on an enlarged scale, photographs of recorded results which are obtained when the recording is made on the recording medium having the ink absorptivity with the second value using the black ink having the high diffusibility at the boundary portion x between a red region R and the black region B. The red region R is obtained by overlapping the recordings made using the yellow and magenta inks. Compared to the case where the yellow region Y is recorded using the yellow ink, the total amount of ink used to record the red region R is approximately 2 times that required for the yellow region Y. FIGS. 9A, 9B, 9C and 9D respectively show the blending states for cases where the width recorded using the black ink having the high diffusibility at the boundary portion x is 2 dots, 4 dots, 6 dots and 8 dots.

As may be seen from FIGS. 8A through 8D and FIGS. 9A through 9D in comparison with FIGS. 6A through 6D and FIGS. 7A through 7D, it was found that the blending becomes larger as the absorptivity of the recording medium decreases. In order to reduce the blending and at the same time maintain a satisfactory recording quality, it was found that the recording width at the boundary portion x using the black ink having the high diffusibility is desirably approximately 6 dots at the boundary of the yellow region Y and the black region B having a small amount of ink, and approximately 8 dots at the boundary of the red region R and the black region B having a large amount of ink. Hence, it is effective to adjust the recording width (number of dots) in the boundary portion x using the black ink having the high diffusibility, from the point of view of reducing the blending and obtaining a satisfactory recording quality.

Figure 10A:
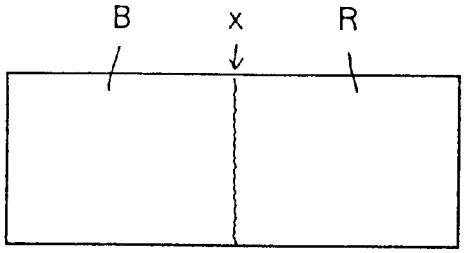
FIGS. 10A and 10B respectively are diagrams for explaining blending states depending on a difference between contrasts of adjacent regions.
Figure 10B:
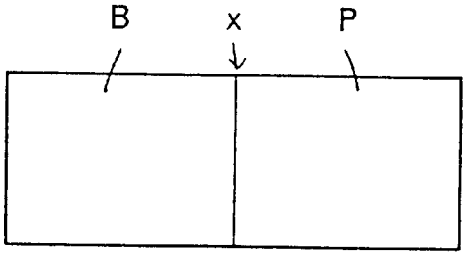

FIGS. 10A and 10B respectively are diagrams for explaining blending states depending on a difference between contrasts of adjacent regions. FIG. 10A schematically shows, on an enlarged scale, a photograph indicating the blending state at the boundary portion x between the black region B and the red region R which has a large contrast difference with black. On the other hand, FIG. 10B schematically shows, on an enlarged scale, a photograph indicating the blending state at the boundary portion x between the black region B and a purple region P having a small contrast difference with black. In FIGS. 10A and 10B, the recording width in the boundary portion x using the black ink having the high diffusibility is 2 dots. The blending at the boundary portion x can be recognized in FIG. 10A, however the blending at the boundary portion x can hardly be recognized in FIG. 10B. In other words, the blending becomes particularly notable or conspicuous at the color boundary where the contrast difference of the adjacent regions is large. For this reason, this embodiment is particularly effective when applied to the case where the contrast difference between the colors of the inks used to recording the adjacent regions is large.

Figure 11A:
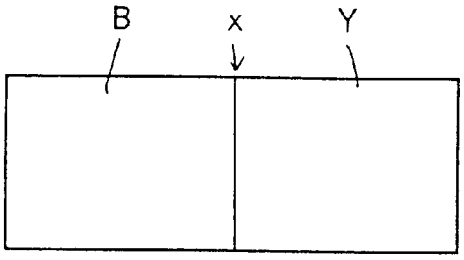
FIGS. 11A and 11B respectively are diagrams for explaining the blending states when the recording is made by changing the diffusibility of the ink having the high diffusibility at the boundary portion between the adjacent regions.
Figure 11B:
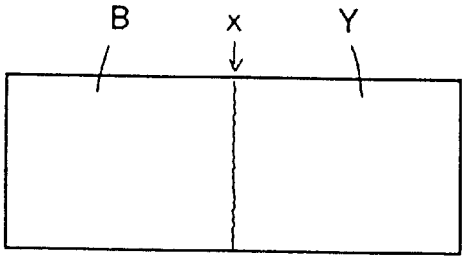

FIGS. 11A and 11B respectively are diagrams for explaining the blending states when the recording is made by changing the diffusibility of the ink having the high diffusibility at the boundary portion between the adjacent regions. FIG. 11A schematically shows, on an enlarged scale, a photograph indicating the blending state at the boundary portion when the high diffusibility of the black ink used to record the black region B is made higher than the diffusibility of the yellow ink used to record the yellow region Y. On the other hand, FIG. 11B schematically shows, on an enlarged scale, a photograph indicating the blending state at the boundary portion when the high diffusibility of the black ink used to record the black region B is made lower than the diffusibility of the yellow ink used to record the yellow region Y. The composition of the inks having the high diffusibility were selected such that the amount of the surface-active agent is 0.3% for the ink having the lower diffusibility and is 0.5% for the ink having the higher diffusibility. In addition, the high diffusibilities of the two kinds of inks were adjusted for each color, and the recordings were made using combinations of the color inks.

When the diffusibility of the black ink was made higher than that of the yellow ink, no blending was visible as shown in FIG. 11A. On the other hand, when the diffusibility of the yellow ink was made higher than that of the black ink, the black ink flowed into the yellow region Y and a relatively notable blending was visible as shown in FIG. 11B.

Hence, when recording the two adjacent regions using two kinds of inks having mutually different but high diffusibilities, the blending becomes notable at the boundary portion when the ink of a color having a low contrast such as black flows into the ink of a color having a high contrast such as yellow. For this reason, when recording the two adjacent regions using two kinds of inks having mutually different but both high diffusibilities, it is effective from the point of view of eliminating the blending at the boundary portion and improving the recording quality to set the diffusibility of the ink having the lower contrast higher than the diffusibility of the ink having the higher contrast, so that the ink having the higher contrast such as yellow flows into the ink having the lower contrast such as black.

In addition, when carrying out the recording using the inks having the high diffusibilities, it is desirable to first carry out the recording using the ink having the low contrast and let the fixing of this ink progress, and then carry out the recording using the ink having the high contrast. Taking such measures is further effective from the point of view of eliminating the blending at the boundary portion and improving the recording quality.

Figure 12A:
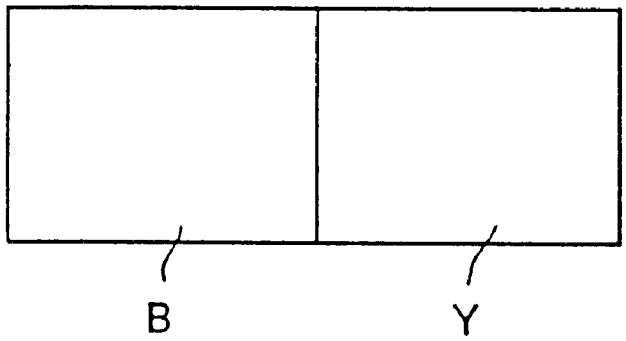
FIGS. 12A through 12C respectively are diagrams for explaining a recording sequence dependency of the blending state at the boundary portion when the recording is made using two kinds of black ink respectively having high and low diffusibilities and inks of different colors having the high diffusibility.
Figure 12B:
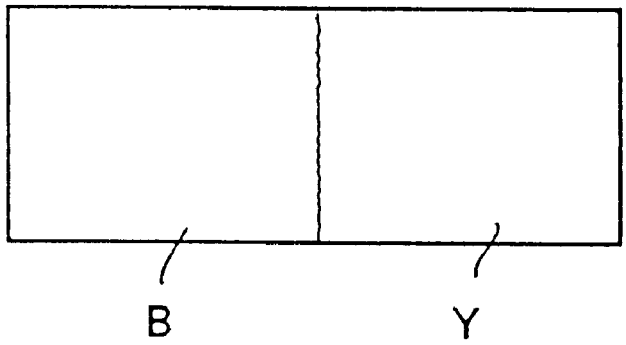
Figure 12C:
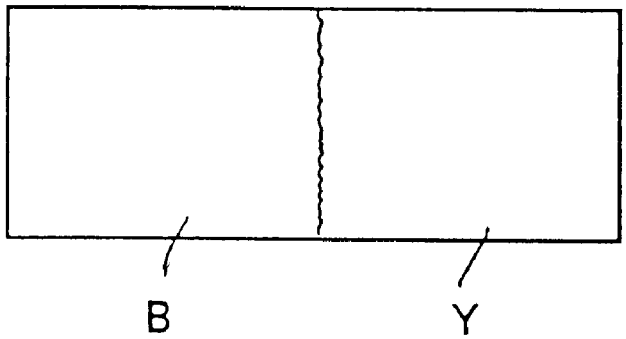
Figure 13A:
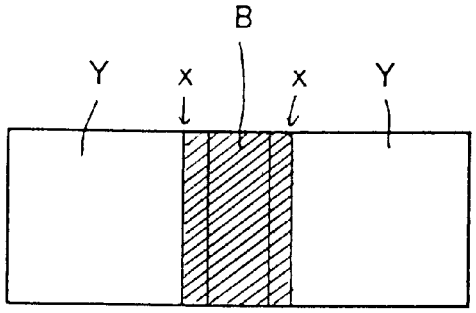
FIGS. 13A and 13B respectively are diagrams for explaining the blending state at the boundary portion when the recording sequence using the black inks having the different diffusibilities is changed.
Figure 13B:
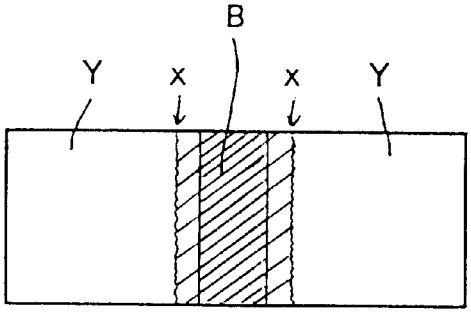

FIGS. 12A through 12C respectively are diagrams for explaining a recording sequence dependency of the blending state at the boundary portion when the recording is made using two kinds of black ink respectively having high and low diffusibilities and inks of different colors having the high diffusibility. FIG. 13A schematically shows, on an enlarged scale, a photograph of a recorded result that is obtained when the recording is sequentially made using the black ink having the low diffusibility, the yellow ink having the high diffusibility, and the black ink having the high diffusibility, in this sequence. On the other hand, FIG. 13B schematically shows, on an enlarged scale, a photograph of a recorded result that is obtained when the recording is sequentially made using the yellow ink having the high diffusibility, the black ink having the low diffusibility, and the black ink having the high diffusibility, in this sequence. FIG. 13C schematically shows, on an enlarged scale, a photograph of a recorded result that is obtained when the recording is sequentially made using the black ink having the low diffusibility, the black ink having the high diffusibility, and the yellow ink having the high diffusibility, in this sequence. In FIGS. 12A through 12C, the recording width in the boundary portion using the black ink having the high diffusibility is 2 dots.

In this embodiment, the recording is sequentially made using the black ink having the low diffusibility, the yellow ink or ink of other colors having the high diffusibility, and the black ink having the high diffusibility, in this sequence. For this reason, the blending hardly occurs at the boundary portion, as may be seen from FIG. 12A. However, in the case of other recording sequences, the blending is notable at the boundary portion as may be seen from FIGS. 12B and 12C.

Accordingly, when carrying out the recording using two kinds of black ink respectively having high and low diffusibilities and the ink of another color having a high diffusibility, it is desirable to employ a recording sequence such that the recording using the ink of the color other than black is made between the recordings made by the two kinds of black ink. By employing such a recording sequence, it is possible to secure a relatively long time for the black ink to fix, and it is also possible to secure a relatively long time until the two kinds of black ink touch each other, thereby suppressing the blending at the boundary portion and unevenness of the recording tone of the black region.

Furthermore, when the recording region recorded by the black ink having the low diffusibility is larger than the peripheral recording regions which are recorded using the black ink having the high diffusibility, it is desirable to carry out the recording using the black ink having the high diffusibility before the recording using the black ink having the low diffusibility. By first carrying out the recording using the black ink having the high diffusibility, it is possible to reduce the blending at the boundary portion and the unevenness of the recording tone of the black region. In other words, by carrying out the recording in this manner, the ink having the low diffusibility flows into the recording region which is recorded using the ink having the high diffusibility to increase the amount of ink, thereby making the recording tone of the black recording region uniform.

FIGS. 13A and 13B respectively are diagrams for explaining the blending state at the boundary portion when the recording sequence using the black inks having the different diffusibilities is changed. FIG. 13A schematically shows, on an enlarged scale, a photograph of a recorded result that is obtained when the recording using the black ink having the low diffusibility is first carried out with a recording width of 48 dots and the recording is then carried out using the black ink having the high diffusibility with a recording width of 8 dots. On the other hand, FIG. 13B schematically shows, on an enlarged scale, a photograph of a recorded result that is obtained when the recording using the black ink having the high diffusibility is first carried out with a recording width of 8 dots and the recording is then carried out using the black ink having the low diffusibility with a recording width of 48 dots. The recorded results shown in FIGS. 13A and 13B were obtained by carrying out the recording using the yellow ink having the high diffusibility between the recordings using the two kinds of black ink.

In the case shown in FIG. 13A, no blending was visible at the boundary portion, and no unevenness of the recording tone was visible in the black recording region. On the other hand, in the case shown in FIG. 13B, the notable unevenness of the recording tone of the black recording region was visible.

On the other hand, when the recording region recorded using the black ink having the low diffusibility is larger than the peripheral recording region recorded using the black ink having the high diffusibility, it is desirable to carry out the recording using the black ink having the low diffusibility before carrying out the recording using the black ink having the high diffusibility, in order to prevent the ink from striking through the recording medium. When the ink strikes through the recording medium, the ink recorded on one side of the recording medium strikes through to the other side of the recording medium. The strike through of the ink should be prevented because the recording in many cases is carried out on both sides of the recording medium. When the recording using the black ink having the low diffusibility is carried out first, it is possible to reduce such strike through of the ink through the recording medium. In other words, it becomes more difficult for the black ink having the low diffusibility to flow into the recording region that is recorded using the black ink having the high diffusibility by first carrying out the recording using the black ink having the low diffusibility. As a result, it is possible to prevent the amount of ink in the recording region which is recorded using the black ink having the high diffusibility from increasing, thereby preventing the strike through of the ink.

Figure 14A:
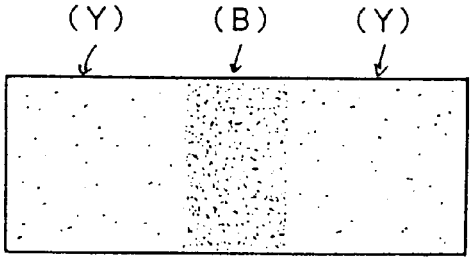
FIGS. 14A and 14B respectively are diagrams for explaining a state on the back side of the recording medium when the recording sequence using the black inks having the different diffusibilities is changed.
Figure 14B:
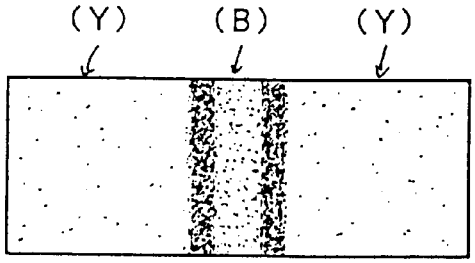

FIGS. 14A and 14B respectively are diagrams for explaining a state on the back side of the recording medium when the recording sequence using the black inks having the different diffusibilities is changed. FIG. 14A schematically shows, on an enlarged scale, a photograph of the back side of the recording medium that is obtained when the recording is first carried out on the front side of the recording medium using the black ink having the low diffusibility with a recording width of 48 dots, and the recording is thereafter carried out on the front side using the black ink having the high diffusibility with a recording width of 8 dots. On the other hand, FIG. 14B schematically shows, on an enlarged scale, a photograph of the back side of the recording medium that is obtained when the recording is first carried out on the front side of the recording medium using the black ink having the high diffusibility with a recording width of 8 dots, and the recording is thereafter carried out on the front side using the black ink having the low diffusibility with a recording width of 48 dots. The recorded results shown in FIGS. 14A and 14B were obtained by carrying out the recording using the yellow ink having the high diffusibility between the recordings made using the two kinds of black ink. In addition, the dots or shades in FIGS. 14A and 14B schematically show the density of the colors at the back side of the recording medium.

As may be seen from FIGS. 14A and 14B, there was virtually no strike through of the ink to the back side of the recording medium in the case shown in FIG. 14A, while the strike through of the ink to the back side of the recording medium was notable in the case shown in FIG. 14B.

When the recording region recorded using the black ink having the low diffusibility is smaller than the peripheral recording region recorded using the black ink having the high diffusibility, it is desirable to carry out the recording using the black ink having the low diffusibility before the recording using the black ink having the high diffusibility. By carrying out the recording using the black ink having the low diffusibility first, it is possible to reduce the blending at the boundary portion and the unevenness of the recording tone at the black region, thereby making a high quality recording possible. That is, by taking such measures, it is possible to prevent the ink having the low diffusibility from flowing into the recording region recorded by the ink having the high diffusibility, and the recording tone of recording region recorded using the ink having the low diffusibility is prevented from decreasing.

Figure 15A:
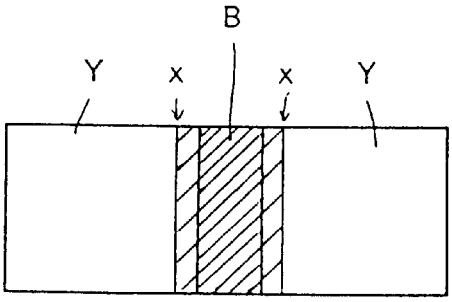
FIGS. 15A and 15B respectively are diagrams for explaining the blending state at the boundary portion when the recording sequence using the black inks having the different diffusibilities is changed.
Figure 15B:
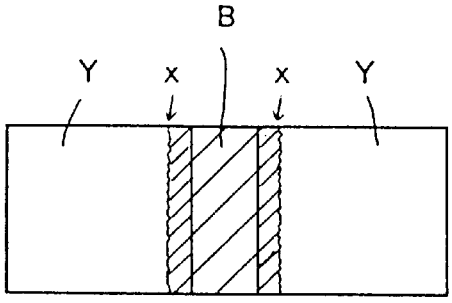

FIGS. 15A and 15B respectively are diagrams for explaining the blending state at the boundary portion when the recording sequence using the black inks having the different diffusibilities is changed. FIG. 15A schematically shows, on an enlarged scale, a photograph of a recorded result that is obtained when the recording using the black ink having the low diffusibility is first carried out with a recording width of 4 dots, and the recording using the black ink having the high diffusibility is thereafter carried out with a recording width of 6 dots. On the other hand, FIG. 15B schematically shows, on an enlarged scale, a photograph of a recorded result that is obtained when the recording using the black ink having the high diffusibility is first carried out with a recording width of 6 dots, and the recording using the black ink having the low diffusibility is thereafter carried out with a recording width of 4 dots. The recorded results shown in FIGS. 15A and 15B were obtained by carrying out the recording using the yellow ink having the high diffusibility between the recordings using the two kinds of black ink.

As may be seen from FIGS. 15A and 15B, no blending was visible at the boundary portion and no unevenness of the recording tone was visible in the black recording region in the case shown in FIG. 15A. On the other hand, the unevenness of the recording tone was notable in the recording region in the case shown in FIG. 15B.

The woodfree (or high-grade) paper or medium-grade paper often used as copier paper is normally subjected to a process called sizing so as to prevent bleeding of the ink. For this reason, when the ink is adhered on such a recording medium, the ink conforms well to the surface of the recording medium after a predetermined time which is sometimes referred to as a conformance time, and the diffusion of the ink into the recording medium starts after this conformance time. Generally, the conformance time of the ink having the low diffusibility is long compared to that of the ink having the high diffusibility, and the diffusion speed of the ink after the conformance time is slower for the ink having the low diffusibility. Accordingly, when recording the adjacent regions using the ink having the high diffusibility and the ink having the low diffusibility, the ink having the low diffusibility stays on the surface of the recording medium for a long time while the ink having the high diffusibility stays on the surface of the recording medium for a short time. Hence, when the adjacent regions are recorded using such two inks having different diffusibilities, the ink flows from the recording region recorded using the ink having the low diffusibility into the recording region recorded using the ink having the high diffusibility, thereby causing the unevenness in the recording tone and the strike through of the ink. However, when using the two inks having the different diffusibilities, it is possible to avoid the above described inconveniences and realize a high quality recording by adjusting the diffusion timings of the inks as described above.

In other words, it is desirable to adhere the ink having the low diffusibility, that is, the ink with the slower start of the diffusion, on the recording medium before the ink having the high diffusibility, so that the ink having the low diffusibility has already started to diffuse into the recording medium at the time when the ink having the high diffusibility is adhered on the recording medium. By carrying out such a recording, it is possible to reduce the flow of the ink from the recording region recorded using the ink having the low diffusibility to the recording region recorded using the ink having the high diffusibility.

Figure 16:
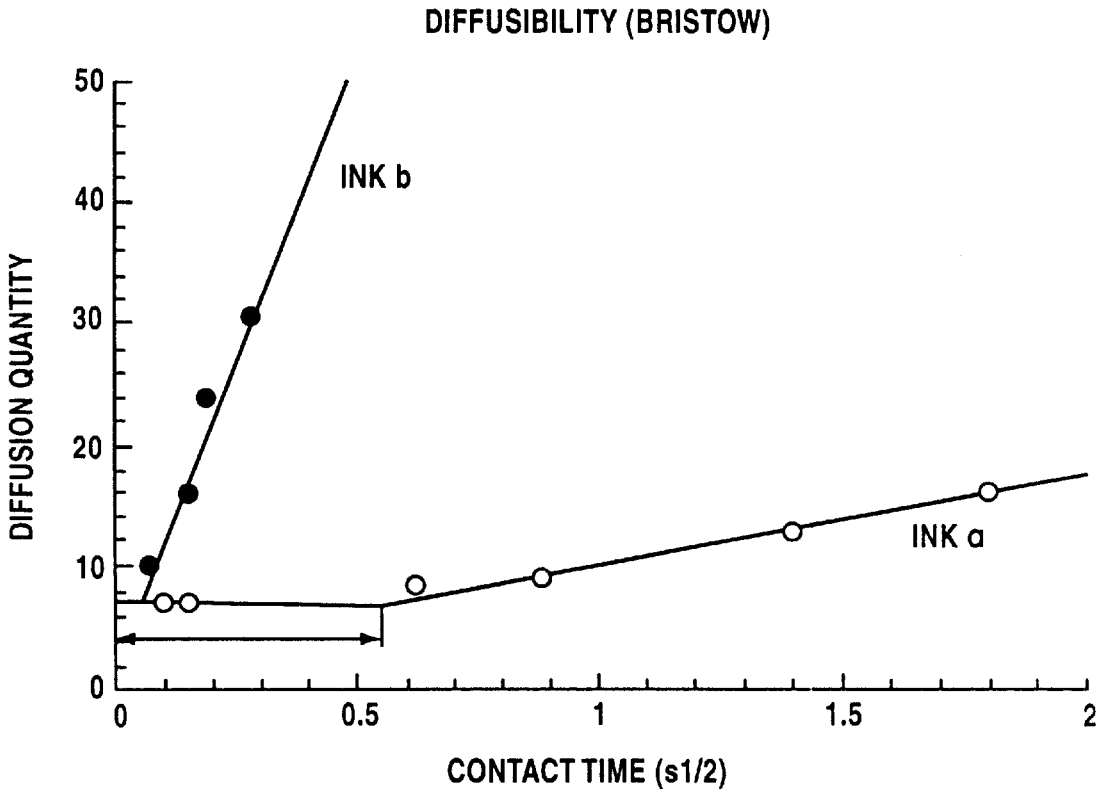
FIG. 16 is a diagram showing results of a Bristow test for an ink having a high diffusibility and an ink having a low diffusibility.

FIG. 16 is a diagram showing results of a Bristow test (J. TAPPI paper pulp test method No.51) for an ink having a high diffusibility and an ink having a low diffusibility. In FIG. 16, a characteristic "a" shows the diffusion quantity of the ink having the low diffusibility with respect to the contact time of the ink on the recording medium, and a characteristic "b" shows the diffusion quantity of the ink having the high diffusibility with respect to the contact time of the ink on the recording medium.

The ink having the low diffusibility uneasily diffuses into the woodfree paper which is subjected to a bleed preventing process such as sizing, and it is possible to carry out a high quality recording free of bleeding. However, with respect to paper having a relatively large ink absorptivity, even the ink having the low diffusibility easily diffuses into the paper along the paper fibers, thereby causing the bleeding which is also referred to as feathering along the longitudinal direction of the paper fibers and considerably deteriorating the recording quality.

On the other hand, when the recording is made using the ink having the high diffusibility on the paper having the relatively large ink absorptivity, it is possible to reduce the feathering, and the deterioration of the recording quality can be suppressed. Hence, when carrying out the recording with respect to a recording medium having a relatively large ink absorptivity, it is desirable from the point of view of minimizing the feathering to record the entire recording region on the recording medium, including the character portions, using the ink having the high diffusibility.

FIGS. 17A and 17B respectively are diagrams showing recorded results which are obtained when the recording is made on a recording medium having a relatively high ink absorptivity. FIG. 17A schematically shows, on an enlarged scale, a photograph of a recorded result that is obtained when the characters are recorded on reproduced paper such as copier paper using the black ink having the high diffusibility. On the other hand, FIG. 17B schematically shows, on an enlarged scale, a photograph of a recorded result that is obtained when the characters are recorded on the reproduced paper such as copier paper using the black ink having the low diffusibility. As may be seen by comparing FIGS. 17A and 17B, the feathering is visible in the case shown in FIG. 17B, but very little feathering is visible in the case shown in FIG. 17A.

In the above described embodiment, two kinds of inks having different diffusibilities are used for black. However, black was used merely as an example of the hue, and a plurality of kinds of inks having different diffusibilities may be used for each of other hues such as cyan, magenta and yellow. In such cases, it is possible to further improve the recording quality. In addition, the hue is limited to the above four colors, and the inks having different diffusibilities may be used similarly for hues such as red, blue and green.

Next, a more detailed description will be given of the construction and operation of a part of this embodiment of the ink jet recording apparatus, by referring to FIGS. 18 through 24.

Figure 18:
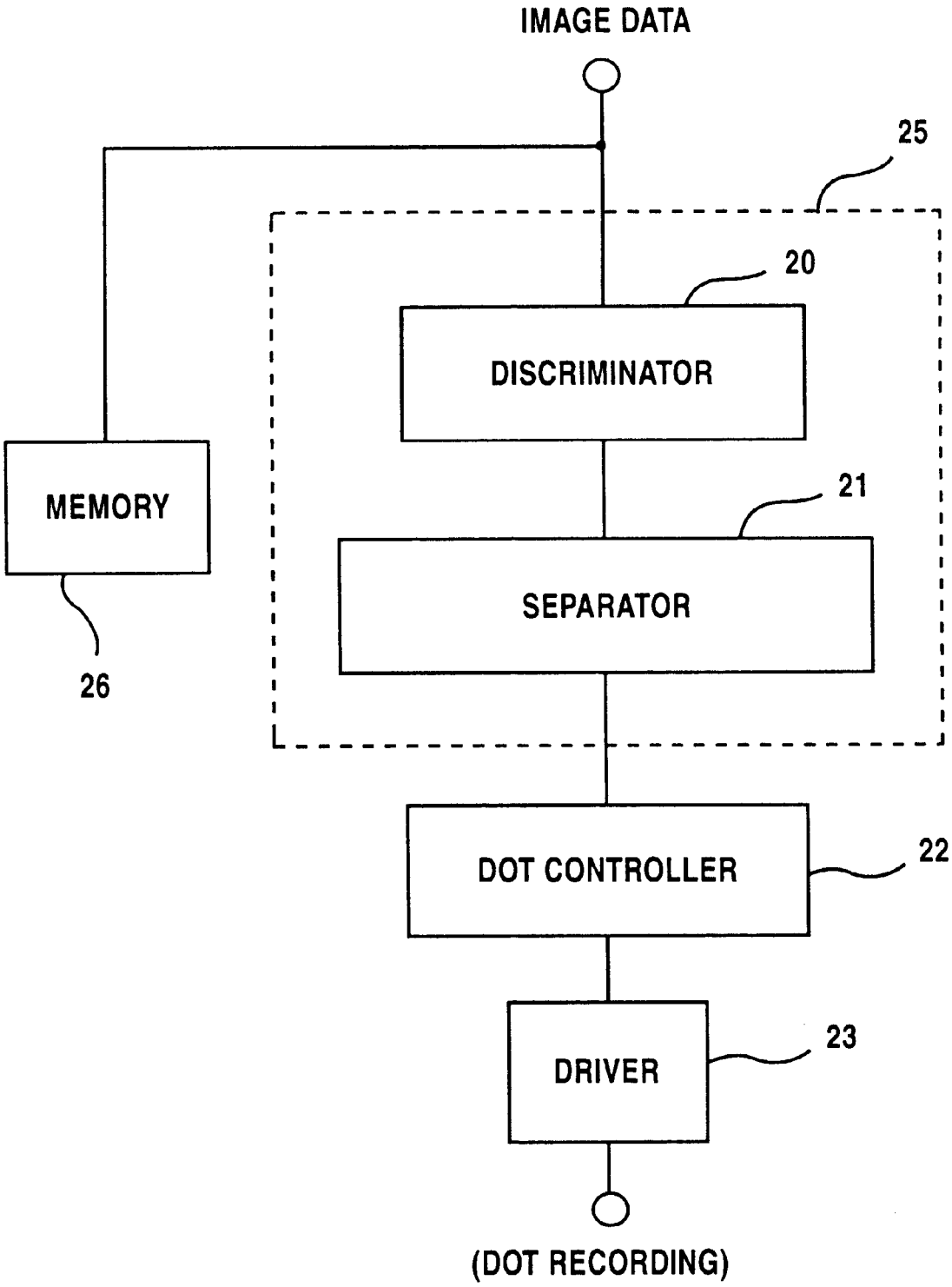
FIG. 18 is a system block diagram showing an image data processing system of the first embodiment of the ink jet recording apparatus.

FIG. 18 is a system block diagram showing an image data processing system of the first embodiment of the ink jet recording apparatus. In FIG. 18, the image data processing system generally includes a boundary color discriminator 20 for black data, separator 21 for black data, a dot controller 22, and a driver 23. The boundary color discriminator 20 receives image data related to an image that is to be recorded, and discriminates the hue touching a black portion within the image. The separator 21 separates from the image data black data related to a black portion to be recorded using the black ink having the high diffusibility and a black portion to be recorded using the black ink having the low diffusibility. The dot controller 22 carries out dot control including setting of a recording width using the black ink having the low diffusibility at the boundary portion of the black portion and a portion of another hue. In addition, the driver 23 drives each head of the head portion 45 shown in FIG. 1 based on the image data, the black data and the recording width using the black ink having the low diffusibility at the boundary portion.

As indicated by a dotted line in FIG. 18, the operations of the boundary color discriminator 20 and the separator 21 can be realized by software stored within a memory 26 of a single central processing unit (CPU) 25 or the like. Further, the operations of the dot controller 22 and the driver 23 may also be realized by the software of the CPU 25. It is also possible to temporarily store the image data related to the image which is to be recorded into the memory 26 or a buffer memory (not shown), and inputting the image data to the boundary color discriminator 20 by reading the image data from the memory 26 or the buffer memory.

A control system which controls the feed mechanism such as the paper feed roller 44 for feeding the recording medium, a control system which controls the movement of the carrier 42 and the like are known. For this reason, a description and illustration of such control systems will be omitted in this application.

Figure 19:
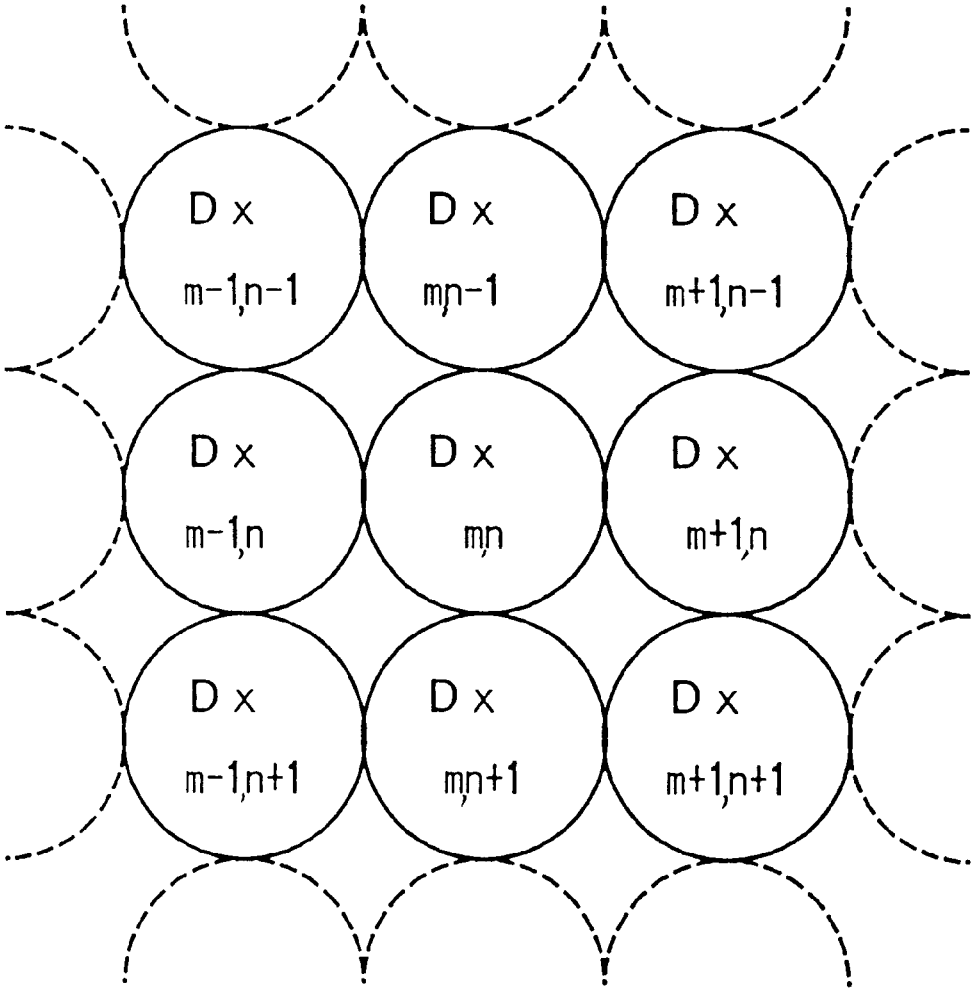
FIG. 19 is a diagram showing dot recording positions of image data.

First, a description will be given of the operation of the boundary color discriminator 20, the separator 21 and the dot controller 22. In the following description, it is assumed that dot recording positions of the image data are described by $DX_{m,n}$ and the like as shown in FIG. 19, where X denotes one of hues Y, M, C, K and K', and m and n are integers. The hue X is recorded using yellow ink having a high diffusibility for yellow Y, recorded using magenta ink having a high diffusibility for magenta M, recorded using cyan ink having a high diffusibility for cyan C, recorded using black ink having a high diffusibility for black K, and recorded using black ink having a low diffusibility for black K'. Neutral tints can be realized by combining the basic colors Y, M, C, K and K' of the inks. For example, red R can be described by R=Y+M, green G can be described by G=Y+C, and blue B can be described by B=M+C.

FIG. 20 is a flow chart for explaining the operation of the boundary color discriminator 20, the separator 21 and the dot controller 22 for a case where a recording width using the black ink having the high diffusibility at the boundary portion is 1 dot. In FIG. 20 and figures which follow, $dX_{m,n}$ indicates the image data of the hue X related to the dot recording position $DX_{m,n}$. The input color image data $dX_{m,n}$ does not include data for X=K'.

In FIG. 20, a step S1 initializes m and n to 0. A step S2 decides whether or not the image data $dK_{m,n}$ related to the dot recording position $DK_{m,n}$ is 1. If the decision result in the step S2 is NO, the process advances to a step S5 which will be described later. On the other hand, if the decision result in the step S2 is YES, a step S3 decides whether or not each hue image data other than black and adjacent to each dot recording position $DK_{m,n}$ is 0. In other words, the decision result in the step S3 becomes YES if the image data $dY_{m-1,n}$, $dY_{m+1,n}$, $dY_{m,n-1}$, $dY_{m,n+1}$, $dM_{m-1,n}$, $dM_{m+1,n}$, $dM_{m,n-1}$, $dM_{m,n+1}$, $dC_{m-1,n}$, $dC_{m+1,n}$, $dC_{m,n-1}$ and $dC_{m,n+1}$ all become 0. If the decision result in the step S3 is YES, a step S4 sets the image data $dK_{m,n}$ to 0, and sets the image data $dK'_{m,n}$ to 1. By this step S4, the recording using the black ink having the high diffusibility is not made with respect to the image data $dK_{m,n}$, the image data $dK_{m,n}$ is replaced by the image data $dK'_{m,n}$, and the recording is made using the black ink having the low diffusibility.

The step S5 decides whether or not m=a, and if the decision result is NO, a step S6 sets m to m+1 and the process returns to the step S2, where a denotes a final value of m. On the other hand, if the decision result in the step S5 is YES, a step S7 decides whether or not n=b, where b denotes a final value of n. If the decision result in the step S7 is NO, a step S8 sets m to 0 and sets n to n+1, and the process returns to the step S2. The process ends if the decision result in the step S7 is YES.

Accordingly, in the boundary portion of the black region and a region of a hue other than black, the portion to be recorded using the black ink having the low diffusibility is replaced by a portion which is to be recorded using the black ink having the high diffusibility by an amount of 1 dot. In other words, the recording width using the black ink having the high diffusibility is set to 1 dot in the boundary portion.

When setting the recording width using the black ink having the high diffusibility in the boundary portion to p dots, the search is basically made for the image data within the range of $dX_{m\pm p,n\pm p}$ in FIG. 20.

Figure 21:
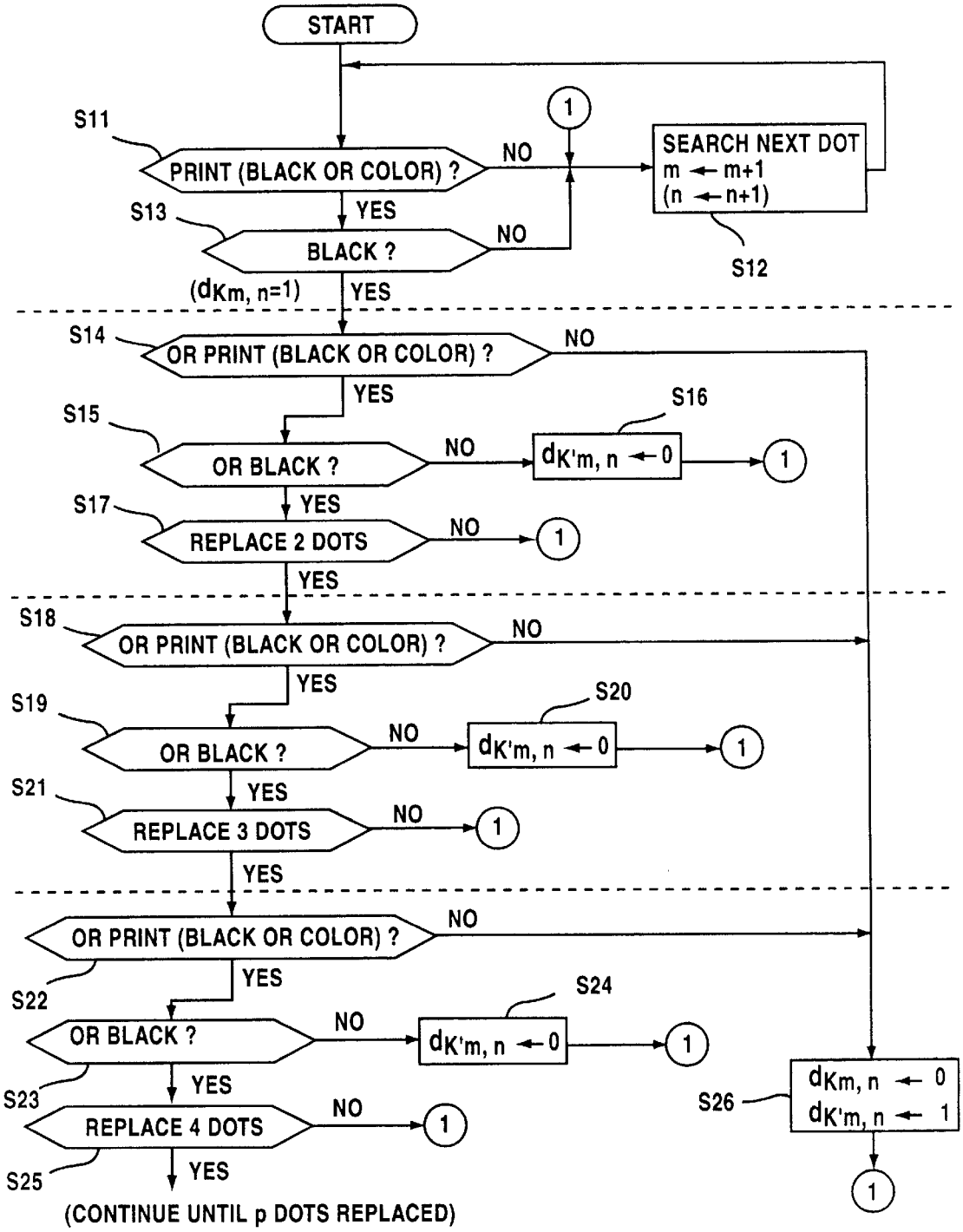
FIG. 21 is a flow chart for explaining the operation of the black data boundary color discriminator, the black data separator and the dot controller for a case where the recording width using the black ink having the high diffusibility at the boundary portion is p dots.

FIG. 21 is a flow chart for explaining the operation of the boundary color discriminator 20, the separator 21 and the dot controller 22 for a case where a recording width using the black ink having the high diffusibility at the boundary portion is p dots.

In FIG. 21, a step S11 decides whether or not the image data $dX_{m,n}$ with respect to the dot recording position $D_{m,n}$ exists, that is, whether or not the recording of black or another hue is to be made. When the dot recording position $D_{m,n}$ is to be unrecorded and the decision result in the step S11 is NO, a step S12 sets m to m+1 or sets n to n+1 in order to search for the next dot recording position. In the initial state, m=1 and n=1, and the dot recording positions are successively searched from this state. Accordingly, m is first set to m+1 in the step S12, and when the search is made up to m=a, n is then set to n+1 in the step S12 and the search is successively repeated until n becomes n=b. On the other hand, if the decision result in the step S11 is YES, a step S13 decides whether or not the image data $dX_{m,n}$ with respect to the dot recording position $D_{m,n}$ is black, that is, $dK_{m,n}=1$. The process returns to the step S12 if the decision result in the step S13 is NO, but the process advances to a step S14 which will be described later if the decision result in the step S13 is YES.

The above described steps S11 through S13 judge whether or not the recording is to be made in black or another hue, and discriminate the hue.

The step S14 decides whether or not an image data $dX_{x,y}$ with respect to any of dot recording positions $D_{x,y}$ adjacent to the dot recording position $D_{m,n}$ exists, that is, whether or not the recording is to be made in black or another hue. In this case, (x, y) is (m, n+1), (m+1, n), or (m+1, n+1). When all of the dot recording positions $D_{x,y}$ are to be unrecorded and the decision result in the step S14 is NO, the process advances to a step S26. The step S26 sets the image data $dK_{m,n}$ to 0 and sets the image data $dK'_{m,n}$ to 1, and the process thereafter returns to the step S12. On the other hand, if the decision result in the step S14 is YES, a step S15 decides whether or not the image data $dX_{x,y}$ with respect to any of the dot recording positions $D_{x,y}$ is black, that is, whether or not $dK_{x,y}=1$. If the decision result in the step S15 is NO, a step S16 sets the image data $dK'_{m,n}$ to 0, and the process returns to the step S12. In addition, if the decision result in the step S15 is YES, a step S17 decides whether or not to replace the image data $dK_{x,y}$ with respect to the 2 dot recording positions $D_{x,y}$ by $dK'_{x,y}$. In other words, the step S17 decides whether or not to set the recording width to be recorded using the black ink having the high diffusibility in the boundary portion to 2 dots. The process returns to the step S12 if the decision result in the step S17 is NO, but the process advances to a step S18 which will be described later if the decision result in the step S17 is YES.

The above described steps S14 through S17 judge the hue of the first adjacent dot at the first dot position, and sets the recording width to be recorded using the black ink having the high diffusibility in the boundary region to 1 dot.

The step S18 decides whether or not the image data $dX_{x,y}$ with respect to any of the dot recording positions $D_{x,y}$ adjacent to the dot recording position $D_{m,n}$ exists, that is, whether or not the recording is to be made in black or another hue. In this case, (x, y) is (m, n+2), (m+1, n+2), (m+2, n), (m+2, n+1) or (m+2, n+2). When all of the dot recording positions $D_{x,y}$ are to be unrecorded and the decision result in the step S18 is NO, the process advances to the step S26. On the other hand, if the decision result in the step S18 is YES, a step S19 decides whether or not the image data $dX_{x,y}$ with respect to any of the dot recording positions $D_{x,y}$ is black, that is, whether or not $dK_{x,y}=1$. If the decision result in the step S19 is NO, a step S20 sets the image data $dK'_{m,n}$ to 0, and the process returns to the step S12. In addition, if the decision result in the step S19 is YES, a step S21 decides whether or not to replace the image data $dK_{x,y}$ with respect to the 3 dot recording positions $D_{x,y}$ by $dK'_{x,y}$. In other words, the step S21 decides whether or not to set the recording width to be recorded using the black ink having the high diffusibility in the boundary portion to 3 dots. The process returns to the step S12 if the decision result in the step S21 is NO, but the process advances to a step S22 which will be described later if the decision result in the step S21 is YES.

The above described steps S18 through S21 judge the hue of the second adjacent dot at the second dot position, and sets the recording width to be recorded using the black ink having the high diffusibility in the boundary region to 2 dots.

The step S22 decides whether or not the image data $dX_{x,y}$ with respect to any of the dot recording positions $D_{x,y}$ adjacent to the dot recording position $D_{m,n}$ exists, that is, whether or not the recording is to be made in black or another hue. In this case, (x, y) is (m, n+3), (m+1, n+3), (m+2, n+3), (m+3, n), (m+3, n+1), (m+3, n+2) or (m+3, n+3). When all of the dot recording positions $D_{x,y}$ are to be unrecorded and the decision result in the step S22 is NO, the process advances to the step S26. On the other hand, if the decision result in the step S22 is YES, a step S23 decides whether or not the image data $dX_{x,y}$ with respect to any of the dot recording positions $D_{x,y}$ is black, that is, whether or not $dK_{x,y}=1$. If the decision result in the step S23 is NO, a step S24 sets the image data $dK'_{m,n}$ to 0, and the process returns to the step S12. In addition, if the decision result in the step S23 is YES, a step S25 decides whether or not to replace the image data $dK_{x,y}$ with respect to the 4 dot recording positions $D_{x,y}$ by $dK'_{x,y}$. In other words, the step S25 decides whether or not to set the recording width to be recorded using the black ink having the high diffusibility in the boundary portion to 4 dots. The process returns to the step S12 if the decision result in the step S25 is NO, but the process advances to a next step (not shown) if the decision result in the step S25 is YES.

The above described steps S22 through S25 judge the hue of the third adjacent dot at the third dot position, and sets the recording width to be recorded using the black ink having the high diffusibility in the boundary region to 3 dots.

Similarly thereafter, the above described operation is repeated until the recording width to be recorded using the black ink having the high diffusibility in the boundary portion is set to p dots.

Figure 22:
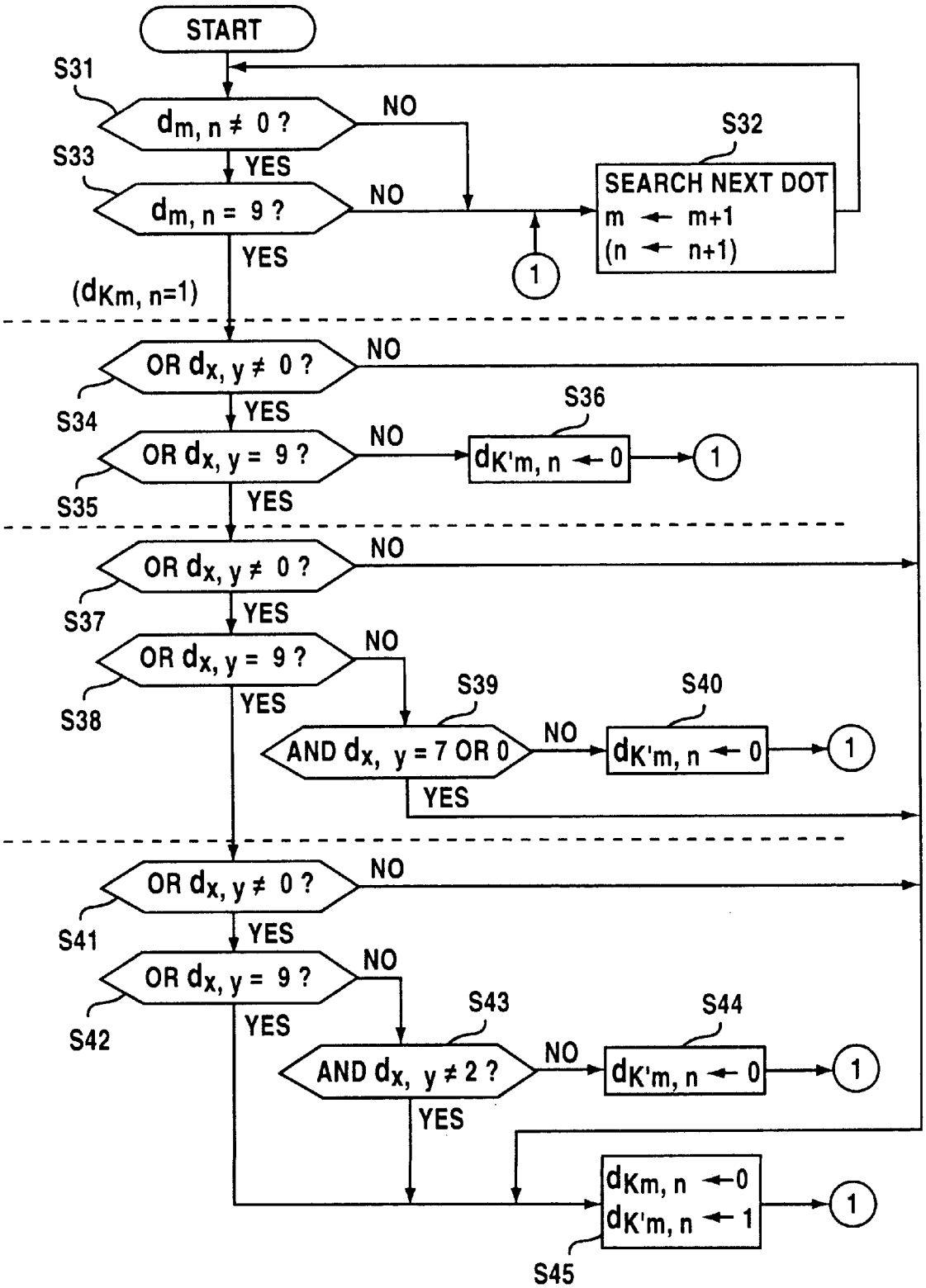
FIG. 22 is a flow chart for explaining the operation of the black data boundary color discriminator, the black data separator and the dot controller for a case where the recording width using the black ink having the high diffusibility at the color boundary portion is adjusted depending on the difference between the contrasts of the colors of the adjacent regions.

Next, a description will be given of the operation of the boundary color discriminator 20, the separator 21 and the dot controller 22 for a case where the recording width to be recorded using the black ink having the high diffusibility in the color boundary portion is adjusted depending on the contrast difference of the hues in the adjacent regions, by referring to FIG. 22. FIG. 22 is a flow chart for explaining the operation of the boundary color discriminator 20, the separator 21 and the dot controller 22 in this case.

In FIG. 22, the hue is indicated by a numerical value. For the sake of convenience, the numerical values are assigned from the hue having the highest contrast, such that the unrecorded portion (no data) is 0, Y=2, M=3, C=4, R(Y+M)=5, G(Y+C)=6,B(M+C)=7, and K=K'=9. It is also assumed in the following description that the recording width to be recorded using the black ink having the high diffusibility, that is, the number of dots to be replaced by K from K', is set to 3 dots for Y, 2 dots for M, C, R and G, and 1 dot for B in the order having a large contrast difference with black (K, K') and having notable blending at the boundary portion.

In FIG. 22, a step S31 decides whether or not an image data $d_{m,n}$ with respect to the dot recording position $D_{m,n}$ exists, that is, whether or not a recording in black or another color is to be made for $d_{m,n}\neq 0$. If the dot recording position $D_{m,n}$ is to be unrecorded and the decision result in the step S31 is NO, a step S32 sets m to m+1 or sets n to n+1 in order to search for the next dot recording position. In the initial state, m=1 and n=1, and the dot recording positions are successively searched from this state. Accordingly, m is first set to m+1 in the step S32, and when the search is made up to m=a, n is then set to n+1 in the step S32 and the search is successively repeated until n becomes n=b. On the other hand, if the decision result in the step S31 is YES, a step S33 decides whether or not the image data $d_{m,n}$ with respect to the dot recording position $D_{m,n}$ is 9, that is, $dK_{m,n}=1$. The process returns to the step S32 if the decision result in the step S33 is NO, but the process advances to a step S34 which will be described later if the decision result in the step S33 is YES.

The above described steps S31 through S33 judge whether or not the recording is to be made in black or another hue, and discriminate the hue.

The step S34 decides whether or not an image data $d_{x,y}$ with respect to any of dot recording positions $D_{x,y}$ adjacent to the dot recording position $D_{m,n}$ exists, that is, whether or not $d_{x,y}\neq 0$ and the recording is to be made in black or another hue. In this case, (x, y) is (m, n+1), (m+1, n), or (m+1, n+1). When all of the dot recording positions $D_{x,y}$ are to be unrecorded and the decision result in the step S34 is NO, the process advances to a step S45. The step S45 sets the image data $dK_{m,n}$ to 0 and sets the image data $dK'_{m,n}$ to 1, and the process thereafter returns to the step S32. On the other hand, if the decision result in the step S34 is YES, a step S35 decides whether or not the image data $d_{x,y}$ with respect to any of the dot recording positions $D_{x,y}$ is black, that is, whether or not $d_{x,y}=9$. If the decision result in the step S35 is NO, a step S36 sets the image data $dK'_{m,n}$ to 0, and the process returns to the step S32. In addition, if the decision result in the step S35 is YES, the process advances to a step S37 which will be described later.

The above described steps S34 through S36 judge the hue of the first adjacent dot at the first dot position, and sets the recording width to be recorded using the black ink having the high diffusibility in the boundary region to 1 dot.

The step S37 decides whether or not the image data $d_{x,y}$ with respect to any of the dot recording positions $D_{x,y}$ adjacent to the dot recording position $D_{m,n}$ exists, that is, whether or not $d_{x,y} \neq 0$ and the recording is to be made in black or another hue. In this case, (x, y) is (m, n+2), (m+1, n+2), (m+2, n), (m+2, n+1) or (m+2, n+2). When all of the dot recording positions $D_{x,y}$ are to be unrecorded and the decision result in the step S37 is NO, the process advances to the step S45. On the other hand, if the decision result in the step S37 is YES, a step S38 decides whether or not the image data $d_{x,y}$ with respect to any of the dot recording positions $D_{x,y}$ is black, that is, whether or not $d_{x,y}=9$. If the decision result in the step S38 is NO, a step S39 decides whether or not the image data $d_{x,y}$ is 0 to 7, so as to decide whether or not the hue of the image data $d_{x,y}$ is other than black. If the decision result in the step S39 is YES, the process advances to the step S45. On the other hand, if the decision result in the step S39 is NO, a step S40 bsets the image data $dK'_{m,n}$ to 0, and the process returns to the step S32. In addition, if the decision result in the step S38 is YES, the process advances to a step S41 which will be described later.

The above described steps S37 through S40 judge the hue of the second adjacent dot at the second dot position, and sets the recording width to be recorded using the black ink having the high diffusibility in the boundary region to 2 dots.

The step S41 decides whether or not the image data $d_{x,y}$ with respect to any of the dot recording positions $D_{x,y}$ adjacent to the dot recording position $D_{m,n}$ exists, that is, whether or not $d_{x,y} \neq 0$ and the recording is to be made in black or another hue. In this case, (x, y) is (m, n+3), (m+1, n+3), (m+2, n+3), (m+3, n), (m+3, n+1), (m+3, n+2) or (m+3, n+3). When all of the dot recording positions $D_{x,y}$ are to be unrecorded and the decision result in the step S41 is NO, the process advances to the step S45. On the other hand, if the decision result in the step S41 is YES, a step S42 decides whether or not the image data $d_{x,y}$ with respect to any of the dot recording positions $D_{x,y}$ is black, that is, whether or not $d_{x,y}=9$. If the decision result in the step S42 is NO, a step S43 decides whether or not the image data $d_{x,y}$ is other than 2, so as to decide whether or not the hue of the image data $d_{x,y}$ is other than yellow. If the decision result in the step S42 or S43 is YES, the process advances to the step S45. On the other hand, if the decision result in the step S43 is NO, a step S44 sets the image data $dK'_{m,n}$ to 0, and the process returns to the step S32.

The above described steps S41 through S44 judge the hue of the third adjacent dot at the third dot position, and sets the recording width to be recorded using the black ink having the high diffusibility in the boundary region to 3 dots.

Figure 23:
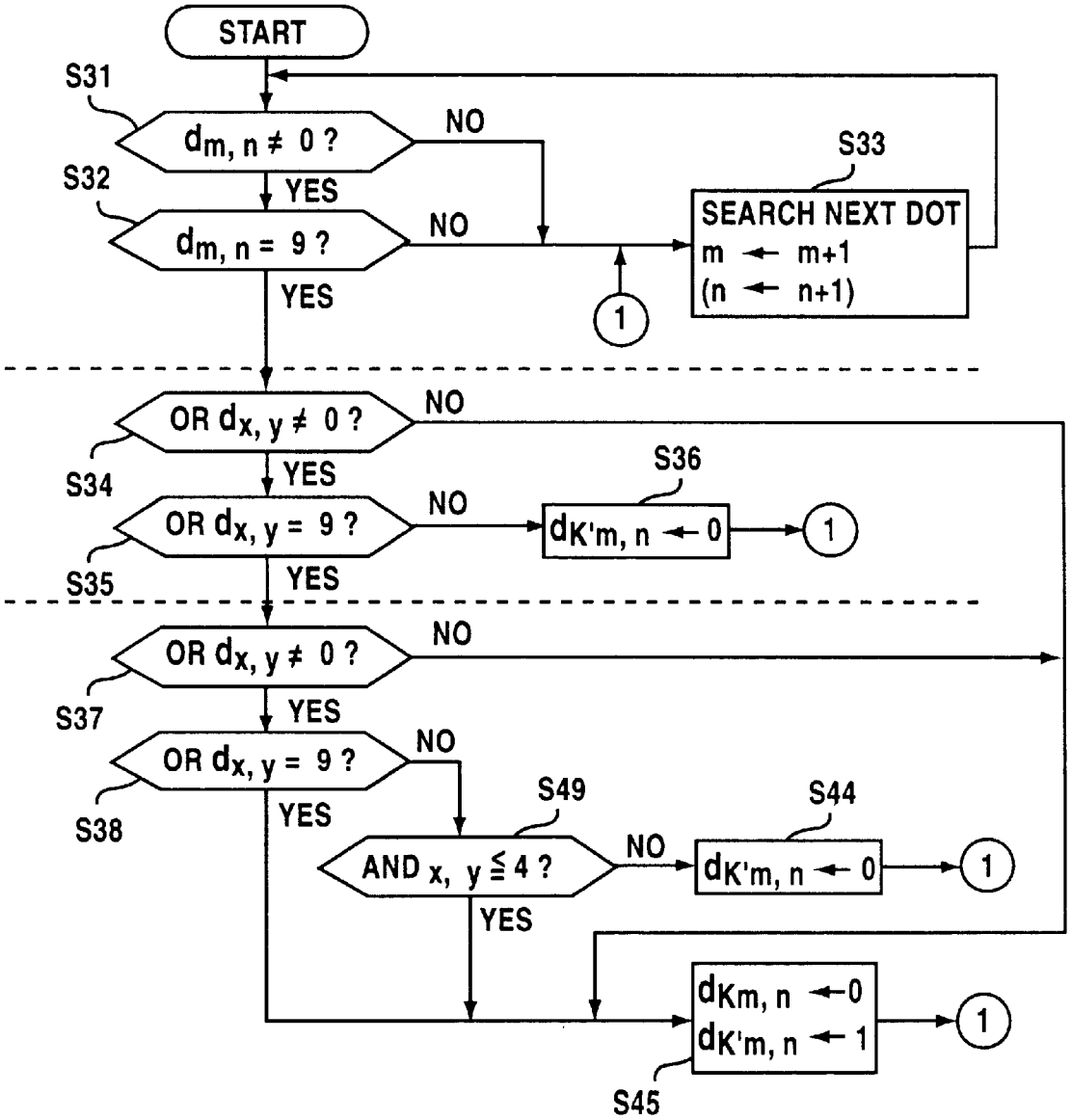
FIG. 23 is a flow chart for explaining the operation of the black data boundary color discriminator, the black data separator and the dot controller for a case where the recording width using the black ink having the high diffusibility at the color boundary portion is adjusted depending on amounts of the ink used to record the adjacent regions.

Next, a description will be given of the operation of the boundary color discriminator 20, the separator 21 and the dot controller 22 for a case where the recording width to be recorded using the black ink having the high diffusibility in the color boundary portion is adjusted depending on the amount of ink recorded in the adjacent regions, by referring to FIG. 23. FIG. 23 is a flow chart for explaining the operation of the boundary color discriminator 20, the separator 21 and the dot controller 22 in this case. In FIG. 23, those steps which are the same as those corresponding steps in FIG. 22 are designated by the same reference numerals, and a description thereof will be omitted.

In FIG. 23, the hue is indicated by a numerical value. For the sake of convenience, the numerical values are assigned from the hue having the highest contrast, such that the unrecorded portion (no data) is 0, Y=2, M=3, C=4, R(Y+M)=5, G(Y+C)=6, B(M+C)=7, and K=K'=9. When overlapping the primary colors Y, M and C to record the secondary colors R, B and G, the amount of ink used to record the secondary color becomes approximately 2 times that used to record the primary color. It is assumed in the following description that the recording width to be recorded using the black ink having the high diffusibility on the primary color side of the boundary portion is set to 1 dot, and the recording width to be recorded using the black ink having the high diffusibility on the secondary color side of the boundary portion is set to 2 dots.

In FIG. 23, if the decision result in the step S38 is YES, the process advances to the step S45. On the other hand, if the decision result in the step S38 is NO, a step S49 decides whether or not the image data $d_{x,y}$ is 4 or greater, so as to decide whether or not the hue of the image data $d_{x,y}$ is cyan or a hue having a contrast lower than cyan. If the decision result in the step S49 is YES, the process advances to the step S45. On the other hand, if the decision result in the step S49 is NO, the step S44 sets the image data $dK'_{m,n}$ to 0 and the process returns to the step S32.

Figure 24:
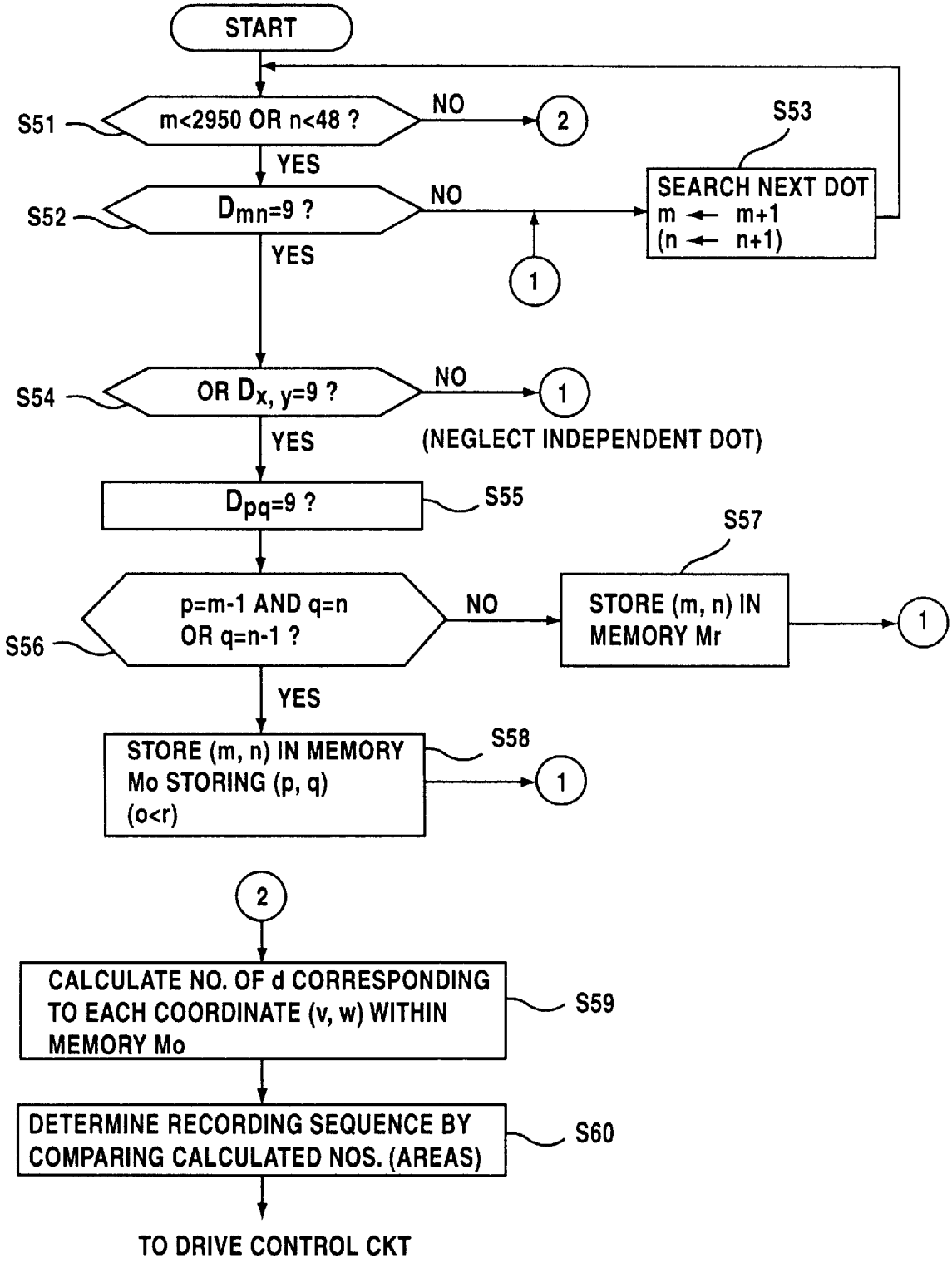
FIG. 24 is a flow chart for explaining the operation of the black data boundary color discriminator, the black data separator and the dot controller for a case where a recording area to be recorded using the black ink having the high diffusibility and a recording area to be recorded using the black ink having the low diffusibility are calculated.

Next, a description will be given of a method of calculating a recording area to be recorded using the black ink having the high diffusibility and a recording area to be recorded using the black ink having the low diffusibility within the black region, by referring to FIG. 24. FIG. 24 is a flow chart for explaining the operation of the boundary color discriminator 20, the separator 21 and the dot controller 22 for a case where the recording area to be recorded using the black ink having the high diffusibility and the recording area to be recorded using the black ink having the low diffusibility are calculated.

In FIG. 24, the hue is indicated by a numerical value. For the sake of convenience, the numerical values are assigned from the hue having the highest contrast, such that the unrecorded portion (no data) is 0, Y=2, M=3, C=4, R(Y+M)=5, G(Y+C)=6, B(M+C)=7, and K=K'=9. In addition, it is assumed that the ink jet recording apparatus employs the serial recording system,and the recording area to be recorded using the black ink having the high diffusibility and the recording area to be recorded using the black ink having the low diffusibility are calculated with respect to the data amounting to one scan, that is, for m=1 to 2950 and N=1 to 48, for example. Furthermore, it is assumed that the black data are separated into the black data $dK_{m,n}$ to be recorded using the black ink having the high diffusibility and the black data $dK'_{m,n}$ to be recorded using the black ink having the low diffusibility by the process described above.

In FIG. 24, a step S51 decides whether or not m<2950 or n<48 with respect to the image data stored within the memory 26 shown in FIG. 18 or within the buffer memory. The process advances to a step S59 which will be described later if the decision result in the step S51 is NO. On the other hand, if the decision result in the step S51 is YES, S52 decides whether or not the image data $d_{m,n}$ with respect to the dot recording position $D_{m,n}$ is 9, that is, whether or not the image data $d_{m,n}$ indicates black. If the decision result in the step S52 is NO, a step S53 sets m to m+1 or sets n to n+1, so as to search the next dot recording position. In the initial state, m=1 and n=1, and the dot recording positions are successively searched from this state. Accordingly, m is first set to m+1 in the step S53, and when the search is made up to m=2950, n is then set to n+1 in the step S53, and the search is successively repeated until n becomes n=48. On the other hand, the process advances to a step S54 which will be described later if the decision result in the step S52 is YES.

The step S54 decides whether or not the image data $d_{x,y}$ with respect to any of the dot recording positions $D_{x,y}$ adjacent to the dot recording position $D_{m,n}$ is 9, that is, whether or not the image data $d_{x,y}$ indicates black. In this case, (x, y) is (m−1, n−3), (m, n−1), (m+1, n−1), (m−1, n), (m+1, n), (m−1, n+1), (m, n−1) or (m+1, n+1), and $1 \leqq x \leqq 2950$ and $1 \leqq y48$. If the decision result in the step S54 is NO, the process returns to the step S53 by neglecting an independent dot which is isolated by itself. On the other hand, if the decision result in the step S54 is YES, a step S55 sets the image data $d_{p,q}$ to $d_{p,q}=9$.

A step S56 decides whether or not p=m−1 and q=n or q=n−1. If the decision result in the step S56 is NO, a step S57 stores (m, n) into a new memory region Mr within the memory 26 or the buffer memory, and the process returns to the step S53. On the other hand, if the decision result in the step S56 is YES, a step S58 stores (m, n) into an existing memory region Mo which stores (p, q) and is within the memory 26 or the buffer memory, where o<r. The process returns to the step S53 after the step S58.

If the decision result in the step S51 is NO, a step S59 calculates the numbers of the image data $dK_{v,w}$ and $dK'_{v,w}$ corresponding to each coordinate (v, w) within the same existing memory region Mo. As a result, the recording areas are calculated. In addition, a step S60 compares the numbers calculated in the step S59, that is, the calculated recording areas, and determines the recording sequence of the recording area to be recorded using the black ink having the high diffusibility and the recording area to be recorded using the black ink having the low diffusibility based on the comparison result. The driver 23 shown in FIG. 18 drives each head of the head portion 45 based on the recording sequence which is determined in this manner.

Next, a description will be given of a second embodiment of the ink jet recording apparatus according to the present invention. This second embodiment of the ink jet recording apparatus employs a second embodiment of the ink jet recording method according to the present invention, a second embodiment of the ink according to the present invention, and a second embodiment of the ink cartridge according to the present invention. The constructions of the ink jet recording apparatus and the ink cartridge may be the same as those shown in FIGS. 1 and 2, and thus, illustration and description related to the construction of the ink jet recording apparatus and the ink cartridge will be omitted for the second embodiment.

In this embodiment, when recording a color image using a plurality of different color inks including black ink, the Rf value of each color ink is set so as to satisfy a predetermined condition. In other words, the Rf value of at least one ink is made different from the Rf values of other inks, and in addition, the ink having a color with a low contrast is made to have a Rf value lower than the ink having a color with a high contrast.

The Rf value is a value indicating the mobility of the coloring material obtained by the paper chromatography method prescribed hereunder. That is, the larger the Rf value of the coloring material is, the lower the affinity with the cellulose fiber on the plain paper becomes, thereby making it more easier for the coloring material to spread with respect to the recording medium. The Rf value is obtained in the following manner.

5 weight % of a desired coloring material is dissolved into a water/diethylene glycol mixture solvent having a 55/45 weight percentage, so as to obtain a test liquid which is used to carry out the test. 2 $\mu$l of this test liquid is charged to the lower end portion of a filter which is manufactured by Toyo Roshi Kabushiki Kaisha of Japan and having a trade name Toyo Filter Paper No.50, and a development is made for a predetermined time according to a normal method using the above mixture solvent as the developing solvent. As a result of this development, a development distance A of the developing solvent from the charge point and a moving distance B of the dye from the charge point are measured, so as to obtain the Rf value which is a ratio B/A of the two measured distances A and B.

In this embodiment, a liquid medium forming the ink jet recording liquid, that is, the ink, is made up of water and a mixture of water and one or more kinds of water-soluble organic solvents. For the organic solvent, it is possible to use monohydric alcohols such as methanol, ethanol, (normal) propyl alcohol and isopropyl alcohol, dihydric alcohols such as ethylene glycol, propylene glycol, butylene glycol, hexylene glycol, diethylene glycol and triethylene glycol, trihydric alcohols such as glycerin, polyalkylene glycols such as polyethylene glycol and polybutylene glycol, nitride-containing heterocyclic compounds such as N-methyl-2-pyrrolidone and 1,3-dimethyl-2-imidazolidinone, and sub-alkyl ether of polyhydric alcohols such as ethylene glycol monomethyl ether, diethylene glycol monomethyl ether and triethylene glycol monomethyl ether. Particularly, it is desirable to use polyhydric alcohols which have hygroscopicity and low evaporation.

The organic solvent content within the ink is 5 to 80 weight %, and is desirably within the range of 5 to 50 weight %. If the organic solvent content is less than 5 weight %, the ink may dry too fast and the solubility of the dye may decrease to more easily cause deposition of the dye within the ink, thereby more easily causing the nozzle to clog. On the other hand, if the organic solvent content exceeds 80 weight %, the viscosity of the ink becomes too high, thereby making it difficult to eject the ink from the nozzle of the head.

The basic composition of the ink used in this embodiment is as described above. However, it is of course possible to add other dispersing agent, cationic, anionic or nonionic surface-active agent and the like, viscosity adjusting agent such as polyvinyl alcohol, celluloses and water-soluble resins, and pH adjusting agent such as diethanol amine and triethanol amine if necessary.

The present inventors recorded color images using yellow, magenta, cyan and black inks having the following composition 1 and the same Rf values.

| (Composition 1) | |
|---|---|
| Dye | 2 Weight % |
| Yellow: C.I. Acid Yellow 23, Rf Value = 0.90 | |
| Magenta: C.I. Acid Red 265, Rf Value = 0.91 | |
| Cyan: C.I. Acid Blue 120, Rf Value = 0.91 | |
| Black: C.I. Acid Black 139, Rf Value = 0.90 | |
| Diethylene Glycol | 10 Weight % |
| Ethyl Alcohol | 5 Weight % |
| Ethylne Glycol Dibenzyl Ether | 1 Weight % |
| Distilled Water | 88 Weight % |

Figure 25:
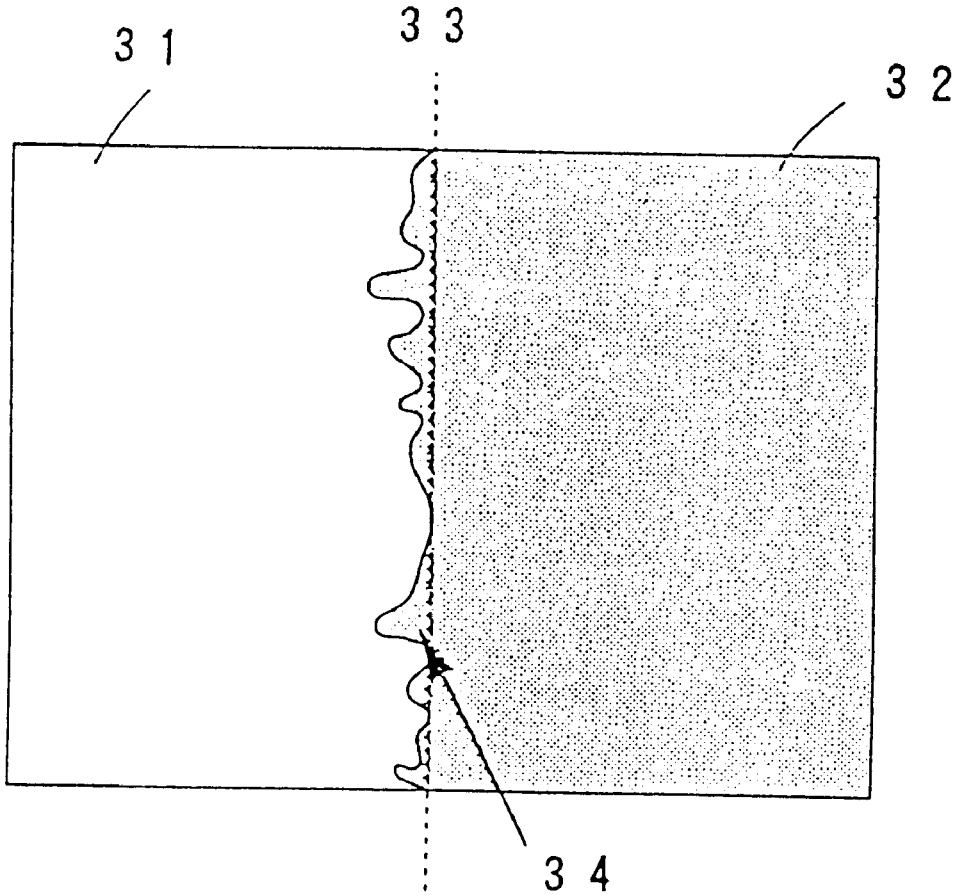
FIG. 25 is a diagram showing the blending that is generated at the boundary portion where a full recording region of a certain color and a full recording region of another color are adjacent to each other.

When the above composition 1 is used, an unwanted mixture of colors, that is, a blending 34, was generated at a boundary portion 33 of a full recording region 31 of a certain color and a full recording region 32 of another color, as shown in FIG. 25. Because of this blending 34, the recorded image became unclear, and it was only possible to obtain an image which is not sharp. The blending generated at the boundary portion between two different colors was particularly notable at the boundary portion of yellow and another color. This notable blending is thought to be caused by the human eyes which are affected by the contrast. In other words, in the boundary portion of two colors having a large contrast difference, the blending is visible to the human as if a run of the color somewhat similar to feathering occurs from the color having the low contrast towards the color having the high contrast.

Figure 26:
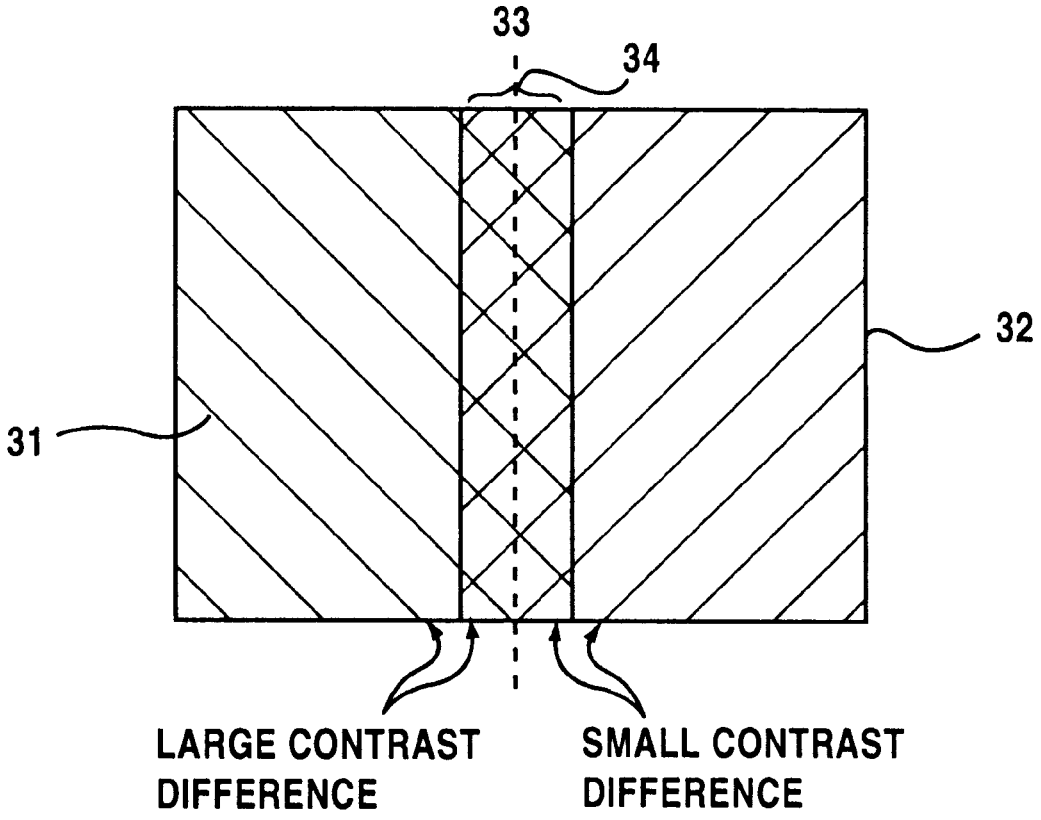
FIG. 26 is a diagram schematically showing the blending shown in FIG. 25.

FIG. 26 is a diagram schematically showing the blending shown in FIG. 25. In FIG. 26, those parts which are the same as those corresponding parts in FIG. 25 are designated by the same reference numerals, and a description thereof will be omitted.

In FIG. 26, the blending region 34 which is a mixture of yellow, magenta and cyan and therefore blackish is generated at the boundary portion 33 of the yellow region 31 and the blue region 32. The contrast difference between the blackish blending region 34 and the blue region 32 is relatively small, and the blending is not very notable. However, the contrast difference between the yellow region 31 and the blackish blending region 34 is large, and the blending therebetween is notable. For this reason, it is visible to the human eyes as if the color runs from the blue region 32 having the low contrast towards the yellow region 31 having the high contrast.

Accordingly, this embodiment selects the dyes without changing the solvent composition ratio of each color ink, so that the Rf value of the dye in the ink of a color having a low contrast is lower than the Rf value of the dye in the ink of a color having a high contrast. In other words, the Rf values are selected as shown in the following so that the Rf values Yr, Mr, Cr and Kr of the yellow, magenta, cyan and black dyes respectively satisfy a relationship $Yr>Mr\geqq Cr>Kr$. In addition, the lower the contrast of the color of the ink is, the larger the affinity with the cellulose fiber forming the main component of the paper which is used as the recording medium is set. As a result, it is possible to make the blending on the recording medium inconspicuous.

The present inventors recorded color images using yellow, magenta, cyan and black inks having the following composition 2 so as to satisfy the above described conditions.

| (Composition 2) | |
|---|---|
| Dye | 2 Weight % |
| Yellow: C.I. Acid Yellow 23, Rf Value = 0.90 | |
| Magenta: C.I. Acid Red 161, Rf Value = 0.86 | |
| Cyan: C.I. Direct Blue 86, Rf Value = 0.86 | |
| Black: C.I. Direct Black 154, Rf Value = 0.72 | |
| Diethylene Glycol | 10 Weight % |
| Ethyl Alcohol | 5 Weight % |
| Ethylne Glycol Dibenzyl Ether | 1 Weight % |
| Distilled Water | 88 Weight % |

When the above composition 2 is used, it was confirmed that the blending which was conventionally notable at the boundary portion between yellow and another color becomes virtually inconspicuous. It may be regarded that the force with which the yellow ink tends to flow into the cyan, magenta and black inks is stronger than the force with which the cyan, magenta and black inks tend to flow into the yellow ink, thereby making it difficult for the cyan, magenta and black inks to intrude into the yellow region by exceeding the boundary portion. It was also confirmed that the black ink is prevented from flowing into the inks of other colors for similar reasons, thereby making it possible to record a clear and sharp color image.

Figure 27:
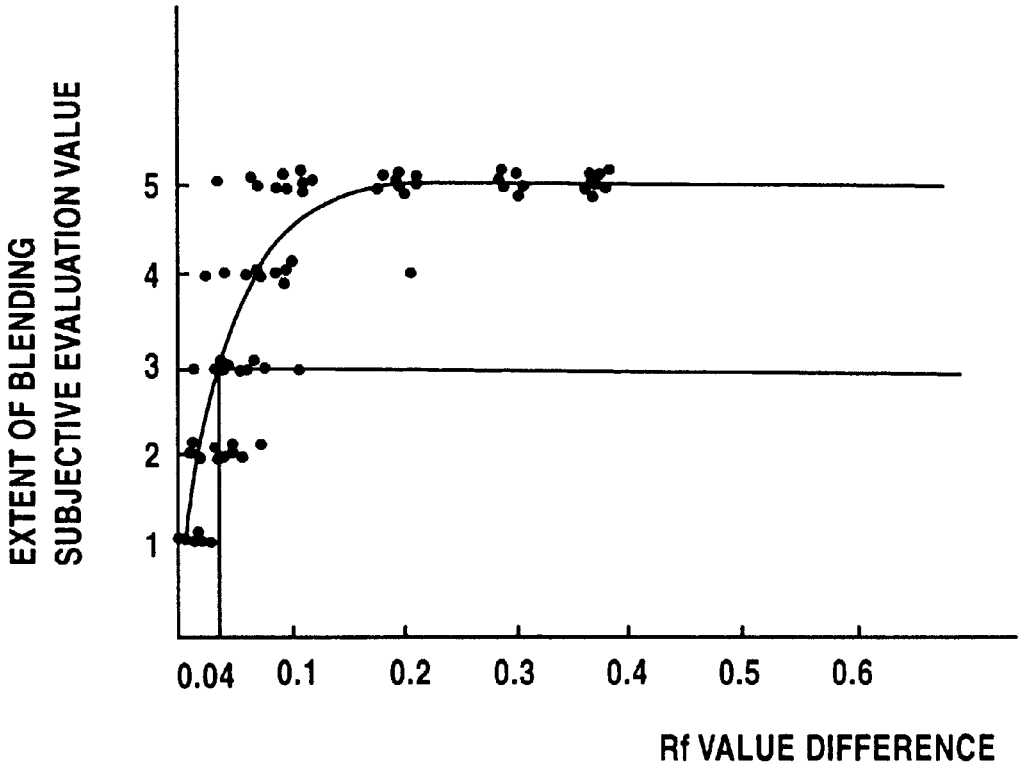
FIG. 27 is a diagram showing the relationship between a difference in Rf values and the extent of the blending.

Furthermore, the present inventors studied the effects of the difference between the Rf values of the yellow and black ink on the blending by conducting experiments for cases where the yellow region which conventionally makes the blending conspicuous and the black region are recorded adjacent to each other. result, the relationship of the difference between the Rf values and the extent of the blending became as shown in FIG. 27. In FIG. 27, the abscissa indicates the difference of the Rf values, and the ordinate indicates the extent of the blending obtained by subjective evaluation. The subjective evaluation takes values from "1" to "5", where "5" indicates very satisfactory, "4" indicates satisfactory, "3"indicates tolerable, "2" indicates unsatisfactory, and "1" indicates very unsatisfactory, and the larger the value the more inconspicuous the blending becomes. As may be seen from FIG. 27, it was confirmed that the difference between the Rf values must be 0.04 or greater in order to obtain the subjective evaluation value of 3 or greater, and that the difference between the Rf values is desirably 0.1 or greater so that the subjective evaluation value becomes 4 or greater.

When carrying out the color image recording on the ink jet recording apparatus using each color ink having the composition 2 described above, it is desirable to sequentially make the recording starting from the ink having the low contrast, similarly as in the case of the first embodiment. This is because the ink which adheres onto the recording medium afterwards tends to be attracted by the ink which is already adhered on the recording medium, thereby causing the blending. According to the experiments conducted by the present inventors, it was found that the effect of preventing the blending is particularly improved when the recording is first made using the black ink having a large affinity with respect to the cellulose fiber and the recording is made last using the yellow ink having a small affinity.

In addition, the present inventors recorded color images using yellow, magenta, cyan and black inks having the following composition 3 which satisfies the same conditions as the composition 2 described above.

| (Composition 3) | |
|---|---|
| Yellow Ink | |
| Dye | 2 Weight % |
| Yellow: C.I. Acid Yellow 23, Rf Value = 0.90 | |
| Diethylene Glycol | 10 Weight % |
| Ethyl Alcohol | 5 Weight % |
| Ethylne Glycol Dibenzyl Ether | 1 Weight % |
| Anionic Surface-Active Agent | 0.5 Weight % |
| Distilled Water | 87.5 Weight % |
| Magenta Ink | |
| Dye | 2 Weight % |
| Magenta: C.I. Acid Red 161, Rf Value = 0.86 | |
| Diethylene Glycol | 10 Weight % |
| Ethyl Alcohol | 5 Weight % |
| Ethylne Glycol Dibenzyl Ether | 1 Weight % |
| Anionic Surface-Active Agent | 0.3 Weight % |
| Distilled Water | 87.7 Weight % |
| Cyan Ink | |
| Dye | 2 Weight % |
| Cyan: C.I. Direct Blue 86, Rf Value = 0.86 | |
| Diethylene Glycol | 10 Weight % |
| Ethyl Alcohol | 5 Weight % |
| Ethylne Glycol Dibenzyl Ether | 1 Weight % |
| Anionic Surface-Active Agent | 0.2 Weight % |
| Distilled Water | 87.8 Weight % |

-continued

| (Composition 3) | |
|---|---|
| Black Ink | |
| Dye | 2 Weight % |
| Black: C.I. Direct Black 154, Rf Value = 0.72 | |
| Diethylene Glycol | 10 Weight % |
| Ethyl Alcohol | 5 Weight % |
| Ethylne Glycol Dibenzyl Ether | 1 Weight % |
| Distilled Water | 88 Weight % |

When the above composition 3 is used, it is possible to make the diffusibility of the ink having the color with the low contrast lower than the diffusibility of the ink having the color with the high contrast because the surface-active agent having the diffusion effect is added to each color ink with a different quantity for each color ink. As a result, it was confirmed that the effect of preventing the blending at the boundary portion is further improved.

Figure 28:
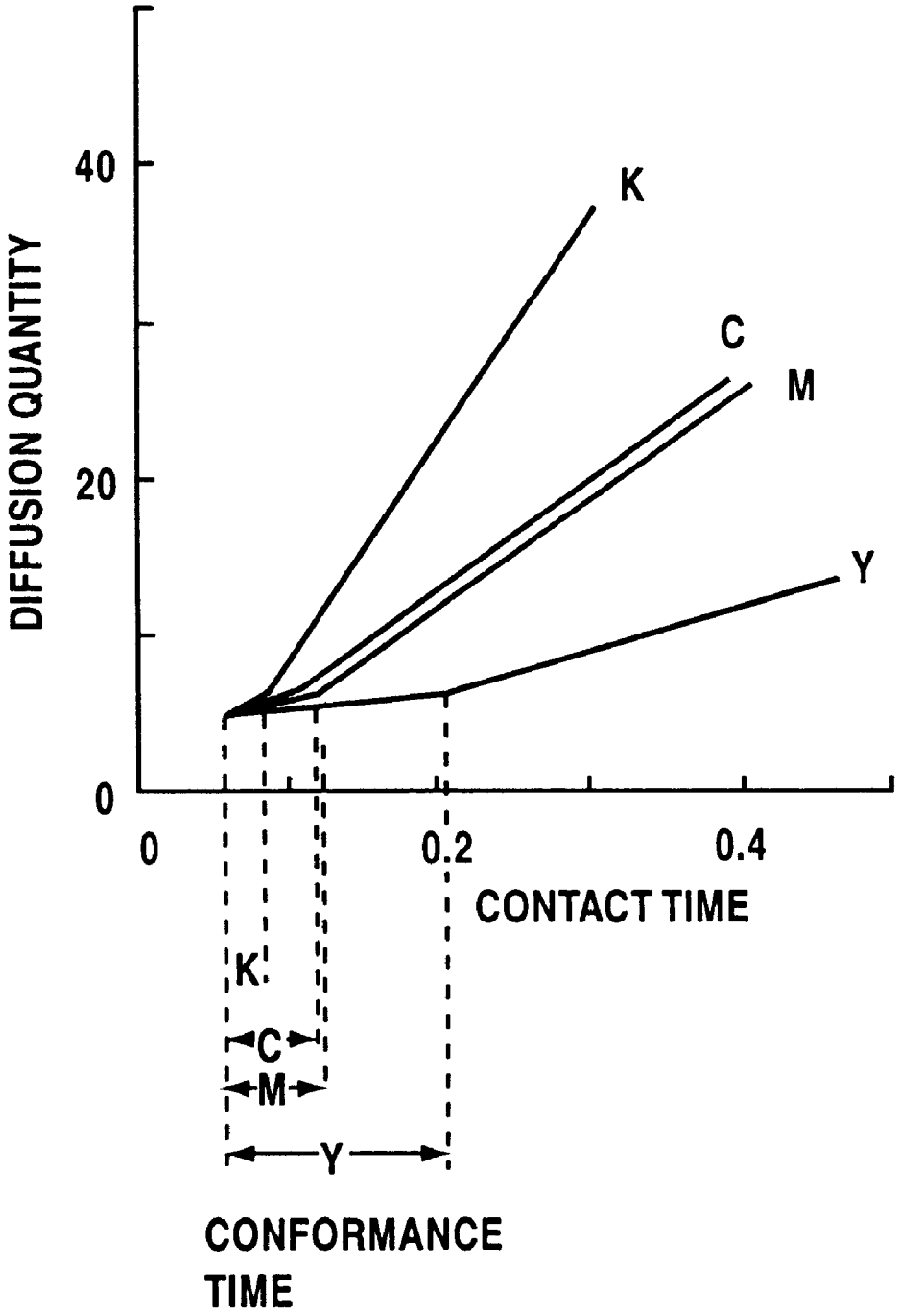
FIG. 28 is a diagram showing the relationship between an ink contact time and a diffusion quantity.

The present inventors obtained the results shown in FIG. 28 by comparing the diffusibilities of each of the inks according to the Bristow method. As shown in FIG. 28, it was found that the conformance time is shortest for the black ink having the lowest contrast, the conformance times of the cyan and magenta inks are approximately the same, and the conformance time of the yellow ink having the highest contrast is the longest. In FIG. 28, the abscissa indicates the contact time of the ink on the recording medium,and the ordinate indicates the ink diffusion quantity. In addition, Y, M, C and K respectively correspond to the yellow, magenta, cyan and black inks. When the recorded results obtained by using such inks were studied, it was confirmed that the blending is further reduced and that an extremely clear and sharp color image can be recorded.

According to the conventional ink jet recording system,it was extremely difficult to obtain a satisfactory recording quality when the generally used paper such as notebook paper, loose-leaf paper, copier paper, writing paper and letter paper are used as the recording medium. The reason for this difficulty was due to the bleeding that is caused by the ink which spreads along the paper fibers when the ink adheres onto the paper. For this reason, narrow rules, small characters, complicated Japanese Kanji characters prescribed under the JIS Second Level (Standard) and the like were in many cases unclear when recorded on the paper.

On the other hand, some paper is subjected to the sizing process so that the bleeding is suppressed when the writing is made using water-soluble ink. When the recording is made by the ink jet recording apparatus on such a paper subjected to the sizing process, however, the ink cannot easily diffuse into the paper is low and the fixing characteristic of the recorded images and characters on the paper becomes poor. For this reason, when the hands of the user touch the recorded images and characters on the paper or, the recorded papers are successively stacked in the case of sequential recording, the recorded images and characters are easily blurred or thinned. Furthermore, when the fixing characteristic of the ink on the paper is poor, the blending of the different colored inks easily occurred at the boundary portion.

In order to eliminate these inconveniences, a method has been proposed in a Japanese Laid-Open Patent Application No.6-143795, in addition to the methods (1) through (7) described above. According to this proposed method, the ink used is prescribed by the contact angle on the surface of polytetra fluoroethylene (PTFE). The contact angle of the ink with respect to the PTFE is greatly affected by the surface roughness of the PTFE. In addition, when the present inventors studied the relationship of the contact angle of the ink with respect to the PTFE and the contact angle of the ink with respect to the recording medium,no correlation was found. As a result, it was found that merely prescribing the ink by its contact angle with respect to the PTFE is insufficient to eliminate the above described inconveniences.

Accordingly, a description will now be given of an embodiment which can effectively suppress the bleeding and blending introduced by the ink jet recording, even with respect to recording mediums such as the so-called plain paper which is subjected to the sizing process and has the paper fibers exposed at the recording surface of the recording medium.

A description will be given of a third embodiment of the ink jet recording apparatus according to the present invention. This third embodiment of the ink jet recording apparatus employs a third embodiment of the ink jet recording method according to the present invention, a third embodiment of the ink according to the present invention, and a third embodiment of the ink cartridge according to the present invention. The constructions of the ink jet recording apparatus and the ink cartridge may be the same as those shown in FIGS. 1 and 2, and thus, illustration and description related to the construction of the ink jet recording apparatus and the ink cartridge will be omitted for the third embodiment.

In this embodiment, when recording a color image using two or more kinds of different color inks, at least one kind of ink has a difference of 4 dyne/cm or greater in surface tension with respect to another kind of ink. In addition, the ink having the higher surface tension is used to record line drawing such as characters, and the ink having the lower surface tension is used to record general images such as graphics. As will be described later, the surface tension of the ink having the higher surface tension is desirably 49 dyne/cm or greater, and the surface tension of the ink having the lower surface tension is desirably 45 dyne/cm or less.

The present inventors have confirmed through experiments that when recording the line drawings such as characters, the bleeding is inconspicuous and no problems are introduced from the practical point of view as long as the color difference of the ink and the recording medium is small, even if the ink used has a high diffusion quantity. In addition, the ink used to record the characters is normally black in most cases, and this embodiment limits the two kinds of inks used for the line drawings such as characters and the general image such as graphics to only the hue having a large color difference with the recording medium which is normally white, that is, only to black. As a result, it is possible to reduce the number of kinds of inks and the number of heads, so that the construction of the ink jet recording apparatus is simplified and the cost of the ink jet recording apparatus is reduced.

In addition, the present inventors made various subjective evaluations and studied the bleeding and blending of the lines. As a result, it was found through experiments that the recording quality is satisfactory when the bleeding quantity of the line is 15 $\mu$m or less and the bleeding quantity of the line is 200 $\mu$m or less.

Figure 29:
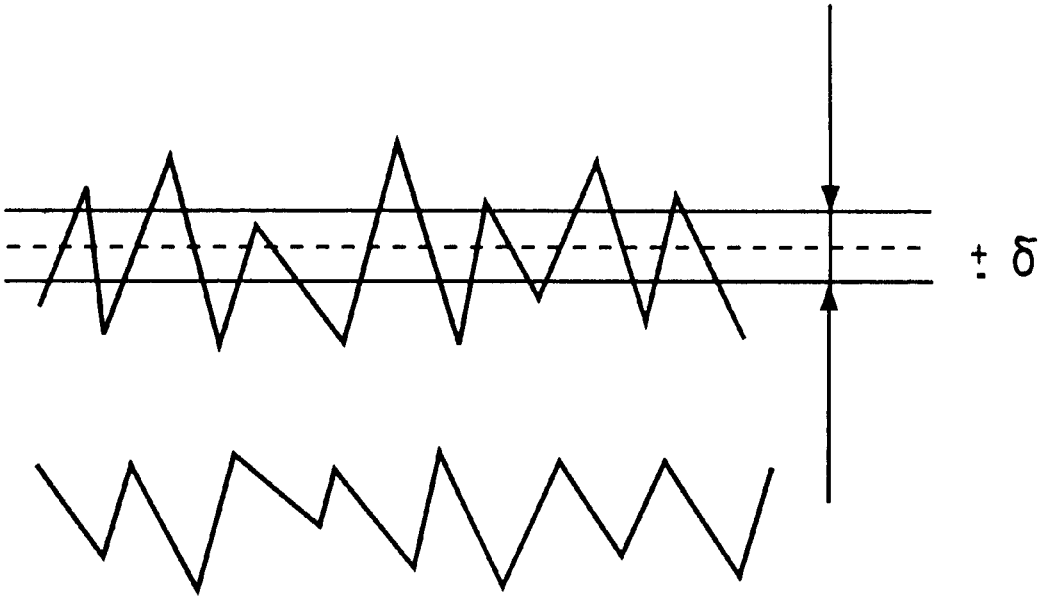
FIG. 29 is a diagram for explaining a bleeding quantity.
Figure 30:
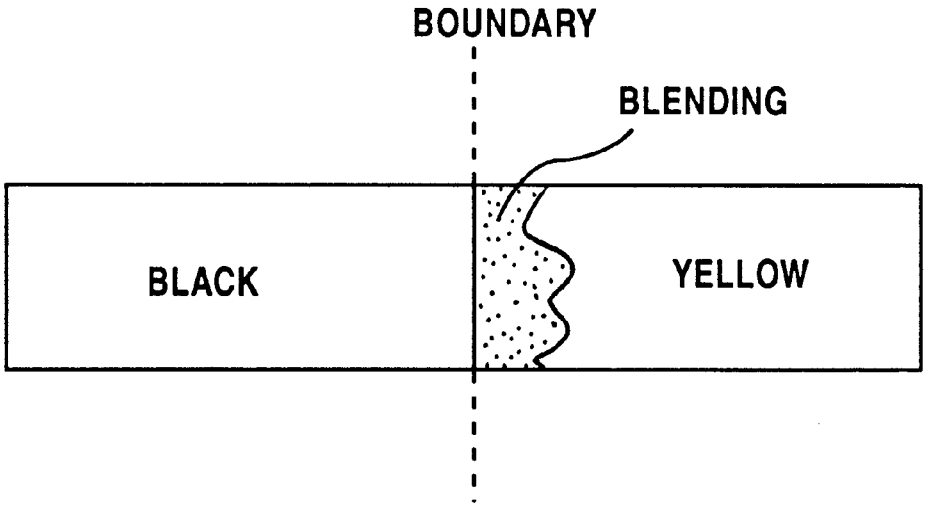
FIG. 30 is a diagram for explaining a blending quantity.

The bleeding quantity refers to the zigzag edges of the lines, that is, the zigzag contours of the lines. As shown in FIG. 29, the edge of the line is divided at fine intervals and a distance from an imaginary line to each edge peak is measured. A linear approximation is then made by least squares method so that an average of the measured distances (amounts of irregularities of the edges) becomes 0, and a standard deviation σ of the amounts of irregularities was taken as the bleeding quantity.

On the other hand, the blending quantity was obtained in the following manner. That is, an area of the ink projecting from a boundary line between two adjacent mutually different hues was calculated, and this area was divided by the length of the boundary line so as to evaluate the length of the projecting ink flow with respect to the unit length. Such an evaluation was made because the blending quantity obtained in area is dependent upon the length of the boundary portion.

Figure 31:
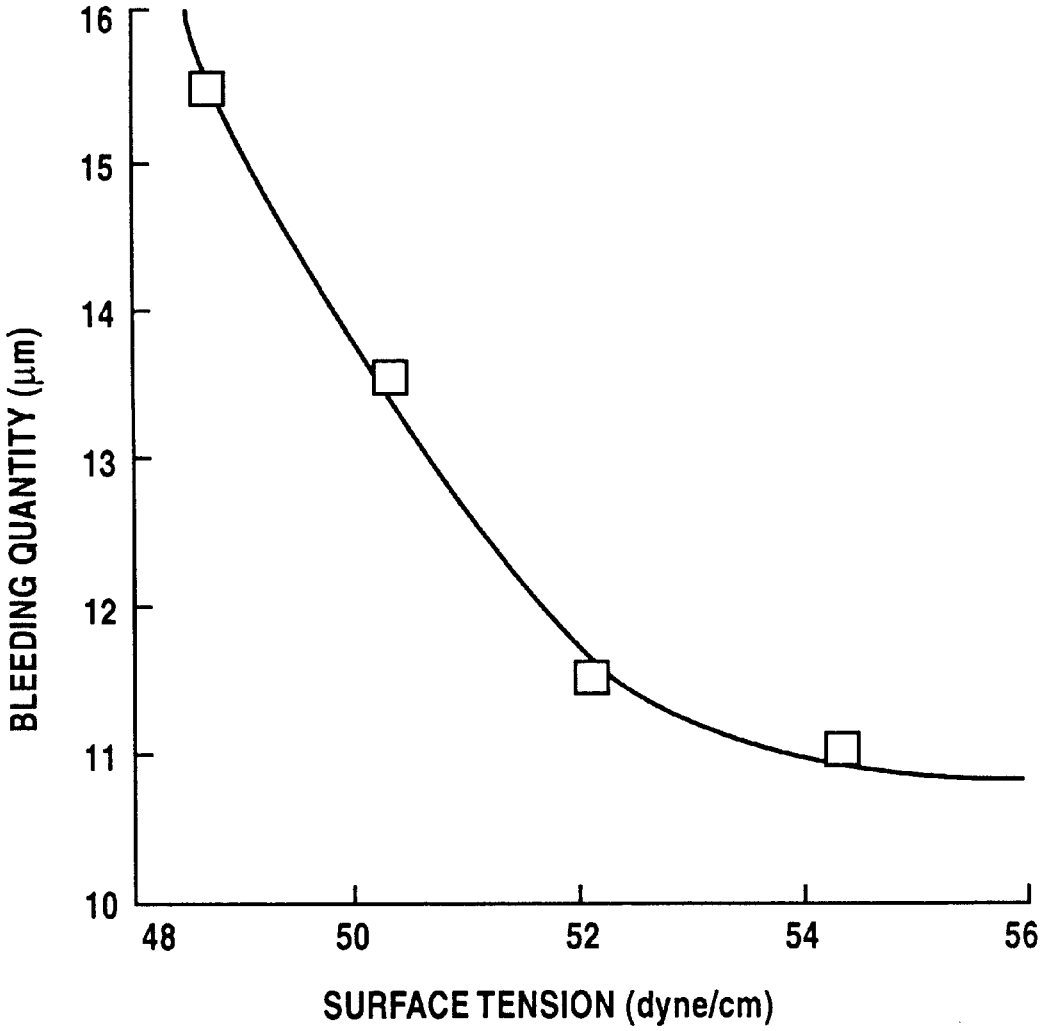
FIG. 31 is a diagram showing the relationship of a surface tension of the ink and the bleeding quantity.
Figure 32:
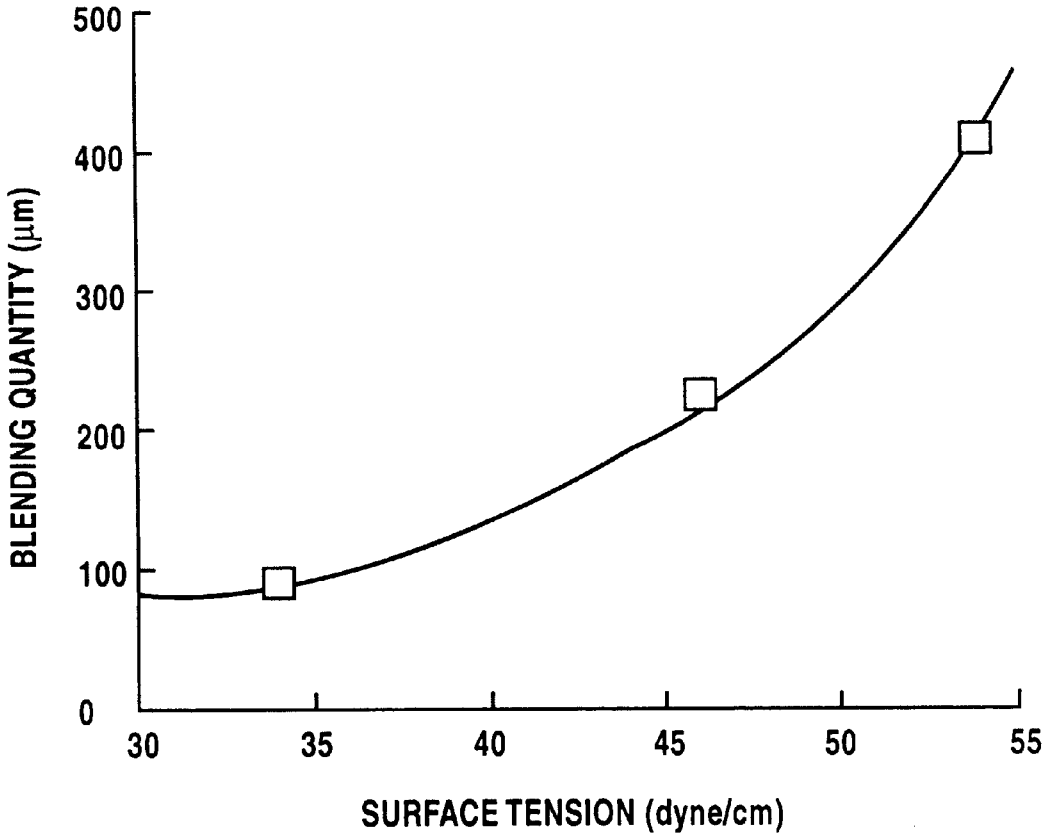
FIG. 32 is a diagram showing the relationship between the surface tension of the ink and the blending quantity.

FIG. 31 is a diagram showing the relationship of the surface tension of the ink and the bleeding quantity. In addition, FIG. 32 is a diagram showing the relationship between the surface tension of the ink and the blending quantity. It was found from FIG. 31 that the surface tension should be 49 dyne/cm or greater in order to make the bleeding quantity 15 μm or less. On the other hand, it was found from FIG. 32 that the surface tension should be 45 dyne/cm or less in order to make the blending quantity 200 μm or less.

The present inventors carried out recordings using black and yellow inks Ak and Ay which have the same surface tension within the above described range of the surface tension, and using black and yellow inks Bk and By which have the same surface tension which is different from that of the black and yellow inks Ak and Ay but fall within the above described range of the surface tension. FIG. 33 shows evaluation results of the bleeding and the blending for such recordings made. For this evaluation, a line drawing having a width of 3 dots and a full image were recorded. In addition, the bleeding of the line drawing was detected for the black ink, and the blending in the full image was detected in the boundary region between the black and yellow inks. The recordings were made for the hues so that the color difference becomes a maximum. In FIG. 33, a symbol "○" indicates that the bleeding quantity is 15 μm or less or the blending quantity is 200 μm or less, while a symbol "x" indicates that the bleeding quantity is greater than 15 μm or the blending quantity is greater than 200 μm.

As may be seen from FIG. 33, in the case of the inks Ak and Ay, the surface tension is 53 dyne/cm and the bleeding quantity is sufficiently small, but the blending quantity is large. On the other hand, in the case of the inks Bk and By, the surface tension is 33.6 dyne/cm and the blending quantity is sufficiently small, but the bleeding quantity is large. Hence, it was confirmed that the inks Ak and Ay are suited for recording the line drawings such as characters, and the inks Bk and By are suited for recording general images such as graphics.

This embodiment becomes more effective as the color difference between the hue of the ink and the hue of the recording medium becomes larger. Normally, the hue of the recording medium is white, and thus, this embodiment is most effective when the hue of the ink is black.

Next, a description will be given of a fourth embodiment of the ink jet recording apparatus according to the present invention. This fourth embodiment of the ink jet recording apparatus employs a fourth embodiment of the ink jet recording method according to the present invention, a fourth embodiment of the ink according to the present invention, and a fourth embodiment of the ink cartridge according to the present invention. The constructions of the ink jet recording apparatus and the ink cartridge may be the same as those shown in FIGS. 1 and 2, and thus, illustration and description related to the construction of the ink jet recording apparatus and the ink cartridge will be omitted for the fourth embodiment.

As described above, it is effective to use the ink having the high diffusibility and short fixing time so as to reduce the blending. However, the ink having the high diffusibility easily bleeds and is therefore not suited for recording the characters, tables and the like. On the other hand, although it is effective to use the ink having the low diffusibility in order to suppress the bleeding and carry out a high quality recording, the fixing time in this case becomes long, thereby increasing the blending.

Accordingly, it is effective from the point of view of reducing the blending and the bleeding to use inks having different diffusibilities depending on the kind of image to be recorded, but merely using inks having the different diffusibilities will result in a different recording tone for each ink used. For this reason, depending on the kind of image to be recorded and the hue of the ink used, it may be impossible to carry out the recording with a sufficiently high recording quality. The recording tone (OD) indicates the density for the case where the recording is made with a 100% printing rate. Hence, the recording tone indicates the optical reflection density in the case where the recording is made using the black ink, and indicates the status A density when the recording is made using the ink having a hue other than black.

In this embodiment, two kinds of inks having the same hue but different diffusibilities are used for at least one hue, the ink having the low diffusibility is used when recording an image in which the inks of different hues are not adjacent to each other on the recording medium,and the ink having the high diffusibility is used when recording an image in which the inks of different hues are adjacent to each other on the recording medium. Furthermore, the densities of the coloring materials (hereinafter referred to as coloring material density) of the two kinds of inks are set to mutually different values so that the recording tones on the recording medium for the two kinds of inks become approximately the same. The coloring material includes the dye, the pigment and the like.

The present inventors conducted experiments using black die for the dye of the ink and using as the recording medium the plain paper Xerox 4024DP manufactured by Xerox which is generally used. The following results were obtained from the experiments.

In a first experiment Ex1, an image was recorded on the recording medium with a printing rate of 100% using an ink I1 having a low diffusibility and an ink I2 having a high diffusibility, where the inks I1 and I2 use the black dyes having the same dye density. FIG. 34 shows the dye densities of the inks I1 and I2 and the measured recording tones on the recording medium. As may be seen from FIG. 34, a large difference is introduced between the recording tones if the inks I1 and I2 have the same dye density. In FIG. 34 and FIGS. 35 through 37 which will be described later, the dye density is indicated in weight percent (wt. %).

On the other hand, in a second experiment Ex2, an image was recorded on the recording medium with a printing rate of 100%, similarly to the first experiment Ex1, but using an ink I3 having a low diffusibility and an ink I4 having a high diffusibility, where the inks I3 and I4 use black dyes having mutually different dye densities. FIG. 35 shows the dye densities of the inks I3 and I4 and the measured recording tones on the recording medium. As may be seen from FIG. 35, the recording tones become approximately the same when the inks I3 and I4 have mutually different dye densities. More particularly, by setting the coloring material density of the ink I3 having the low diffusibility lower than the coloring material density of the ink I4 having the high diffusibility, it becomes possible to make the recording tones on the recording medium approximately the same for the two kinds of inks I3 and I4.

Therefore, according to this embodiment, it is possible to effectively and positively suppress the blending and the bleeding. Generally, the color ink jet recording apparatus is provided with inks of four colors, namely, yellow, magenta, cyan and black. However, since the hue of the recording medium is normally white, it is very rare for the characters, tables and the like to be recorded using the yellow ink. In addition, even if the characters, tables and the like were recorded on the recording medium using the yellow ink, the bleeding of the yellow ink would be inconspicuous. For these reasons, the effects of this embodiment become greater as the color difference or the contrast difference between the hue of the recording medium and the two kinds of ink having the same hue but mutually different diffusibilities becomes greater, and in addition, the effects are greatest when the hue of the ink is black and the hue of the recording medium is white.

The present inventors studied the recording tone with which a sufficiently high recording quality is obtainable, by making subjective evaluations and the like. It was found that the recording quality falls within a tolerable range if the recording tone is 0.9 or greater in the case where the recording medium is the plain paper, and that the recording quality falls within the tolerable range if the recording tone is 1.3 or greater in the case where the recording medium is the ink jet recording paper exclusively for use in the ink jet recording. Moreover, in the case of the image recording using the two kinds of inks having the same hue but different diffusibilities, it was found that the recording quality falls within the tolerable range if the difference between the recording tones for the two kinds of inks is approximately 0.3 or less, regardless of the kind of recording medium used.

Normally, when the difference between the recording tones is on the order of 0.3, this difference is detected as a large different by the human eyes. However, this embodiment selectively uses the two kinds of inks having the different diffusibilities depending on the kind of image that is to be recorded, and the present inventors found that the difference between the recording tones does not appear very large to the human eyes with respect to the image as a whole. For example, when the characters were recorded as line drawing and the graphic patterns having a 100% printing rate were recorded as the general image, it was found and confirmed by comparing the recording tones of the two on the recording medium that the recording quality falls sufficiently within the tolerable range even if the difference between the recording tones is 0.3. The recording tone on the recording medium using the ink used to record the line drawing in this case is the recording tone that is obtained when this ink is used to record the patterns having the 100% printing rate.

Next, a description will be given of a fifth embodiment of the ink jet recording apparatus according to the present invention. This fifth embodiment of the ink jet recording apparatus employs a fifth embodiment of the ink jet recording method according to the present invention, a fifth embodiment of the ink according to the present invention, and a fifth embodiment of the ink cartridge according to the present invention. The constructions of the ink jet recording apparatus and the ink cartridge may be the same as those shown in FIGS. 1 and 2, and thus, illustration and description related to the construction of the ink jet recording apparatus and the ink cartridge will be omitted for the fifth embodiment.

In this embodiment, two kinds of inks having the same hue but different diffusibilities are used for at least one hue, the ink having the low diffusibility is used when recording an image in which the inks of different hues are not adjacent to each other on the recording medium,and the ink having the high diffusibility is used when recording an image in which the inks of different hues are adjacent to each other on the recording medium. Furthermore, the recording using the ink having the lower recording tone on the recording medium,that is, the ink having the higher diffusibility in this case, is carried out a plurality of times in an overlapping manner.

The present inventors conducted experiments using black die for the dye of the ink and using as the recording medium the plain paper Xerox 4024DP manufactured by Xerox which is generally used. The following results were obtained from the experiments.

In a third experiment Ex3, an image was recorded on the recording medium with a printing rate of 100%, similarly to the second experiment Ex2, using an ink I3 having a low diffusibility and an ink I4 having a high diffusibility, where the inks I3 and I4 use the black dyes having mutually different dye densities. Furthermore, the recording using the ink I4 having the high diffusibility was carried out a plurality of times to make a so-called overlap recording. FIG. 36 shows the number of overlap recordings made using the ink I4 and the measured recording tone on the recording medium. As may be seen from FIG. 36, it was confirmed that the recording tone obtained by the overlap recordings using the ink I4 having the high dye density and the recording tone obtained by the recording using the ink I3 having the low diffusibility become approximately the same. More particularly, by carrying out the recording using the ink I4 having the high diffusibility a plurality of times and carrying out the recording using the ink I3 having the low diffusibility once, it is possible to make the recording tones on the recording medium approximately the same for the two kinds of inks I3 and I4.

Therefore, according to this embodiment, it is possible to effectively and positively suppress the blending and the bleeding. Generally, the color ink jet recording apparatus is provided with inks of four colors, namely, yellow, magenta, cyan and black. However, since the hue of the recording medium is normally white, it is very rare for the characters, tables and the like to be recorded using the yellow ink. In addition, even if the characters, tables and the like were recorded on the recording medium using the yellow ink, the bleeding of the yellow ink would be inconspicuous. For these reasons, the effects of this embodiment become greater as the color difference or the contrast difference between the hue of the recording medium and the two kinds of ink having the same hue but mutually different diffusibilities becomes greater, and in addition, the effects are greatest when the hue of the ink is black and the hue of the recording medium is white.

The present inventors studied the recording tone with which a sufficiently high recording quality is obtainable in this embodiment, by making subjective evaluations and the like. It was found that the recording quality falls within a tolerable range if the recording tone is 0.9 or greater in the case where the recording medium is the plain paper, and that the recording quality falls within the tolerable range if the recording tone is 1.3 or greater in the case where the recording medium is the ink jet recording paper exclusively for use in the ink jet recording since the demanded (or required) value for the exclusive ink jet recording paper is higher than that of the plain paper. Moreover, in the case of the image recording using the two kinds of inks having the same hue but different diffusibilities, it was found that the recording quality falls within the tolerable range if the difference between the recording tones for the two kinds of inks is approximately 0.3 or less, regardless of the kind of recording medium used.

Next, a description will be given of a modification of the fifth embodiment. In this embodiment, the two kinds of inks having the same hue but different diffusibilities are used for at least one hue, similarly to the fifth embodiment. In addition, the ink having the low diffusibility is used when recording an image in which the inks of different hues are not adjacent to each other on the recording medium,and the ink having the high diffusibility is used when recording an image in which the inks of different hues are adjacent to each other on the recording medium. Furthermore, the recording using the ink which results in the low recording tone on the recording medium,that is, the ink having the high diffusibility, is carried out a plurality of times in an overlapping manner. Moreover, similarly to the fourth embodiment, the coloring material densities of the two kinds of inks are set to mutually different values so that the recording tones on the recording medium using the two kinds of inks become approximately the same.

The present inventors conducted experiments using black die for the dye of the ink and using as the recording medium the plain paper Xerox 4024DP manufactured by Xerox which is generally used. The following results were obtained from the experiments.

In a fourth experiment Ex4, an image was recorded on the recording medium with a printing rate of 100%, similarly to the second experiment Ex2, using an ink I5 having a low diffusibility and an ink I6 having a high diffusibility, where the inks I5 and I6 use the black dyes having mutually different dye densities. Furthermore, the recording using the ink I6 having the high diffusibility was carried out a plurality of times to make the so-called overlap recording. FIG. 37 shows the number of overlap recordings made using the ink I6 and the measured recording tone on the recording medium. As may be seen from FIG. 37, it was confirmed that the recording tone obtained by the overlap recordings using the ink I6 having the high dye density and the recording tone obtained by the recording using the ink I5 having the low diffusibility become approximately the same. More particularly, by carrying out the recording using the ink I6 having the high diffusibility a plurality of times and carrying out the recording using the ink I5 having the low diffusibility once, it is possible to make the recording tones on the recording medium approximately the same for the two kinds of inks I5 and I6.

Therefore, according to this modification, it is possible to effectively and positively suppress the blending and the bleeding. Generally, the color ink jet recording apparatus is provided with inks of four colors, namely, yellow, magenta, cyan and black. However, since the hue of the recording medium is normally white, it is very rare for the characters, tables and the like to be recorded using the yellow ink. In addition, even if the characters, tables and the like were recorded on the recording medium using the yellow ink, the bleeding of the yellow ink would be inconspicuous. For these reasons, the effects of this modification become greater as the color difference or the contrast difference between the hue of the recording medium and the two kinds of ink having the same hue but mutually different diffusibilities becomes greater, and in addition, the effects are greatest when the hue of the ink is black and the hue of the recording medium is white.

The present inventors studied the recording tone with which a sufficiently high recording quality is obtainable in this modification, by making subjective evaluations and the like. It was found that the recording quality falls within a tolerable range if the recording tone is 0.9 or greater in the case where the recording medium is the plain paper, and that the recording quality falls within the tolerable range if the recording tone is 1.3 or greater in the case where the recording medium is the ink jet recording paper exclusively for use in the ink jet recording. Moreover, in the case of the image recording using the two kinds of inks having the same hue but different diffusibilities, it was found that the recording quality falls within the tolerable range if the difference between the recording tones for the two kinds of inks is approximately 0.3 or less, regardless of the kind of recording medium used.

Next, a description will be given of a sixth embodiment of the ink jet recording apparatus according to the present invention. This sixth embodiment of the ink jet recording apparatus employs a sixth embodiment of the ink jet recording method according to the present invention, a sixth embodiment of the ink according to the present invention, and a sixth embodiment of the ink cartridge according to the present invention. The constructions of the ink jet recording apparatus and the ink cartridge may be the same as those shown in FIGS. 1 and 2, and thus, illustration and description related to the construction of the ink jet recording apparatus and the ink cartridge will be omitted for the sixth embodiment.

In this embodiment, when carrying out the recording using inks of two or more kinds of different hues, the difference between the contact angle with respect to the recording medium of at least one kind of ink and that of another kind of ink is set to 15° or greater. In addition, the ink having the higher contact angle with respect to the recording medium is used to record the line drawings such as characters, and the ink having the lower contact angle is used to record the general images such as graphics. As will be described later, the contact angle of the ink having the high contact angle is preferably 85° or greater, while the contact angle of the ink having the low contact angle is preferably 70° or less.

Figure 38:
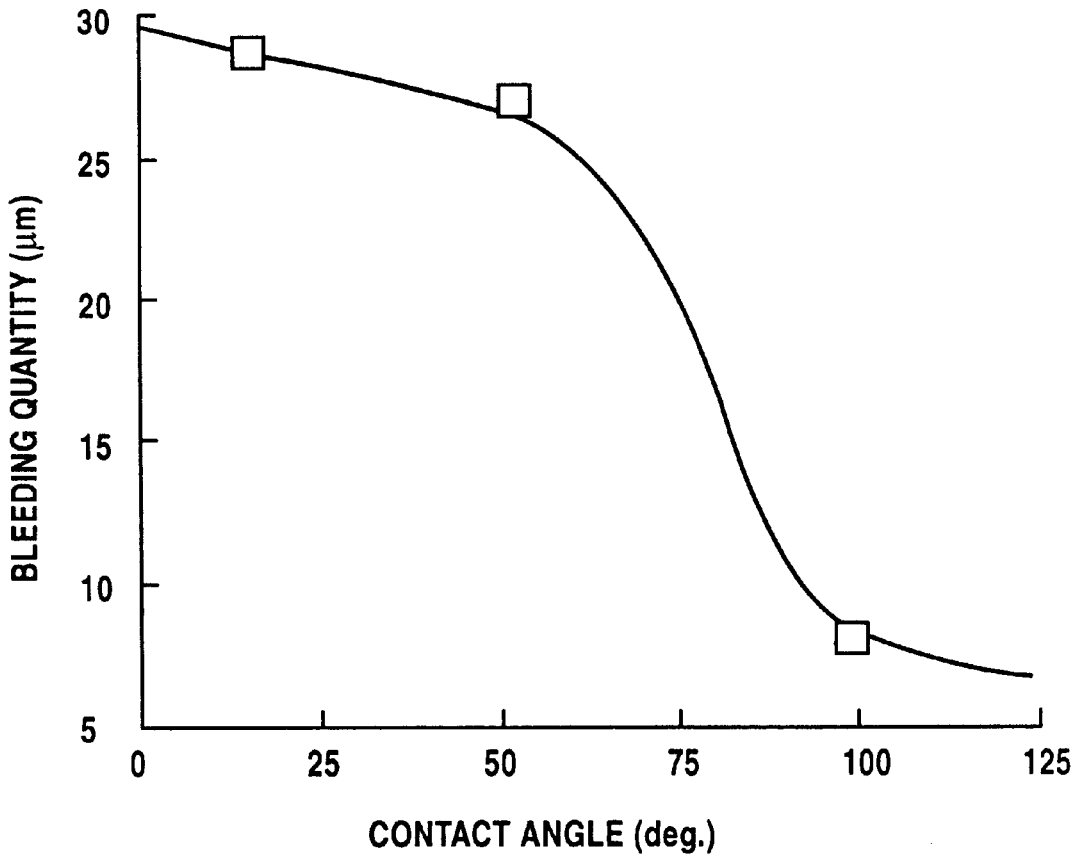
FIG. 38 is a diagram showing the relationship of an ink contact angle and the bleeding quantity.
Figure 39:
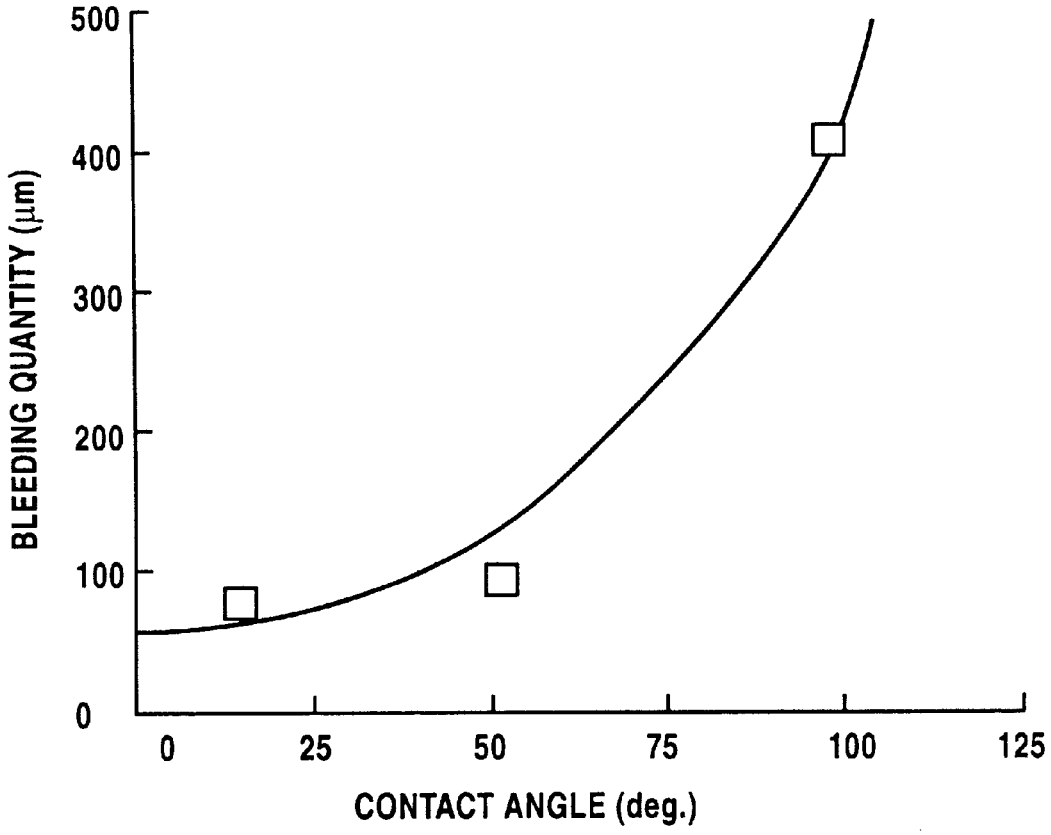
FIG. 39 is a diagram showing the relationship of the ink contact angle and the blending quantity.

FIG. 38 is a diagram showing the relationship between the ink contact angle and the bleeding quantity. FIG. 39 is a diagram showing the relationship between the ink contact angle and the blending quantity. It was found from FIG. 38 that the contact angle should be set to 85° or greater in order to make the bleeding quantity 15 $\mu$m or less. On the other hand, if was found from FIG. 39 that the contact angle should be 70° or less in order to make the blending quantity 200 $\mu$m or less.

The present inventors carried out recordings using black and yellow inks Ck and Cy which have the same contact angle within the above described range of the contact angle which is set to 85° or greater, and using black and yellow inks Dk and Dy which have the same contact angle within the above described range of the contact angle which is set to 70° or less. FIG. 40 shows evaluation results of the bleeding and the blending for such recordings made. For this evaluation, a line drawing having a width of 3 dots and a full image were recorded. In addition, the bleeding of the line drawing was detected for the black ink, and the blending in the full image was detected in the boundary region between the black and yellow inks. The recordings were made for the hues so that the color difference becomes a maximum. The contact angle of the inks in FIG. 40 were obtained with respect to the plain paper Xerox 4024DP manufactured by Xerox which was used as an example of the plain paper used for the recording medium. Since the ink diffusion occurs on the paper, the ink contact angle was measured immediately after, that is, approximately 0.1 second after the ink was adhered on the plain paper Xerox 4024DP. The measurement itself was made indirectly, that is, by picking up the image of the ink at the instant when the ink adheres on the paper and measuring the contact angle from the obtained still image. In FIG. 40, a symbol "○" indicates that the bleeding quantity is 15 μm or less or the blending quantity is 200 μm or less, while a symbol "x"indicates that the bleeding quantity is greater than 15 μm or the blending quantity is greater than 200 μm.

As may be seen from FIG. 40, in the case of the inks Ck and Cy, the contact angle is 102° and the bleeding quantity is sufficiently small, but the blending quantity is large. On the other hand, in the case of the inks Dk and Dy, the contact angle is 51° and the blending quantity is sufficiently small, but the bleeding quantity is large. Hence, it was confirmed that the inks Ck and Cy are suited for recording the line drawings such as characters, and the inks Dk and Dy are suited for recording general images such as graphics.

This embodiment becomes more effective as the color difference between the hue of the ink and the hue of the recording medium becomes larger. Normally, the hue of the recording medium is white, and thus, this embodiment is most effective when the hue of the ink is black.

For comparison purposes, the present inventors measured the contact angles with respect to the PTFE for the inks Ck, Cy, Dk and Dy described above. FIG. 41 shows the measured results obtained in this case. From FIG. 41, it was found that the contact angles of the inks Dk and Dy are outside the range of the contact angle prescribed in the Japanese Laid-Open Patent Application No.6-143795. In addition, compared to FIG. 40, the contact angles of the inks Ck and Cy shown in FIG. 41 are virtually unchanged from those shown in FIG. 40, but the contact angles of the inks Dk and Dy shown in FIG. 41 are greatly changed from those shown in FIG. 40. In other words, it was found that the contact angle of the ink with respect to the recording medium more greatly affects the recording quality than the contact angle of the ink with respect to the particular material, that is, the PTFE.

Accordingly, it was found that the diffusibility of the ink cannot be prescribed sufficiently by the contact angle with respect to the PTFE which is unrelated to the recording medium and the surface tension of the ink as proposed in the Japanese Laid-Open Patent Application No.6-143795.

Furthermore, according to the method proposed in the Japanese Laid-Open Patent Application No.6-143795, the diffusibilities of the inks are different. For this reason, even if mainly the character portion recorded using the ink having the low diffusibility and mainly the image portion recorded using the ink having the high diffusibility have the same hue, differences will be introduced in the recording tones, the color saturations, contrasts and the like between the two recordings, thereby causing deterioration of the recording quality. Hence, a description will next be given of an embodiment which can eliminate this inconvenience.

Next, a description will be given of a seventh embodiment of the ink jet recording apparatus according to the present invention. This seventh embodiment of the ink jet recording apparatus employs a seventh embodiment of the ink jet recording method according to the present invention, a seventh embodiment of the ink according to the present invention, and a seventh embodiment of the ink cartridge according to the present invention. The constructions of the ink jet recording apparatus and the ink cartridge may be the same as those shown in FIGS. 1 and 2, and thus, illustration and description related to the construction of the ink jet recording apparatus and the ink cartridge will be omitted for the seventh embodiment.

Various studies have been made on the diffusibility of the ink and the absorptivity of the recording medium based on the Lucas-Washburn formulas, and the diffusibility and the absorptivity are about to be made clear as evidenced for example by "New Science of Paper" by Takuya Kadoya, issued by Chugai Sangyo Chosakai, pp.345–370, Jun. 12, 1994. The Bristow test is a method of testing the diffusibility or absorptivity based on the theory proposed by Takuya Kadoya. An absorption coefficient Ka ($ml/(m^2 \cdot ms^{1/2})$) which is obtained by the Bristow test uniquely describes the absorptivity of the recording medium with respect to the ink.

Accordingly, when the recording is made by the recording medium having a small absorption coefficient Ka with respect to the ink or, by the ink having a small diffusion coefficient Ka with respect to the recording medium, the diffusion of the ink into the recording medium is suppressed, thereby making it possible to carry out a high quality recording free of bleeding.

On the other hand, when the recording is made by the recording medium having a large absorption coefficient Ka with respect to the ink, the diffusion of the ink into the recording medium is accelerated, and the existence time of the ink on the recording medium is shortened. As a result, it is possible to carry out a high quality recording free of blending.

The absorption coefficient Ka of the recording medium and the diffusion coefficient Ka of the ink will both be simply referred to as the coefficient Ka in the following description for the sake of convenience.

Two ink groups having different coefficients Ka with respect to the recording medium are used, and mainly the general images having a plurality of hues adjacent to each other are recorded using the inks belonging to the ink group having the large coefficient Ka, while mainly the line drawings such as characters having no hues adjacent to each other are recorded using the inks belonging to the ink group having the small coefficient Ka. Hence, it is possible to simultaneously realize the high quality recording of the general images free of blending at the color boundary portion, and the high quality recording of the sharp line drawings such as characters free of bleeding.

Furthermore, at least 1 pixel (dot) which forms the color boundary portion is recorded using the ink belonging to the ink group having the large coefficient Ka, while other pixels (dots) are recorded using the ink of the same hue but belonging to the ink group having the small coefficient Ka. By taking these measures, it is possible to simultaneously realize the high quality recording of the general image having no blending at the color boundary portion and the high quality recording of the line drawings such as characters which are sharp and free of bleeding. In addition, the quality of the recording is also high from the point of view that there are no unevenness in the recording tones, and no differences in the color saturations, contrasts and the like on the recording medium.

The present inventors have conducted experiments for black inks K'1 through K'5 used for the monochrome recording, so as to check the coefficient Ka and the extent of the bleeding with respect to various kinds of recording mediums. The results shown in FIG. 42 were obtained by such experiments. The inks K'1 through K'5 respectively have compositions including 2 weight % of acid dye and 5 weight % of diethylene glycol as the base, 0 to 20.0 weight % of ethanol additive, and the remainder water. The ethanol contents of the inks K'1, K'2, K'3, K'4 and K'5 respectively are 0, 5.0 weight %, 10.0 weight %, 15.0 weight % and 20.0 weight %. The unit of the coefficient Ka is normally (ml/($m^2 \cdot ms^{1/2}$)), but in FIG. 42 and FIGS. 43 and 44 which will be described later, the coefficient Ka is described in the unit of (nl/($mm^2 \cdot s^{1/2}$)) for the sake of convenience.

The results shown in FIG. 43 were obtained when the coefficient Ka and the extent of the blending were checked for various kinds of recording mediums by conducting experiments with respect to black, yellow, magenta and cyan inks K6, Y6, M6 and C6 through K9, Y9, M9 and C9 which are used for the color recording. The inks K6, Y6, M6 and C6 through K9, Y9, M9 and C9 respectively have compositions including 4 weight % of direct dye and 5 weight % of glycerol as the base, 0 to 2.0 weight % of first nonionic surface-active agent as the additive, and the remainder water. The first nonionic surface-active agent contents of the inks K6, Y6, M6 and C6, the inks K7, Y7, M7 and C7, the inks K8, Y8, M8 and C8, and the inks K9, Y9, M9 and C9 respectively are 0, 0.5 weight %, 100 weight %, and 2.0 weight %.

These inks K'l through K'5, and K6, Y6, M6 and C6 through K9, Y9, M9 and C9 having such compositions were obtained by measuring the amount of ink in a sealed polyethylene container for each kind of ink, stirring and melting the ink at 50° C. for 3 hours, cooling the ink to room temperature, and filtering the ink using a filter having a pore size of 0.2 $\mu$m. In FIG. 42 and 43, the coefficient Ka of each ink was obtained by carrying out the Bristow test using three kinds of woodfree (first-grade) copier papers as the recording medium. In addition, the extent of the bleeding and the blending were obtained by making recordings on the three kinds of woodfree copier papers with a resolution of 360 dpi.

In FIG. 42, the extent of the bleeding is evaluated in 3 levels. In FIG. 42, a symbol "○" indicates a state where virtually no bleeding is visible and sharp edges are realized, a symbol "Δ" indicates a state where slight bleeding is visible and the edges are slightly zigzag, and a symbol "x" indicates a state where large bleeding is visible and the considerable unevenness of the edges is visible. The results shown in FIG. 42 were obtained by setting the ink jet quantity onto each woodfree copier paper to approximately 120 to 40 pl which can obtain a recording size of approximately 100 $\mu$m in diameter when converted into a perfect or ideal circular dot.

From FIG. 42, it was confirmed that the evaluation of the extent of the bleeding becomes "Δ" for the ink and recording medium combination with the coefficient Ka of less than 15, and becomes "o" for the ink and recording medium combination with the coefficient Ka of less than 10.

On the other hand, in FIG. 43, the extent of the blending is evaluated in 3 levels. In FIG. 32, a symbol "○" indicates a state where virtually no blending is visible and the color boundary portion is relatively clear, a symbol "Δ" indicates a state where slight blending is visible and slight color mixture is visible at the color boundary portion, and a symbol "x" indicates a state where a large blending is visible and the color boundary portion cannot be recognized. The results shown in FIG. 43 were obtained by setting the ink jet quantity onto each woodfree copier paper to approximately 120 to 50 pl.

From FIG. 43, it was confirmed that the evaluation of the extent of the blending becomes "Δ" for the ink and recording medium combination with the coefficient Ka of 50 or greater, and becomes "○" for the ink and recording medium combination with the coefficient Ka of 89 or greater.

FIG. 44 shows the results of experiments conducted similarly to the case shown in FIG. 43, with respect to inks K10, Y10, M10 and C10 through K15, Y15, M15 and C15. Instead of being added with the first nonionic surface-active agent, the inks K10, Y10, M10 and C10 are added with 2 weight % of a second nonionic surface-active agent, the inks K11, Y11, M11 and C11 are added with 2 weight % of a third nonionic surface-active agent, and the inks K12, Y12, M12 and C12 are added with 2 weight % of a fourth nonionic surface-active agent. Instead of being added with the first nonionic surface-active agent, the inks K13, Y13, M13 and C13 are added with 1 weight % of a fifth nonionic surface-active agent. Instead of being added with the first nonionic surface-active agent, the inks K14, Y14, M14 and C14 are added with 15 weight % of ethanol. Further, instead of being added with the first nonionic surface-active agent, the inks K15, Y15, M15 and C15 are added with 20 weight % of ethanol. The ink jet quantity onto each woodfree copier paper was set to approximately 80 to 45 pl, and the blending was evaluated similarly to the case shown in FIG. 43.

From FIG. 44, it was confirmed that the evaluation of the extent of the blending becomes "Δ" for the ink and recording medium combination with the coefficient Ka of 40 or greater, and becomes "○" for the ink and recording medium combination with the coefficient Ka of 83 or greater.

In this embodiment, the recording was made using five kinds of ink, namely, the ink K'2 shown in FIG. 42 and the inks K9, Y9, M9 and C9 shown in FIG. 43. The black regions having no boundary with other hues such as yellow, magenta and cyan were recorded using the ink K'2, while the other regions were recorded using the inks K9, Y9, M9, and C9. Hence, no bleeding was visible in the line drawings recorded using the ink K'2, and a high quality recording was possible with a high recording tone. At the same time, no blending was visible at the color boundary portion within the general image recorded using the inks K9, Y9, M9 and C9, and a high quality color recording was possible.

However, because the inks having different characteristics are used, the black region recorded using the ink K'2 appears to have a recording tone different from that of the black region recorded using the ink K9, and a new problem was generated in that the recording quality is slightly deteriorated thereby. Hence, in this embodiment, it is desirable that the black region of the boundary portion is recorded for a predetermined recording width (for example, 2 dots) using the ink K9, and the other black regions are recorded using the ink K'2. In this case, the difference between the recording tones of the black regions becomes virtually inconspicuous, and the deterioration of the recording quality was prevented.

As described above, it is desirable to apply this embodiment to the black ink which often records the line drawings such as characters with respect to which there are strong demands to realize a bleed-free high quality recording, and to the yellow, magenta and cyan inks which are the basic colors used for the color recording. On the other hand, it is desirable that the recording medium is of a kind generally used, and has the paper fibers exposed at the recording surface, such as the so-called plain paper including copier paper.

On the other hand, when recording line drawings and general images on the recording medium with a desired resolution by the ink jet recording apparatus, it is necessary to adjust the amount of ink that is ejected from the head, that is, the ink jet quantity, so that the obtained dot size is suited for the predetermined resolution. The spreading of the dot on the recording medium is smaller for the ink having the low diffusibility than the ink having the high diffusibility, and the amount of ink recorded on the recording medium is larger for the ink having the low diffusibility as compared to the ink having the high diffusibility. This tendency is notable in the case of copier paper which is subjected to a sizing process or the like which suppresses diffusion of the ink into the recording medium,and plain paper such as bond paper and post card. On the other hand, in the case of ink jet recording paper such as the coated paper exclusively for use in the ink jet recording, overhead projector (OHP) film and glossy paper, the ink acceptor layer is provided on the base paper/film so that the ink absorption is uniform and/or fast. Hence, the effects of the diffusibility of the ink on the ink absorptivity (or permeability) of the recording medium is relatively small in the case of the ink jet recording paper. For example, the ink acceptor layer is made of hydrophilic and water absorbent polymers and resins such as polyvinyl alcohol and cationic resins, pigment, binder and the like.

Therefore, the behaviors of the inks having different diffusibilities on the recording medium greatly differ, and it was difficult to design a recording medium which guarantees a sufficiently high performance with respect to each of the various inks. Hence, a proposal has been made to adjust the ink jet quantity depending on the kind or behavior of the recording medium that is used.

A method which adjusts the ink jet quantity depending on the kind of recording medium is effective, but it also introduces drawbacks. In other words, it is necessary to control the head driving condition depending on the ink jet quantity, thereby making the control of the head driving system complex. As a result, the construction of the head driving system becomes complex and the head driving system becomes expensive. In addition, depending on the head driving condition, it may be impossible to appropriately adjust the ink jet quantity.

As a method of adjusting the ink jet quantity, been a proposal to adjust the dot diameter by recording the ink at the same position on the recording medium a plurality of times in an overlapping manner. For example, a Japanese Laid-Open Patent Application No.6-344652 proposes a method which applies this method to a case where inks having different diffusibilities are used. More particularly, when using the ink which has a high diffusibility and is used for color recording to make a recording on a recording medium which is exclusively adjusted for the monochrome recording using the ink having a low diffusibility, the recording using the ink having the high diffusibility is made a plurality of times in an overlapping manner, and the dot diameter is adjusted to a diameter which is approximately the same as that of an ink dot formed by the ink having the low diffusibility.

However, the ink having the low diffusibility can realize a high quality recording even when the recording medium used is the plain paper, and there is no need to use a recording medium adjusted exclusively therefor. On the other hand, although no blending occurs in the case of the ink having the high diffusibility even when the recording medium used is the plain paper, the peripheral portion of the line segments become blurred when the line drawings such as characters are recorded, ad it is impossible to record images having clear contours. For this reason, in order to realize the color image recording with respect to which there are demands for satisfactory color development, color reproducibility and sharpness, it is desirable to realize an optimized recording medium exclusively for use with the ink having the high diffusibility.

As described above, there is not much demand or need for a recording medium which is adjusted exclusively for use with the ink having the low diffusibility. On the other hand, even if the dot diameter is adjusted by carrying out the recording a plurality of times in the overlapping manner using the ink having the high diffusibility, the resulting recording quality including the color saturation, hue and color reproducibility is generally lower than the recording quality which can be obtained when the recording is normally made by the ink having the high diffusibility with respect to the recording medium which is adjusted exclusively for use with the ink having the high diffusibility. Furthermore, when the recording is made using the ink having the low diffusibility with respect to the recording medium which is adjusted exclusively for use with the ink having the high diffusibility, it is necessary to reduce the ink jet quantity, and the overlap recording cannot be made.

Accordingly, the recording medium characteristic including the spreading of the ink on the recording medium is normally adjusted with respect to the ink having the high diffusibility because of the demand to realize clear and beautiful color image recording. For this reason, when the recording is made on the recording medium which is adjusted exclusively for use with the ink having the high diffusibility using the ink having the low diffusibility in the same manner with which the recording is made with respect to the plain paper, a large amount of ink will be adhered on the recording medium at one time. As a result, the amount of ink on the recording medium exceeds the ink absorption capacity of the ink acceptor layer, and there is a high possibility that the characters will be deformed and that the ink will solidify in the ink acceptor layer, thereby causing unevenness in the recording tone. Furthermore, since the amount of ink which adheres on the recording medium is large, the time required for the ink to dry and fix becomes long, and when the practical recording speed of the ink jet recording apparatus is taken into consideration, it may be difficult to secure the necessary dry and fixing time for the ink. The inconveniences such as unevenness of the recording tone when the full recording having a high recording density is made and the long fixing time become notable particularly in the case of the OHP film which includes a base made up of transparent plastic film or the like which absorbs no ink because of the high light transmittance required, and a precise and uniform ink acceptor layer.

Next, a description will be given of an eighth embodiment of the ink jet recording apparatus according to the present invention which can positively prevent the above described inconveniences even when the recording medium used is the OHP film or the like. This eighth embodiment of the ink jet recording apparatus may use the ink cartridge shown in FIG. 2, and employs an eighth embodiment of the ink jet recording method according to the present invention. The construction of the ink jet recording apparatus in this eighth embodiment may be the same as that shown in FIG. 1, and a description and illustration thereof will be omitted.

This embodiment reduces the amount of ink adhered on the recording medium during 1 scan of the head when the recording is made with respect to a recording medium exclusively for the ink jet recording such as the OHP film using the ink having the low diffusibility, so as to prevent a large amount of ink from being adhered on the recording medium at one time. More particularly, an average amount of recording ink per unit area during 1 scan of the head is set approximately the same as a predetermined amount of ink that is adhered on the recording medium during 1 scan of the head when making the recording on the recording medium using the ink having the high diffusibility. In other words, when carrying out the recording on the recording medium using the ink having the low diffusibility, the amount of ink adhered on the recording medium during 1 scan of the head i set less than or equal to the ink absorption capacity of the recording medium. In addition, by repeating such scan of the head a plurality of times when making the recording using the ink having the low diffusibility, it is possible to make the amount of ink which has the low diffusibility and is adhered on the recording medium per unit area approximately the same as the predetermined amount of ink described above. This embodiment also utilizes the evaporation of the solvent in the ink, and takes measures so that the amount of ink adhered on the recording medium during 1 scan of the head does not exceed the ink absorption capacity of the recording medium. As a result, it is possible to reduce the unevenness of the recording tone, and positively secure the time which is required for the ink to dry and fix.

For example, in this embodiment, the black, yellow, magenta and cyan inks stored within the ink cartridges 11-1 through 11-4 have a composition including 3 weight percent (%) of direct dye of each color, 10 weight % of diethylene glycol, 1.5 weight % of nonionic surface-active agent and the remainder water. In addition, the black ink stored within the ink cartridge 11-5 has a composition including 2 weight % of acid black dye, 5 weight % of diethylene glycol, 5 weight % of ethanol and the remainder water, for example. These inks having such compositions were obtained by measuring the amount of ink in a sealed polyethylene container for each kind of ink, stirring and melting the ink at 50° C. for 3 hours, cooling the ink to room temperature, and filtering the ink using a filter having a pore size of 0.2 μm. When the diffusibilities of each of the inks are described by the absorption coefficient Ka of the Bristow test (J. TAPPI paper pulp test method No.51) with respect to the Xerox 4024DP copier paper, the diffusibility of the black ink within the ink cartridge 11-5 having the low diffusibility was approximately 9 nl/($mm^2 \cdot s^{1/2}$), and the diffusibilities of the black, yellow, magenta and cyan inks within the ink cartridges 11-1 through 11-4 respectively were approximately 110 to 150 nl/($mm^2 \sqrt{s^{1/2}}$)

Figure 45:
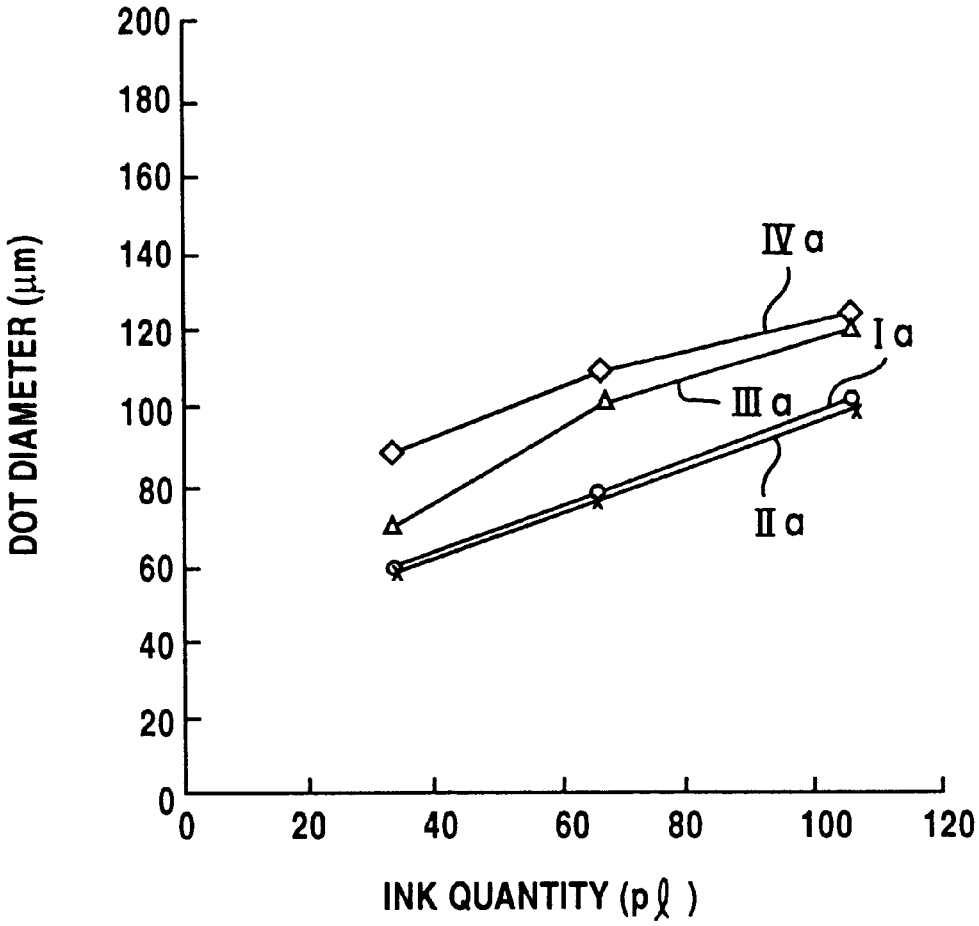
FIG. 45 is a diagram showing the relationship of an amount of ink adhered on the recording medium and a dot diameter for a case where the recording is made on the recording medium using the black ink having the low diffusibility.

FIG. 45 is a diagram showing the relationship between the amount of ink adhered on the recording medium and the dot diameter when the recording is made on the recording medium using the black ink which has the low diffusibility and is stored within the ink cartridge 11-5. In FIG. 45, the ordinate indicates the dot diameter, and the abscissa indicates the ink quantity. In addition, characteristics Ia, IIa, IIIa and IVa respectively indicate the characteristics for the cases where the recording medium is a first copier paper, a second copier paper, a third copier paper and an OHP film. The dot diameter was obtained by measuring the areas of 50 dots recorded on the recording medium and taking an average value of the diameters of the dots by assuming each dot to have a perfect or ideal circular shape.

Figure 46:
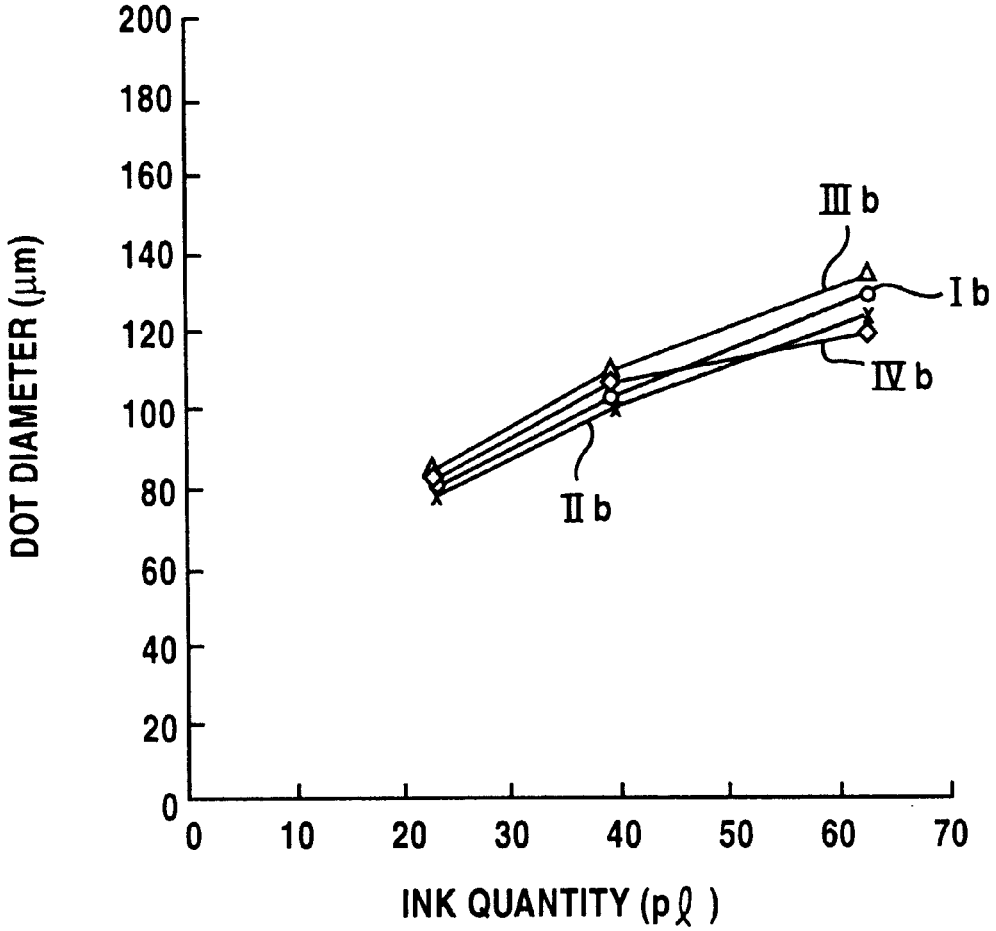
FIG. 46 is a diagram showing the relationship of the amount of ink adhered on the recording medium and the dot diameter for a case where the recording is made on the recording medium using the black ink having the high diffusibility.

On the other hand, FIG. 46 is a diagram showing the relationship between the amount of ink adhered on the recording medium and the dot diameter when the recording is made on the recording medium using the black ink which has the high diffusibility and is stored within the ink cartridge 11-1. 46, the ordinate indicates the dot diameter, and the abscissa indicates the ink quantity. In addition, characteristics Ib, IIb, IIIB and IVb respectively indicate the characteristics for the cases where the recording medium is the first copier paper, the second copier paper, the third copier paper and the OHP film. The dot diameter was obtained by measuring the areas of 50 dots recorded on the recording medium and taking an average value of the diameters of the dots by assuming each dot to have a perfect or ideal circular shape. The relationship between the amount of ink adhered on the recording medium and the dot diameter became similar to that shown in FIG. 46 for each of the cases where the recordings were made on the recording medium using the yellow, magenta and cyan inks which respectively have the high diffusibility and are stored in the ink cartridges 11-2 through 11-4, and an illustration thereof will be omitted.

When it was assumed that a predetermined dot diameter suited for carrying out the recording with a resolution of 360 dpi using the inks described above is approximately 110±10 μm which is slightly larger than 100 μm=√2·25.4 mm/360 which connects obliquely adjacent dots to form an oblique line, it was found that the ink quantity required to form the predetermined dot diameter on the plain paper such as the first through third copier papers is approximately 100 pl for the ink having the low diffusibility and approximately 50 pl for the ink having the high diffusibility. On the other hand, when dots were recorded on the ink jet recording paper such as the OHP film using the above described ink quantities and the diameters of the dots were measured, the dot diameter of the ink having the low diffusibility became slightly larger than the predetermined dot diameter, but the dot diameter of the ink having the high diffusibility became the predetermined dot diameter, that is, the optimum value.

The present inventors made recordings on the plain paper using these inks under the above described conditions, and it was confirmed that a bleed-free high quality monochrome (black-and-white) recording is possible and that a blend-free high quality color recording is possible.

In addition, the present inventors made recordings on the OHP film using these inks under the above described conditions. It was confirmed that a high quality color recording is possible. But in the case of the monochrome recording, it was confirmed that the unevenness of the recording tone caused by the solidification of the ink becomes notable particularly in the full recording portion where the recording density is high.

Accordingly, the present inventors applied this embodiment to the recording of various patterns on the OHP film such that the full recording with a resolution of 360 dpi is made by the head portion having 48 nozzles using the black ink having the low diffusibility and making the head portion scan 2 times. The recorded results obtained were then compared with a comparison example Ce1 which was obtained by making the full recording in 1 scan of the head portion using 48 dots per line. The scan time 1 scan of the head portion was set to approximately 1 second.

In the comparison example Ce1, it was found that the unevenness is generated in the recording tone due to the solidification of the ink and that the recording quality becomes poor.

Figure 47:
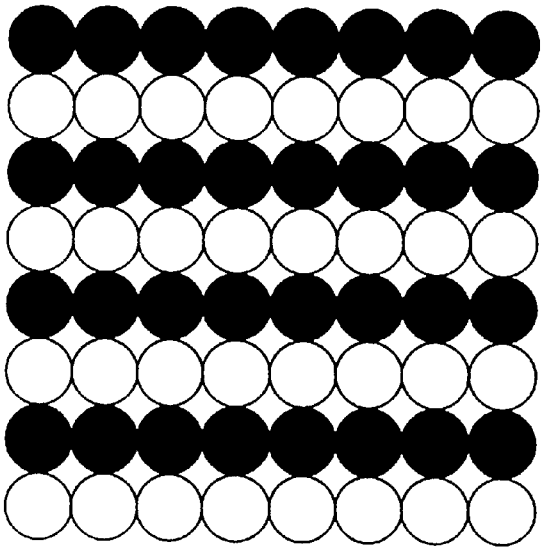
FIG. 47 is a diagram showing a line pattern.
Figure 48:
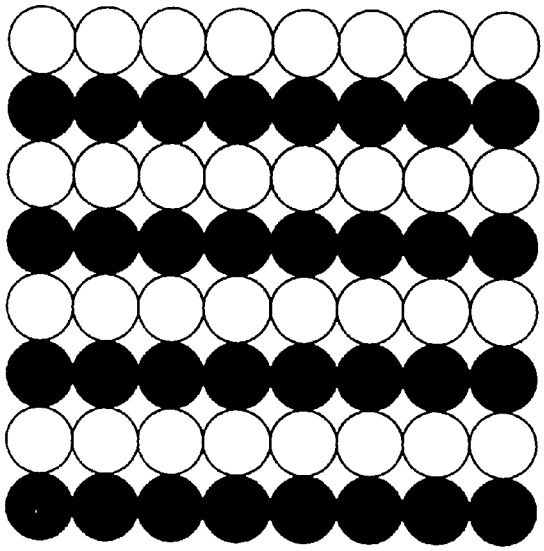
FIG. 48 is a diagram showing an inverted pattern of the line pattern.

On the other hand, in the case of an experiment ex1 in which an intermittent line pattern shown in FIG. 47 and an intermittent line pattern shown in FIG. 48 are recorded in an overlapping manner by the 2 scans of the head portion, it was possible to greatly reduce the unevenness of the recording tone caused by the solidification of the ink when compared to the comparison example Ce1, and considerable improvement in the recording quality was confirmed. The intermittent line pattern shown in FIG. 47 has horizontal lines occurring at every other line, while the intermittent line pattern shown in FIG. 48 is an inverted pattern of the intermittent line pattern shown in FIG. 47.

Figure 49:
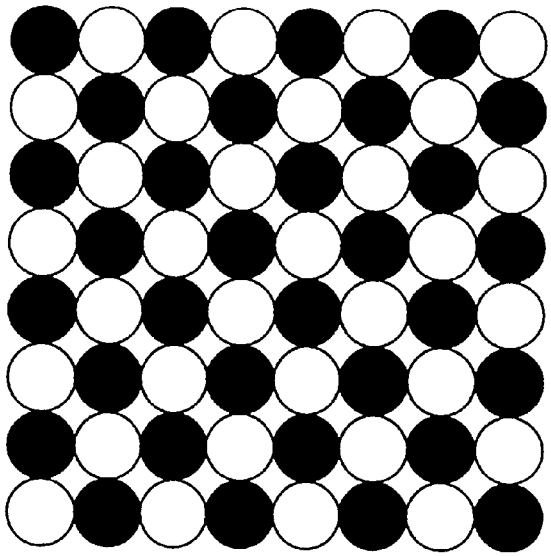
FIG. 49 is a diagram showing a checker-board pattern.
Figure 50:
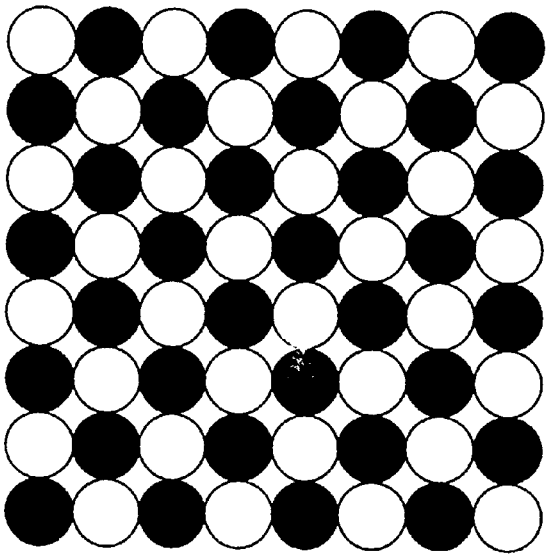
FIG. 50 is a diagram showing an inverted pattern of the checker-board pattern.

Similarly, in the case of an experiment ex2 in which a checker-board pattern shown in FIG. 49 and a checker-board pattern shown in FIG. 50 are recorded in an overlapping manner by the 2 scans of the head portion, it was possible to greatly reduce the unevenness of the recording tone caused by the solidification of the ink when compared to the comparison example Ce1, and considerable improvement in the recording quality was confirmed. The checker-board pattern shown in FIG. 50 is an inverted pattern of the checker-board pattern shown in FIG. 49.

In a comparison example Ce2, a wait time after 1 scan of the head portion until the next scan starts was set to approximately 1 second, and the full recording was made using 48 dots per line, so that the recording time as a whole becomes equivalent to that of the experiments ex1 and ex2 which carry out the overlap recording by 2 scans of the head portion. However, the results obtained by the comparison example Ce2 were similar to those obtained by the comparison example Ce1. In other words, the unevenness was generated in the recording tone due to the solidification of the ink, and the recording quality was poor in the comparison example Ce2.

The present inventors also confirmed recorded results for cases where the above experiments ex1 and ex2 are combined.

In an experiment ex3, overlap recording of the intermittent line pattern shown in FIG. 47 and the checker-board pattern shown in FIG. 49 were made in 2 successive scans of the head portion, and overlap recording of the inverted intermittent line pattern shown in FIG. 48 and the inverted checker-board pattern shown in FIG. 50 were made in the next successive 2 scans of the head portion. According to this experiment ex3, the unevenness in the recording tone caused by the solidification of the ink was greatly reduced compared to the comparison example Ce1, and it was confirmed that the recording quality is greatly improved.

Similarly, in an experiment ex4, overlap recording of the checker-board pattern shown in FIG. 49 and the inverted checker-board pattern shown in FIG. 50 were made in 2 successive scans of the head portion, and overlap recording of the intermittent line pattern shown in FIG. 47 and the inverted intermittent line pattern shown in FIG. 48 were made in the next successive 2 scans of the head portion. According to this experiment ex4, the unevenness in the recording tone caused by the solidification of the ink was greatly reduced compared to the comparison example Ce1 and further reduced when compared to the experiment ex3 because the overlap recording records the patterns having non-adjacent dots with priority, and it was confirmed that the recording quality is greatly improved and further improved when compared to the experiment ex3.

In addition, a head portion having 48 nozzles was used, and a total of 12 scans were made for each group made up of 4 nozzles, so as to carry out a full recording on the OHP film corresponding to the normal 1 scan of the head portion. From the recorded result, it was confirmed that the unevenness of the recording tone is greatly reduced and that the recording quality is improved. Therefore, it was confirmed that by reducing the number of dots recorded in 1 scan and increasing the number of scans, it is possible to effectively reduce the unevenness of the recording tone and a sufficient drying and fixing time can be secured.

For example, when recording the image by a method similar to that used in the experiment ex4 described above, the head portion is controlled based on an AND (logical product) of the image data input to the ink jet recording apparatus from the host unit or the like during the first scan of the head portion and the image data related to the checker-board pattern shown in FIG. 49. During the second scan of the head portion, the head portion is controlled based on the AND of the image data from the host unit and the image data related to the inverted checker-board pattern shown in FIG. 50. During the third scan of the head portion, the head portion is controlled based on the image data from the host unit and the image data related to the intermittent line pattern shown in FIG. 47. In addition, during the fourth scan of the head portion, the head portion is controlled based on the image data from the host unit and the image pattern related to the inverted intermittent line pattern shown in FIG. 48.

On the other hand, when recording the image by a method similar to that used in the experiment ex4 described above, it is also possible to input the input image data corresponding to the AND of the image data and the image data related to the checker-board pattern shown in FIG. 49 directly from the host unit or the like to the ink jet recording apparatus during the first scan of the head portion. In this case, during the second scan of the head portion, the input image data corresponding to the AND of the image data and the image data related to the inverted checker-board pattern shown in FIG. 50 is directly input from the host unit to the ink jet recording apparatus. Similarly, during third scan of the head portion, the input image data corresponding to the AND of the image data and the image data related to the intermittent line pattern shown in FIG. 47 is directly input from the host unit to the ink jet recording apparatus, and during the fourth scan of the head portion, the input image data corresponding to the AND of the image data and the image data related to the inverted intermittent line pattern shown in FIG. 48 is directly input from the host unit to the ink jet recording apparatus.

Therefore, in this embodiment, when carrying out the recording on the recording medium which has the recording characteristic adjusted with respect to the ink having the high diffusibility using the ink having the low diffusibility, the amount of ink recorded per unit area during 1 scan of the head portion using the ink having the low diffusibility is set less than or equal to the amount of ink recorded during 1 scan using the ink having the high diffusibility. In addition, when carrying out successive recordings using the ink having the low diffusibility by making the head portion scan a plurality of times, a plurality of complementary thinned patterns are recorded in the case of the full recording, and the logical product (AND) of the complementary thinned patterns and the image data is recorded when recording the image data. In this case, the complementary thinned patterns are not limited to the intermittent line patterns and the checker-board patterns described above, and it is possible to use a pair of symmetrical thinned patterns, for example. It is also possible to successively carry out the recording using a plurality of pairs of symmetrical thinned patterns. In this case, it is desirable to successively carry out the recording in an overlap with a sequence giving priority to those patterns having non-adjacent dots. If a maximum recording width of the head portion which has a plurality of nozzles for ejecting the ink having the low diffusibility taken along a direction perpendicular to the scan direction in 1 scan of the head portion is denoted by D dots, it is possible to decompose the image data having the width of D dots into N image data having a width less than D dots and to successively record the decomposed image data on the recording medium in N scans of the head portion.

This embodiment is particularly suited for the case where the OHP film is used as the recording medium. However, the OHP film used may have a two-layer structure. The two-layer OHP film has different characteristics at the front and back sides thereof. In other words, a first OHP film which is designed with respect to the ink having the high diffusibility and a second OHP film which is designed with respect to the ink having the low diffusibility are bonded, so that the front side is suited for the high quality color image recording and the back side is suited for the monochrome image recording having no unevenness in the recording tone. The present inventors carried out recordings similar to those described above with respect to such a two-layer OHP film having the two-layer structure. For example, the thickness of the ink acceptor layer of the second OHP film was set to approximately 1.5 times that of the first OHP film, and it was confirmed that the high quality color image recording can be made on the front side of the first OHP film,while the monochrome image recording having no unevenness in the recording tone can be made on the back side of the second OHP film.

Various kinds of polymers given various water-solubility characteristics and/or water-absorption characteristics may be used for the OHP film that is employed in this embodiment. Further, in order to adjust the characteristics, appropriate amounts of insoluble polymers and inorganic pigments such as clay, talc, alumina and silica may be added to the OHP film. However, the transparency of the OHP film should not be deteriorated by the addition of such additives. Polyvinyl alcohol, gelatin, albumin, casein, cationic starch, gum arabic, polyamide, polyvinyl pyrrolidone, water-soluble cellulose and the like may be used as the polymer.

The ink acceptor layer provided on the recording medium such as the OHP film may be formed in advance or may be formed at the time of the recording. The method of carrying out the recording while forming the ink acceptor layer on the recording medium is known, and it is possible to employ any of the methods proposed in Japanese Laid-Open Patent Applications No.63-299939, No.5-96720, No.6-23973 and No.6-92010, for example.

On the other hand, the diameter of the nozzle of the head is on the order of 30 $\mu$m to 100 $\mu$m and very small. Hence, a solvent which is non-volatile and hygroscopic is added to the ink so that the ink will not evaporate and dry up at the tip end of the nozzle (nozzle orifice) to block the nozzle orifice. However, although it is possible to prevent blocking of the nozzle orifice caused by the deposition of the dye within the nozzle orifice, the increase of the ink viscosity caused by the evaporation of the solvent cannot be avoided. As the ink viscosity increases, the ink injecting direction becomes unstable, and an error is generated in the position of the dot recorded on the recording medium. In extreme cases, it no longer becomes possible to inject the ink because of the increased ink viscosity, and the dot to be recorded on the recording medium becomes omitted or drops out. In order to prevent these inconveniences, a backup unit 46 shown in FIG. 1 is provided to spray the ink having the increasing viscosity from the nozzle into the backup unit 46 before the ink viscosity becomes too large so as to clear the nozzle orifice. But the ink viscosity depends on the kind and density of the wetting agent, dye and the like included within the ink. Although the ink viscosities of the various kinds of inks used in one ink jet recording apparatus may be different, the conventional ink jet recording apparatus gave absolutely no consideration as to the differences in the ink viscosities among the various kinds of inks.

If the viscosities of the various kinds of inks used in one ink jet recording apparatus are different, it is conceivable to spray ink from each nozzle in correspondence with each kind of ink. However, this conceivable method would require the ink to be sprayed frequently from each nozzle, thereby increasing the ink consumption and slowing down the recording speed. It is also conceivable to spray ink from the nozzle corresponding to the ink having the largest viscosity, but this conceivable method would also require a relatively large ink consumption, and the recording speed cannot be improved beyond a certain extent.

Next, a description will be given of a ninth embodiment of the ink jet recording apparatus according to the present invention which can eliminate the above inconveniences originating from the different viscosities of the various kinds of inks used. This ninth embodiment of the ink jet recording apparatus can use the ink cartridge shown in FIG. 2, and employs a ninth embodiment of the ink jet recording method according to the present invention. The construction of the ink jet recording apparatus may be the same as that shown in FIG. 1, and an illustration and description thereof will be omitted.

In this embodiment, the increases in the viscosities of the two or more kinds of inks used in one ink jet recording apparatus due to solvent evaporation are set approximately the same. As a result, the ink spray condition for the nozzle can be suppressed to a minimum because the increases in the viscosities of the two or more kinds of inks are approximately the same. In addition, it is possible to improve the recording speed, and also suppress the ink consumption.

In this embodiment, a liquid medium or solvent forming the ink jet recording liquid, that is, the ink, is made up of water and a mixture of water and one or more kinds of water-soluble organic solvents. For the organic solvent, it is possible to use monohydric alcohols such as methanol, ethanol, (normal) propyl alcohol and isopropyl alcohol, dihydric alcohols such as ethylene glycol, propylene glycol, butylene glycol, hexylene glycol, diethylene glycol and triethylene glycol, trihydric alcohols such as glycerin, polyalkylene glycols such as polyethylene glycol and polybutylene glycol, nitride-containing heterocyclic compounds such as N-methyl-2-pyrrolidone and 1,3-dimethyl-2-imidazolidinone, and subalkyl ether of polyhydric alcohols such as ethylene glycol monomethyl ether, diethylene glycol monomethyl ether and triethylene glycol monomethyl ether. Particularly, it is desirable to use polyhydric alcohols which have hygroscopicity and low evaporation.

The organic solvent content within the ink is 5 to 80 weight %, and is desirably within the range of 5 to 50 weight %. If the organic solvent content is less than 5 weight %, the ink may dry too fast and the solubility of the dye may decrease to more easily cause deposition of the dye within the ink, thereby more easily causing the nozzle to clog. On the other hand, if the organic solvent content exceeds 80 weight %, the viscosity of the ink becomes too high, thereby making it difficult to eject the ink from the nozzle of the head.

The basic composition of the ink used in this embodiment is as described above. However, it is of course possible to add other dispersing agent, cationic, anionic or nonionic surface-active agent and the like, viscosity adjusting agent such as polyvinyl alcohol, celluloses and water-soluble resins, and pH adjusting agent such as diethanol amine and triethanol amine if necessary.

The present inventors conducted experiments and measured the extents of the increases in the viscosities of the inks having the following compositions.

Ink IK1: 8% Black Dye+5% Diethylene Glycol+2% Additive+Remainder Water

Ink IK2: 8% Black Dye+15% Diethylene Glycol+2% Additive+Remainder Water

Ink IK3: 4% Black Dye+5% Diethylene Glycol+6% Ethanol+Remainder Water

Ink IK4: 3% Color Dye (Acid Blue 9)+10% Diethylene Glycol+3% Ethanol+2% Additive+Remainder Water The inks IK1 through IK4, 42 g (=42000 $mm^3$, specific gravity of approximately 1.04) each, were independently put into four petri dishes and released to normal temperature and humidity (25° C.60% RH) conditions so as to evaporate the solvent. Each petri dish had a diameter r=36.6 mm and a depth h=20 mm, and was designed to satisfy V/S=10 mm, where V $mm^3$ denotes the volume of the released ink within the petri dish and S $mm^2$ denotes the surface area of the released ink within the petri dish. Each ink in the petri dish was stirred at constant intervals of 24 hours, and the viscosity of each ink was measured on an E-type viscometer starting from the first day up to the twelfth day.

Figure 51:
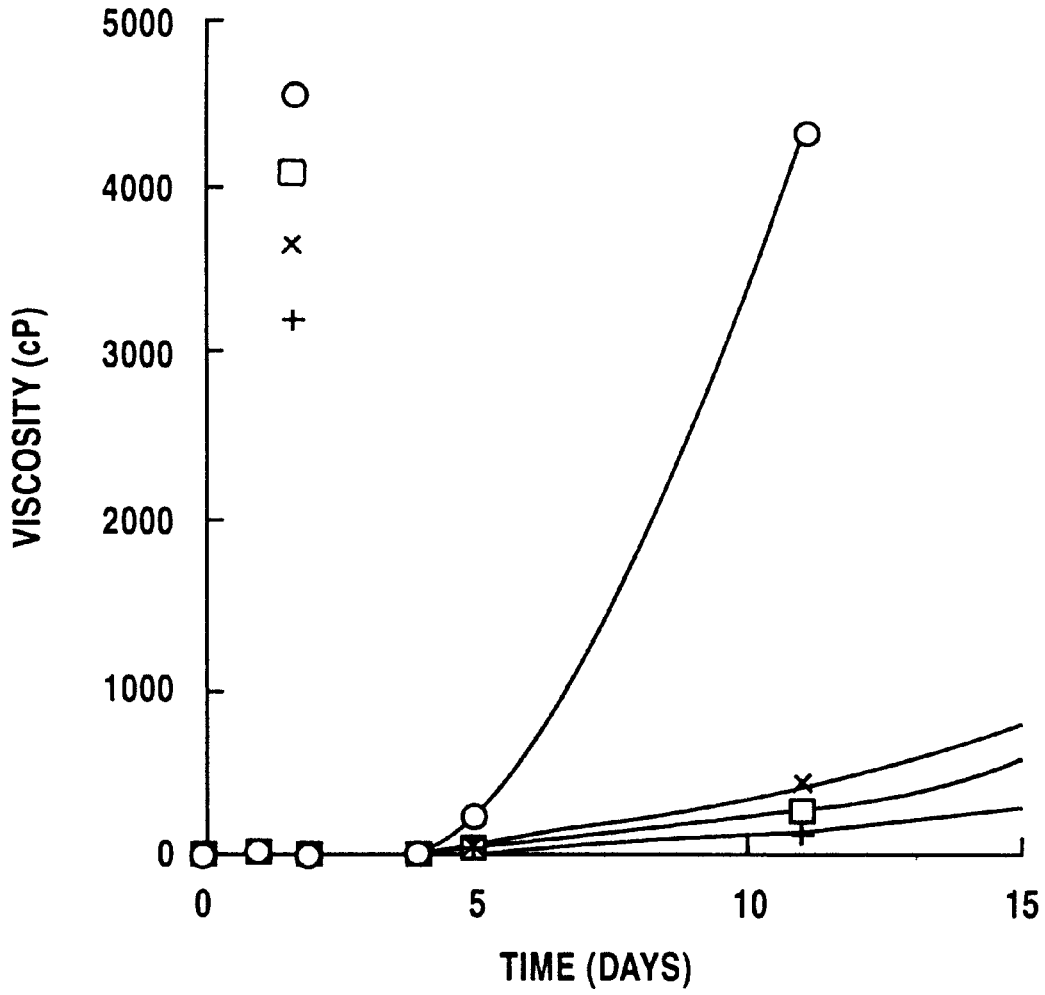
FIG. 51 is a diagram showing an increase of viscosity with respect to time for various kinds of inks.

As a result, was confirmed that the viscosity of each ink increases with time as shown in FIG. 51. In FIG. 51, the ordinate indicates the viscosity, and the abscissa indicates the time. In addition, the characteristics of the ink IK1 is indicated by a symbol "○", the ink IK2 by a symbol "□" the ink IK3 by a symbol "×", and the ink IK4 by a symbol "+". As may be seen from FIG. 51, the viscosity of the four inks IK1 through IK4 did not increase much up to the fourth day, however, considerably increase in the viscosity was found alter the fifth day. Furthermore, although the change in the viscosities of the inks IK2 through IK4 were 1000 cp or less and approximately the same, the viscosity of the ink IK1 increased considerably.

Figure 52:
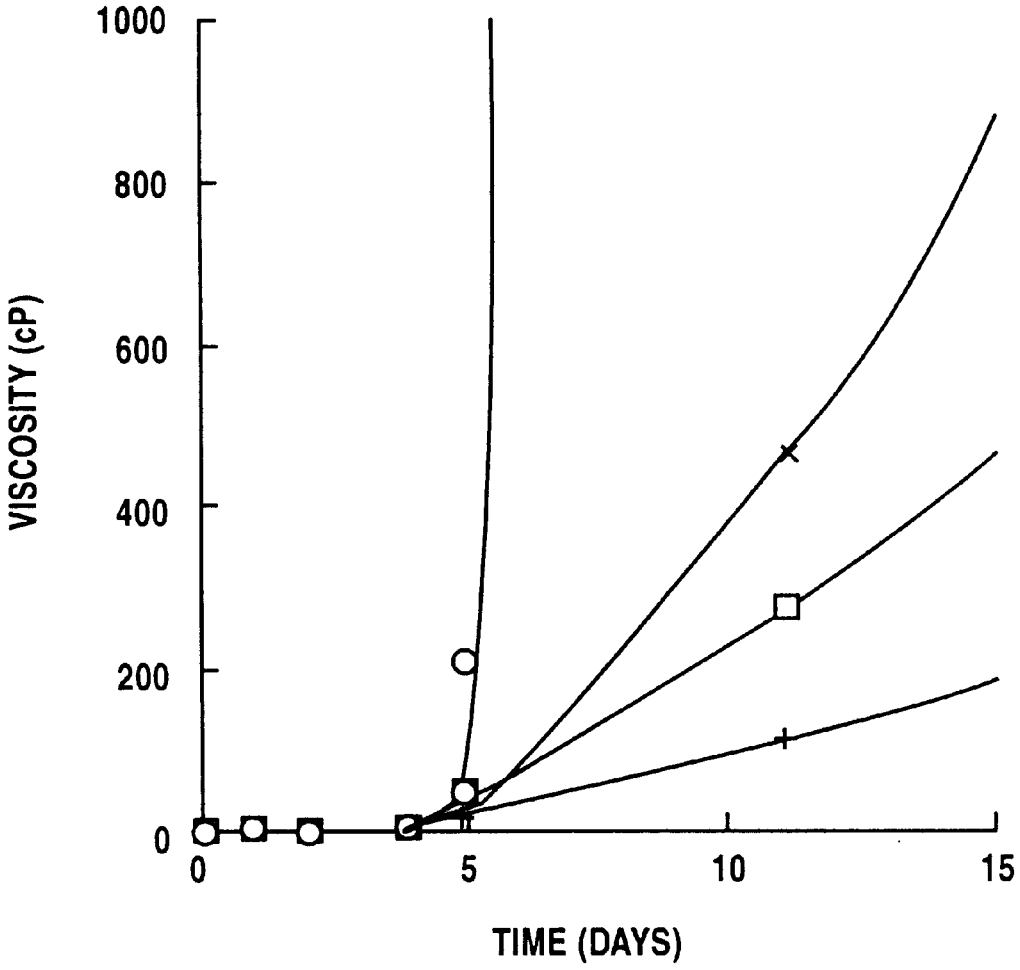
FIG. 52 is a diagram showing a portion of FIG. 51 on an enlarged scale.

The present inventors enlarged the scale of the ordinate in FIG. 51 and made a more detailed study of the viscosity of each ink, and the results shown in FIG. 52 were obtained. In FIG. 52, the same symbols are used as in FIG. 51 to indicate the characteristics of the inks IK1 through IK4. The present inventors actually carried out recordings using the inks IK1 through IK4, and studied the effects of the increases in the ink viscosities based on the results shown in FIGS. 51 and 52.

The recordings were made on the ink jet recording apparatus described above in conjunction with FIGS. 1 and 2 for the following cases (i) through (iii). In the case (i), the sequential recording was made using a combination of the inks IK1 and IK4 having a viscosity difference of 200 cp or greater after 5 days while spraying the ink from the nozzle at a rate of once in 20 seconds. In the case (ii), the sequential recording was made using a combination of the inks IK2 and IK4 having a viscosity difference of 200 cp or greater after 10 days while spraying the ink from the nozzle at a rate of once in 20 seconds. In the case (iii), the sequential recording was made using a combination of the inks IK3 and IK4 having a viscosity difference of 200 cp or greater after 7 days while spraying the ink from the nozzle at a rate of once in 20 seconds. The recording defect such as dropout was detected for each of the cases (i) through (iii). As a result, it was found that the recording defect occurs in the case (i), but that no recording defect occurs in the cases (ii) and (iii).

Figure 53:
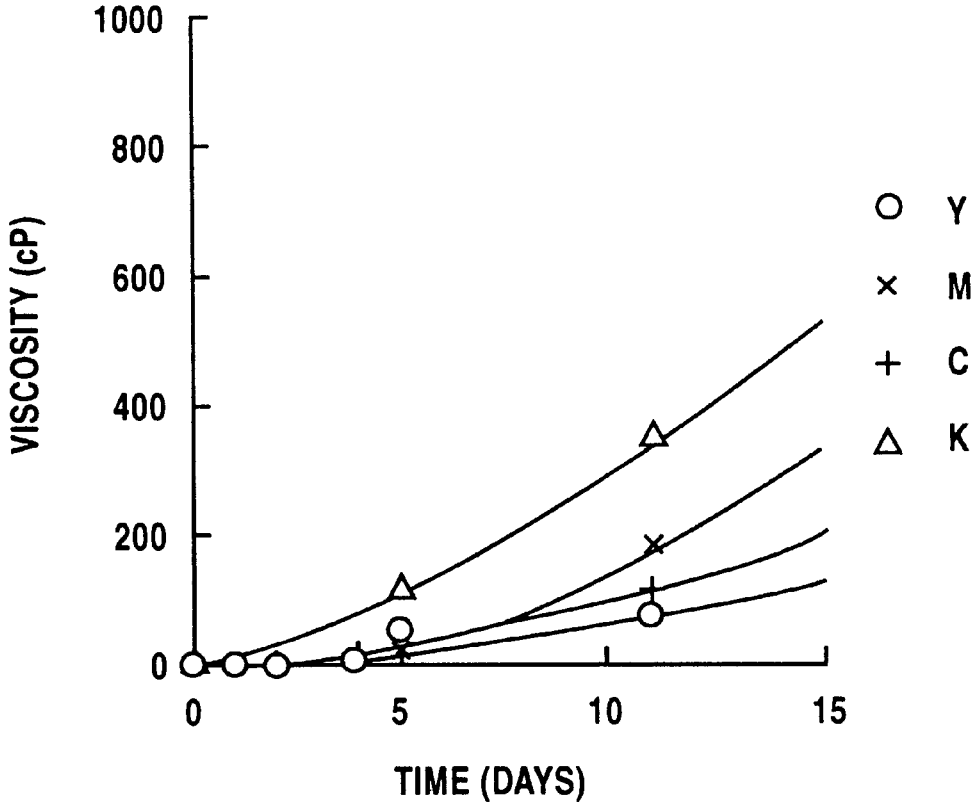
FIG. 53 is a diagram showing the increase of the viscosity with respect to time for four color inks.

Furthermore, the present inventors adjusted the compositions of yellow, magenta, cyan and black inks Y0, M0, C0 and K0 as shown below, so that the increases in the ink viscosities become approximately the same as shown in FIG. 53.

Yellow Ink Y0: 2% Yellow Dye+10% Diethylene Glycol+3% Ethanol+2% Additive+2% Adjusting Agent+Remainder Water Magenta Ink M0: 4% Red Dye+10% Diethylene Glycol+3% Ethanol+2% Additive+1% Adjusting Agent +Remainder Water Cyan Ink C0: 3% Blue Dye+10% Diethylene Glycol+3% Ethanol+2% Additive+Remainder Water Black Ink K0: 6% Black Dye+10% Diethylene Glycol+2% Additive+Remainder Water The sequential recording was made similarly as described above using a selected combination of the inks Y0, M0, C0 and K0 while spraying the ink from the nozzle at a rate of once in 20 seconds. It was also confirmed that a satisfactory recording can be made without introducing recording defects such as dropout. In FIG. 53, the ordinate indicates the viscosity measured under conditions similar to those described above, and the abscissa indicate the time. The characteristics of the yellow ink Y0 is indicated by a symbol "○", the magenta ink M0 by a symbol "×", the cyan ink C0 by a symbol "+", and the black ink K0 by a symbol "Δ".

Therefore, when carrying out the ink jet recording using inks of at least two or more colors, it was possible to continue normal recording even under the ink spray condition which sprays the ink only a minimum number of times, by setting the increases of the viscosities of the inks caused by evaporation of the solvent approximately the same value. It was also confirmed that the viscosity increases of the inks are such that the viscosity difference of the inks after 5 days is approximately 1000 cp, and is desirably within approximately 200 cp, when 42 g of each ink is independently put into a corresponding petri dish and released to normal temperature and humidity (25° C.60% RH) conditions so as to evaporate the solvent, where each petri dish has a diameter r=36.6 mm and a depth h=20 mm. In addition, it was also confirmed that each ink may be a water-soluble ink including the dye and the organic solvent, ink having dispersed pigment or the like.

In this embodiment, the compositions of the inks are adjusted so that the increases in the ink viscosities become approximately the same. However, in a modification of this embodiment, it is possible to adjust the compositions of the inks so that the viscosity difference of the inks falls within a predetermined range depending on the frequency with which each nozzle of the head which sprays the ink is used.

In other words, in order to carry out a high quality recording at a high speed on the ink jet recording apparatus, it is one approach to set the number of nozzles of the head to be used depending on the kind of image that is to be recorded. In this case, the recording can be carried out at the high speed as much as possible using a large number of nozzles when recording the line drawings such as characters, and the recording can be carried out with the high quality using a small number of nozzles when recording the general color image such as graphics. But the nozzles of each head will not be used uniformly in this case, and the waiting or standby time of the nozzles becomes different for each head. For example, if the small number m of nozzles of the head used to record the general image is m=16 and the large number n of nozzles of the head used to record the line drawing is n=128, the recording time for the general image is approximately n/m=8 times the recording time for the line drawing. Hence, in a modification of this embodiment, effects similar to those described above are obtained by adjusting the compositions of the inks so that the rate with which the viscosity of the ink supplied to the head having the small number of nozzles increases is approximately 8 times the rate with which the viscosity of the ink supplied to the head having the large number of nozzles increases.

On the other hand, in order to set the rates of the increases of the viscosities of the inks approximately the same, it is possible to (a) adjust the dye density, (b) adjust the solvent density, or (c) adjust the additive density, for example. According to the method (a), there is a possibility that the recording tone will decrease. According to the methods (b) and (c), there is a possibility that the initial ink viscosity ill increase and the fixing time will increase. However, according to the experiments conducted by the present inventors, it was confirmed that the increases in the viscosities of the inks can be adjusted within a range which introduces no problems from the practical point of view, even if one of the methods (a) through (c) is employed.

In each of the embodiments and modifications described above, the number of kinds of inks used, the compositions of the inks, the characteristics of the recording mediums and the like are of course not limited to those described above. In addition, the various combinations of the various kinds of inks and recording mediums may be used. Moreover, it is possible to appropriately combine a plurality of embodiments and/or modifications if necessary.

Further, the present invention is not limited to these embodiments, but various variations and modifications may be made without departing from the scope of the present invention.

What is claimed is:

1. An ink jet recording method which records an image on a recording medium by adhering inks of a plurality of hues on the recording medium, the ink jet recording method comprising the steps of:

(a) carrying out a recording using two kinds of inks having different diffusibilities with respect to the recording medium for at least a predetermined one of the hues, a first ink out of the two kinds of inks having a diffusibility which is lower than a diffusibility of a ink having a hue other than the predetermined hue; and (b) at a boundary portion on the recording medium where a first recording region which includes the predetermined hue and a second recording region which includes a hue different from the predetermined hue are adjacent to each other, recording at least a portion of the boundary portion with a predetermined recording width up to the second recording region using a second ink out of the two kinds of inks having a diffusibility higher than that of the first ink and recording a remaining portion of the boundary portion using the first ink, the second ink and inks of hues other than the predetermined hue having approximately the same diffusibility as the second ink have diffusibilities which are higher for hues with lower contrasts.

2. An ink jet recording method which records an image on a recording medium by adhering inks of a plurality of hues on the recording medium, the ink jet recording method comprising the steps of:

(a) carrying out a recording using two kinds of inks having different diffusibilities with respect to the recording medium for at least a predetermined one of the hues, a first ink out of the two kinds of inks having a diffusibility which is lower than a diffusibility of an ink having a hue other than the predetermined hue;

(b) at a boundary portion on the recording medium where a first recording region which includes the predetermined hue and a second recording region which includes a hue different from the predetermined hue are adjacent to each other, recording at least a portion of the boundary portion with a predetermined recording width up to the second recording region using a second ink out of the two kinds of inks having a diffusibility higher than that of the first ink and recording a remaining portion of the boundary portion using the first ink; and (c) recording the image using an ink of a hue having a first contrast with a priority over recording the image using an ink of a hue having a second contrast higher than the first contrast.

3. An ink jet recording method which records an image on a recording medium by adhering inks of a plurality of hues on the recording medium, the ink jet recording method comprising the steps of:

(a) carrying out a recording using two kinds of inks having different diffusibilities with respect to the recording medium for at least a predetermined one of the hues, a first ink out of the two kinds of inks having a diffusibility which is lower than a diffusibility of an ink having a hue other than the predetermined hue; and (b) at a boundary portion on the recording medium where a first recording region which includes the predetermined hue and a second recording region which includes a hue different from the predetermined hue are adjacent to each other, recording at least a portion of the boundary portion with a predetermined recording width up to the second recording region using a second ink out of the two kinds of inks having a diffusibility higher than that of the first ink and recording a remaining portion of the boundary portion using the first ink;

wherein said step (b) includes recording the image using the second ink before recording the image using the first ink when the remaining portion of the boundary portion is larger than the portion of the boundary portion with the predetermined recording width.

4. An ink jet recording method which records an image on a recording medium by adhering inks of a plurality of hues on the recording medium, the ink jet recording method comprising the steps of:

(a) carrying out a recording using two kinds of inks having different diffusibilities with respect to the recording medium for at least a predetermined one of the hues, a first ink out of the two kinds of inks having a diffusibility which is lower than a diffusibility of an ink having a hue other than the predetermined hue; and (b) at a boundary portion on the recording medium where a first recording region which includes the predetermined hue and a second recording region which includes a hue different from the predetermined hue are adjacent to each other, recording at least a portion of the boundary portion with a predetermined recording width up to the second recording region using a second ink out of the two kinds of inks having a diffusibility higher than that of the first ink and recording a remaining portion of the boundary portion using the first ink, wherein said step (b) includes recording the image using the first ink before recording the image using the second ink when the remaining portion of the boundary portion is smaller than the portion of the boundary with the predetermined recording width.

5. An ink jet recording method which records an image on a recording medium by adhering inks of a plurality of hues on the recording medium, the ink jet recording method comprising the steps of:

(a) carrying out a recording using two kinds of inks having different diffusibilities with respect to the recording medium for at least a predetermined one of the hues, a first ink out of the two kinds of inks having a diffusibility which is lower than a diffusibility of an ink having a hue other than the predetermined hue; and (b) at a boundary portion on the recording medium where a first recording region which includes the predetermined hue and a second recording region which includes a hue different from the predetermined hue are adjacent to each other, recording at least a portion of the boundary portion with a predetermined recording width up to the second recording region using a second ink out of the two kinds of inks having a diffusibility higher than that of the first ink and recording a remaining portion of the boundary portion using the first ink, wherein said step (b) includes recording the image using the first ink before recording the image using the second ink when the remaining portion of the boundary portion is smaller than the portion of the boundary with the predetermined recording width.

6. An ink jet recording method which records an image on a recording medium by adhering inks of a plurality of hues on the recording medium, the ink jet recording method comprising the steps of:

(a) carrying out a recording using two kinds of inks having different diffusibilities with respect to the recording medium for at least a predetermined one of the hues, a first ink out of the two kinds of inks having a diffusibility which is lower than a diffusibility of an ink having a hue other than the predetermined hue; and (b) at a boundary portion on the recording medium where a first recording region which includes the predetermined hue and a second recording region which includes a hue different from the predetermined hue are adjacent to each other, recording at least a portion of the boundary portion with a predetermined recording width up to the second recording region using a second ink out of the two kinds of inks having a diffusibility higher than that of the first ink and recording a remaining portion of the boundary portion using the first ink, wherein said step (b) comprises the substeps of:

recording the first recording region and the remaining portion of the boundary portion using the first ink; and recording the portion of the boundary portion with the predetermined recording width using the second ink a predetermined time after recording the first recording region and the remaining portion of the boundary region, said predetermined time being set longer than a conformance time of the first ink that is required with respect to the recording medium in order for the first ink to conform to the recording medium.

7. An ink jet recording method which records an image on a recording medium by adhering inks of a plurality of hues on the recording medium, the ink jet recording method comprising the steps of:

(a) carrying out a recording using two kinds of inks having different diffusibilities with respect to the recording medium for at least a predetermined one of the hues, a first ink out of the two kinds of inks having a diffusibility which is lower than a diffusibility of an ink having a hue other than the predetermined hue; and (b) at a boundary portion on the recording medium where a first recording region which includes the predetermined hue and a second recording region which includes a hue different from the predetermined hue are adjacent to each other, recording at least a portion of the boundary portion with a predetermined recording width up to the second recording region using a second ink out of the two kinds of inks having a diffusibility higher than that of the first ink and recording a remaining portion of the boundary portion using the first ink, wherein said predetermined recording width is adjusted based on at least one of an amount of inks used to record the boundary portion and diffusibilities of the inks.

8. An ink jet recording method which records an image on a recording medium by adhering inks of a plurality of hues on the recording medium, the ink jet recording method comprising the steps of:

(a) carrying out a recording using two kinds of inks having different diffusibilities with respect to the recording medium for at least a predetermined one of the hues, a first ink out of the two kinds of inks having a diffusibility which is lower than a diffusibility of an ink having a hue other than the predetermined hue; and (b) at a boundary portion on the recording medium where a first recording region which includes the predetermined hue and a second recording region which includes a hue different from the predetermined hue are adjacent to each other, recording at least a portion of the boundary portion with a predetermined recording width up to the second recording region using a second ink out of the two kinds of inks having a diffusibility higher than that of the first ink and recording a remaining portion of the boundary portion using the first ink, wherein the portion of the boundary portion with the predetermined recording width and the remaining portion of the boundary portion recorded as a result of said step (b) have approximately a same contrast or color saturation.

9. An ink jet recording method which records an image on a recording medium by adhering inks of a plurality of hues on the recording medium, the ink jet recording method comprising the steps of:

(a) carrying out a recording using two kinds of inks having different diffusibilities with respect to the recording medium for at least a predetermined one of the hues, a first ink out of the two kinds of inks having a diffusibility which is lower than a diffusibility of an ink having a hue other than the predetermined hue; and (b) at a boundary portion on the recording medium where a first recording region which includes the predetermined hue and a second recording region which includes a hue different from the predetermined hue are adjacent to each other, recording at least a portion of the boundary portion with a predetermined recording up to the second recording region using a second ink out of the two kinds of inks having a diffusibility higher than that of the first ink and recording a remaining portion of the boundary portion using the first ink, wherein said step (b) includes using the first ink and the second ink which include a same dye, and an amount of the dye included in the second ink is larger than an amount of the due included in the first ink.

10. An ink jet recording method which records as image on a recording medium by adhering inks of a plurality of hues on the recording medium, the ink jet recording method comprising the steps of:

(a) carrying out a recording using two kinds of inks having different diffusibilities with respect to the recording medium for at least a predetermined one of the hues, a first ink out of the two kinds of inks having a diffusibility which is lower than a diffusibility of an ink having a hue other than the predetermined hue; and (b) at a boundary portion on the recording medium where a first recording region which includes the predetermined hue and a second recording region which includes a hue different from the predetermined hue are adjacent to each other, recording at least a portion of the boundary portion with a predetermined recording width up to the second recording region using a second ink out of the two kinds of inks having a diffusibility higher than that of the first ink and recording a remaining portion of the boundary portion using the first ink, wherein the portion of the boundary portion with the predetermined recording width and the remaining portion of the boundary portion recorded as a result of said step (b) have approximately a same recording tone.

11. An ink jet recording method which records an image on a recording medium by adhering inks of a plurality of hues on the recording medium, the ink jet recording method comprising the steps of:

(a) carrying out a recording using two kinds of inks having different diffusibilities with respect to the recording medium for at least a predetermined one of the hues, a first ink out of the two kinds of inks having a diffusibility which is lower than a diffusibility of an ink having a hue other that the predetermined hue; and (b) at a boundary portion on the recording medium where a first recording region which includes the predetermined hue and a second recording region which includes a hue different from the predetermined hue are adjacent to each other, recording at least a portion of the boundary portion with a predetermined recording width up to the second recording region using a second ink out of the two kinds of inks having a diffusibility higher than that of the first ink and recording a remaining portion of the boundary portion using the first ink, wherein the portion of the boundary portion with the predetermined recording width and the remaining portion of the boundary portion recorded as a result of said step (b) have a recording tone difference of 0.3 (OD) or less.

12. The ink jet recording method as claimed in claim 11, wherein said step (b) includes using the second ink which includes an amount of dye larger than an amount of dye included in the first ink.

13. The ink jet recording method as claimed in claim 11, wherein an amount of the first ink adhered within the remaining portion of the boundary portion per unit area by said step (b) is larger than an amount of the second ink adhered within the portion of the boundary portion with the predetermined recording width per unit area.

14. An ink jet recording apparatus which records an image on a recording medium by adhering inks of a plurality of hues on the recording medium, two kinds of inks having different diffusibilities with respect to the recording medium being used for at least a predetermined one of the hues, a first ink out of the two kinds of inks having a diffusibility which is lower than a diffusibility of an ink having a hue other than the predetermined hue, said ink jet recording apparatus comprising:

a head portion having a plurality of heads corresponding to a number of kinds of inks used; and control means for controlling said head portion so that, at a boundary on the recording medium where a first recording region which includes the predetermined hue and a second recording region which includes a hue different from the predetermined hue are adjacent to each other, at least a portion of the boundary portion is recorded with a predetermined recording width up to the second recording region using a second ink out of the two kinds of inks having a diffusibility higher than that of the first ink and a remaining portion of the boundary portion is recorded using the first ink, wherein said head portion uses inks such that the second ink and inks of hues other than the predetermined hue having approximately the same diffusibility as the second ink have diffusibilities which are higher for hues with lower contrasts.

15. An ink jet recording apparatus which records an image on a recording medium by adhering inks of a plurality of hues on the recording medium, two kinds of inks having different diffusibilities with respect to the recording medium being used for at least a predetermined one of the hues, a first ink out of the two kinds of inks having a diffusibility which is lower than a diffusibility of an ink having a hue other than the predetermined hue, said ink jet recording apparatus comprising:

a head portion having a plurality of heads corresponding to a number of kinds of inks used; and control means for controlling said head portion so that, at a boundary portion on the recording medium where a first recording region which includes the predetermined hue and a second recording region which includes a hue different from the predetermined hue are adjacent to each other, at least a portion of the boundary portion is recorded with a predetermined recording width up to the second recording region using a second ink out of the two kinds of inks having a diffusibility higher than that of the first ink and a remaining portion of the boundary portion is recorded using the first ink, wherein said control means controls said head portion so as to record the image using an ink of a hue having a first contrast with a priority over recording the image using an ink of a hue having a second contrast higher than the first contrast.

16. An ink jet recording apparatus which records an image on a recording medium by adhering inks of a plurality of hues on the recording medium, two kinds of inks having different diffusibilities with respect to the recording medium being used for at least a predetermined one of the hues, a first ink out of the two kinds of inks having a diffusibility which is lower than a diffusibility of an ink having a hue other than the predetermined hue, said ink jet recording apparatus comprising:

a head portion having a plurality of heads corresponding to a number of kinds of inks used, and control means for controlling said head portion so that, at a boundary portion on the recording medium where a first recording region which includes the predetermined hue and a second recording region which includes a hue different from the predetermined hue are adjacent to each other, at least a portion of the boundary portion is recorded with a predetermined recording width up to the second recording region using a second ink out of the two kinds of inks having a diffusibility higher than that of the first ink and a remaining portion of the boundary portion is recorded using the first ink, wherein said control means controls said head portion to record the image using the second ink before recording the image using the first ink when the remaining portion of the boundary portion is larger than the portion of the boundary portion with the predetermined recording width.

17. An ink jet recording apparatus which records an image on a recording medium by adhering inks of a plurality of hues on the recording medium, two kinds of inks having different diffusibilities with respect to the recording medium being used for at least a predetermined one of the hues, a first ink out of the two kinds of inks having a diffusibility which is lower than a diffusibility of an ink having a hue other that the predetermined hue, said ink jet recording apparatus comprising:

a head portion having a plurality of heads corresponding to a number of kinds of inks used; and control means for controlling said head portion so that, at a boundary position on the recording medium where a first recording region which includes the predetermined hue and a second recording region which includes a hue different from the predetermined hue are adjacent to each other, at least a portion of the boundary portion is recorded with a predetermined recording width up to the second recording region using a second ink out of the two kinds of inks having a diffusibility higher than that of the first ink and a remaining portion of the boundary portion if recorded using the first ink, wherein said control means controls said head portion to record the image using the first ink before recording the image using the second ink when the remaining portion of the boundary portion is larger than the portion of the boundary portion with the predetermined recording width.

18. An ink jet recording apparatus which records an image on a recording medium by adhering inks of a plurality of hues on the recording medium, two kinds of inks having different diffusibilities with respect to the recording medium being used for at least a predetermined one of the hues, a first ink out of the two kinds of inks having a diffusibility which is lower than a diffusibility of an ink having a hue other than the predetermined hue, said ink jet recording apparatus comprising:

a head portion having a plurality of heads corresponding to a number of kinds of inks used; and control means for controlling said head portion so that, at a boundary portion on the recording medium where a first recording region which includes the predetermined hue and a second recording region which includes a hue different from the predetermined hue are adjacent to each other, at least a portion of the boundary portion is recorded with a predetermined recording width up to the second recording region using a second ink out of the two kinds of inks having a diffusibility higher than that of the first ink and a remaining portion of the boundary portion is recording using the first ink, wherein said control means controls said head portion to record the image using the first ink before recording the image using the second ink when the remaining portion of the boundary portion is smaller than the portion of the boundary portion with the predetermined recording width.

19. An ink jet recording apparatus which records an image on a recording medium by adhering inks of a plurality of hues on the recording medium, two kinds of inks having different diffusibilities with respect to the recording medium being used for at least a predetermined one of the hues, a first ink out of the two kinds of inks having a diffusibility which is lower than a diffusibility of an ink having a hue other than the predetermined hue, said ink jet recording apparatus comprising:

a head portion having a plurality of heads corresponding to a number of kinds of inks used; and control means for controlling said head portion so that, at a boundary portion on the recording medium where a first recording region which includes the predetermined hue and a second recording region which includes a hue different from the predetermined hue are adjacent to each other, at least a portion of the boundary portion is recorded with a predetermined recording width up to the second recording region using a second ink out of the two kinds of inks having a diffusibility higher than that of the first ink and a remaining portion of the boundary portion is recorded using the first ink, wherein said control means controls said head portion to record the first recording region and the remaining portion of the boundary portion using the first ink; and controls said head portion to record the portion of the boundary portion with the predetermined recording width using the second ink a predetermined time after recording the first recording region and the remaining portion of the boundary portion, said predetermined time being set longer than a conformance time of the first ink that is required with respect to the recording medium in order for the first ink to conform to the recording medium.

20. An ink jet recording apparatus which records an image on a recording medium by adhering inks of a plurality of hues on the recording medium, two kinds of inks having different diffusibilities with respect to the recording medium being used for a least a predetermined one of the hues, a first ink out of the two kinds of inks having a diffusibility which is lower than a diffusibility of an ink having a hue other than the predetermined hue, said ink jet recording apparatus comprising:

a head portion having a plurality of heads corresponding to a number of kinds of inks used; and control means for controlling said head portion so that, at a boundary portion on the recording medium where a first recording region which includes the predetermined hue and a second recording region which includes a hue different from the predetermined hue are adjacent to each other, at least a portion of the boundary portion is recorded with a predetermined recording width up to the second recording region using a second ink out of the two kinds of inks having a diffusibility higher than that of the first ink and a remaining portion of the boundary portion is recorded using the first ink, wherein said predetermined recording width is adjusted based on at least one of an amount of inks used to record the boundary portion and diffusibilities of the inks.

21. An ink jet recording apparatus which records an image on a recording medium by adhering inks of a plurality of hues on the recording medium, two kinds of inks having different diffusibilities with respect to the recording medium being used for a least a predetermined one of the hues, a first ink out of the two kinds of inks having a diffusibility which is lower than a diffusibility of an ink having a hue other than the predetermined hue, said ink jet recording apparatus comprising:

a head portion having a plurality of heads corresponding to a number of kinds of inks used; and control means for controlling said head portion so that, at a boundary portion on the recording medium where a first recording region which the predetermined hue and a second recording region which includes a hue different from the predetermined hue are adjacent to each other, at least a portion of the boundary portion is recorded with a predetermined recording width up to the second recording region using a second ink out of the two kinds of inks having a diffusibility higher than that of the first ink and a remaining portion of the boundary portion is recorded using the first ink, wherein the portion of the boundary portion with the predetermined recording width and the remaining portion of the boundary portion recorded by said head portion have approximately a same contrast or color saturation.

22. An inkjet recording apparatus which records an image on a recording medium by adhering inks of a plurality of hues on the recording medium, two kinds of inks having different diffusibilities with respect to the recording medium being used for at least a predetermined one of the hues, a first ink out of the two kinds of inks having a diffusibility which is lower than a diffusibility of an ink having a hue other than the predetermined hue, said ink jet recording apparatus comprising:

a head portion having a plurality of heads corresponding to a number of kinds of inks used; and control means for controlling said head portion so that, at a boundary portion on the recording medium where a first recording region which the predetermined hue and a second recording region which includes a hue different from the predetermined hue are adjacent to each other, at least a portion of the boundary portion is recorded with a predetermined recording width up to the second recording region using a second ink out of the two kinds of inks having a diffusibility higher than that of the first ink and a remaining portion of the boundary portion is recorded using the first ink, wherein said head portion uses the first ink and the second ink which include a same dye, and an amount of the dye included in the second ink is larger than an amount of the dye included in the first ink.

23. An ink jet recording apparatus which records an image on a recording medium by adhering inks of a plurality of hues on the recording medium, two kinds of inks having different diffusibilities with respect to the recording medium being used for at least a predetermined one of the hues, a first ink out of the two kinds of inks having a diffusibility which is lower than a diffusibility of an ink having a hue other than the predetermined hue, said ink jet recording apparatus comprising:

a head portion having a plurality of heads corresponding to a number of kinds of inks used; and control means for controlling said head portion so that, at a boundary portion on the recording medium where a first recording region which includes the predetermined hue and a second recording region which includes a hue different from the predetermined hue are adjacent to each other, at least a portion of the boundary portion is recorded with a predetermined recording width up to the second recording region using a second ink out of the two kinds of inks having a diffusibility higher than that of the first ink and a remaining portion of the boundary portion is recorded using the first ink, wherein the portion of the boundary portion with the predetermined recording width and the remaining portion of the boundary portion recorded by said head portion have approximately a same recording tone.

24. An ink jet recording apparatus which records an image on a recording medium by adhering inks of a plurality of hues on the recording medium, two kinds of inks having different diffusibilities with respect to the recording medium being used for at least a predetermined one of the hues, a first ink out of the two kinds of inks having a diffusibility which is lower than a diffusibility of an ink having a hue other than the predetermined hue, said ink jet recording apparatus comprising:

a head portion having a plurality of heads corresponding to a number of kinds of inks used; and control means for controlling said head portion so that, at a boundary portion on the recording medium where a first recording region which includes the predetermined hue and a second recording region which includes a hue different from the predetermined hue are adjacent to each other, at least a portion of the boundary portion is recorded with a predetermined recording width up to the second recording region using a second ink out of the two kinds of inks having a diffusibility higher than that of the first ink and a remaining portion of the boundary portion is recorded using the first ink, wherein the portion of the boundary portion with the predetermined recording width and the remaining portion of the boundary portion recorded by said head portion have a recording tone difference of 0.3 (OD) or less.

25. The ink jet recording apparatus as claimed in claim 24, wherein said head portion uses the second ink which includes an amount of dye larger than an amount of dye included in the first ink.

26. The ink jet recording apparatus as claimed in claim 24, wherein an amount of the first ink adhered within the remaining portion of the boundary portion per unit area by said head portion is larger than an amount of the second ink adhered within the portion of the boundary portion with the predetermined recording width per unit area.

27. A combination including an ink cartridge which stores a first ink of a predetermined hue which is used together with inks of a plurality of hues when making an ink jet recording by an ink jet recording apparatus which records an image on a recording medium by adhering the inks on the recording medium, said ink jet recording apparatus comprising a head portion having a plurality of heads corresponding to a number of kinds of inks used, and control means for controlling said head portion so that, at a boundary portion on the recording medium where a first recording region which includes the predetermined hue and a second recording region which includes a hue different from the predetermined hue are adjacent to each other, at least a portion of the boundary portion is recorded with a predetermined recording width up to the second recording region using a second ink of the predetermined hue having a diffusibility higher than that of the first ink and a remaining portion of the boundary portion is recorded using the first ink, said combination comprising:

the inks of the plurality of hues;

a cartridge body; for said ink cartridge and the first ink of the predetermined hue stored within said cartridge body, said first ink having a diffusibility with respect to the recording medium lower than diffusibilities of the inks of the plurality of hues, and a contrast which is lower than contrasts of the inks of the plurality of hues.

28. The combination as claimed in claim 27, wherein the predetermined hue is black.

29. The combination as claimed in claim 27, wherein the first ink includes a dye used in the inks of the plurality of hues.

30. The combination as claimed in claim 27, wherein an amount of dye included in the first ink is larger than an amount of dye included in each of the inks of the plurality of hues.

31. A combination including an ink cartridge which stores a first ink of a predetermined hue which is used together with a black ink when making an ink jet recording by an ink jet recording apparatus which records an image on a recording medium by adhering the inks on the recording medium, said ink jet recording apparatus comprising a head portion having a plurality of heads corresponding to a number of kinds of inks used, and control means for controlling said head portion so that, at a boundary portion on the recording medium where a first recording region which includes the predetermined hue and a second recording region which includes a hue different from the predetermined hue are adjacent to each other, at least a portion of the boundary portion is recorded with a predetermined recording width up to the second recording region using a second ink of the predetermined hue having a diffusibility higher than that of the first ink and a remaining portion of the boundary portion is recorded using the first ink, said combination comprising:

the black ink;

a cartridge body; for said ink cartridge and the first ink of the predetermined hue stored within said cartridge body, said first ink having a diffusibility with respect to the recording medium higher than a diffusibility of the black ink, and a contrast which is higher than a contrast of the black ink.

32. The combination as claimed in claim 31, wherein the first ink is selected from a group consisting of black, yellow, magenta and cyan.

33. The combination as claimed in claim 31, wherein the first ink includes a black dye and a contrast identical to those of the black ink.

34. The combination as claimed in claim 31, wherein the first ink includes an amount of dye larger than an amount of dye included in the black ink.

35. A combination including an ink of a predetermined hue which is used together with a black ink when making an ink jet recording by an ink jet recording apparatus which records an image on a recording medium by adhering the inks on the recording medium, said ink jet recording apparatus comprising a head portion having a plurality of heads corresponding to a number of kinds of inks used, and control means for controlling said head portion so that, at a boundary portion on the recording medium where a first recording region which includes the predetermined hue and a second recording region which includes a hue different from the predetermined hue are adjacent to each other, at least a portion of the boundary portion is recorded with a predetermined recording width up to the second recording region using another ink of the predetermined hue having a diffusibility higher than that of the ink of the predetermined hue and a remaining portion of the boundary portion is recorded using the ink of the predetermined hue, said combination comprising:

said black ink; and said ink of predetermined hue, including a dye; and a solvent, a diffusibility of the ink of the predetermined hue with respect to the recording medium being higher than a diffusibility of the black ink, said ink of the predetermined hue having a contrast which is higher than a contrast of the black in.

36. The combination as claimed in claim 35, wherein the ink of the predetermined hue is selected from a group consisting of black, yellow, magenta and cyan.

37. The combination as claimed in claim 35, wherein said dye of the ink of the predetermined hue include a black dye and a contrast identical to those of the black ink.

38. The combination as claimed in claim 35, wherein the ink of the predetermined hue includes an amount of dye larger than an amount of dye included in the black ink.

* * * * *